US007842142B1

(12) United States Patent
Kusumi et al.

(10) Patent No.: US 7,842,142 B1
(45) Date of Patent: Nov. 30, 2010

(54) HIGH STRENGTH PART AND METHOD FOR PRODUCING THE SAME

(75) Inventors: Kazuhisa Kusumi, Chiba-Ken (JP); Hironori Sato, Chiba-Ken (JP); Masayuki Abe, Chiba-Ken (JP); Nobuhiro Fujita, Chiba-Ken (JP); Noriyuki Suzuki, Chiba-Ken (JP); Kunio Hayashi, Chiba-Ken (JP); Shinya Nakajima, Chiba-Ken (JP); Jun Maki, Chiba-Ken (JP); Masahiro Oogami, Chiba-Ken (JP); Toshiyuki Kanda, Chiba-Ken (JP); Manabu Takahashi, Chiba-Ken (JP); Yuzo Takahashi, Chiba-Ken (JP)

(73) Assignee: Nippon Steel Corporation, Chiyoda-ku, Tokyo (JP)

( * ) Notice: Subject to any disclaimer, the term of this patent is extended or adjusted under 35 U.S.C. 154(b) by 430 days.

(21) Appl. No.: 11/575,344

(22) PCT Filed: Sep. 15, 2005

(86) PCT No.: PCT/JP2005/017441

§ 371 (c)(1),
(2), (4) Date: Mar. 15, 2007

(87) PCT Pub. No.: WO2006/030971

PCT Pub. Date: Mar. 23, 2006

(30) Foreign Application Priority Data

| | | |
|---|---|---|
| Sep. 15, 2004 | (JP) | 2004-267792 |
| Sep. 15, 2004 | (JP) | 2004-267795 |
| Sep. 15, 2004 | (JP) | 2004-267797 |
| Oct. 25, 2004 | (JP) | 2004-309779 |

(51) Int. Cl.
*C21D 8/00* (2006.01)

(52) U.S. Cl. ..... 148/531; 148/533; 148/634; 148/650

(58) Field of Classification Search ..... None
See application file for complete search history.

(56) References Cited

U.S. PATENT DOCUMENTS

| | | | | |
|---|---|---|---|---|
| 3,774,435 | A * | 11/1973 | Wales et al. | 72/331 |
| 4,211,584 | A * | 7/1980 | L'Hermite et al. | 148/508 |
| 4,309,890 | A * | 1/1982 | Ichikawa et al. | 72/368 |
| 4,437,947 | A * | 3/1984 | Saito et al. | 205/50 |

(Continued)

FOREIGN PATENT DOCUMENTS

GB 1 532 641 11/1978

(Continued)

OTHER PUBLICATIONS

Machine translation of JP 2004-124221, obtained from www4.ipdl.inpit.go.jp.*

(Continued)

*Primary Examiner*—George Wyszomierski
(74) *Attorney, Agent, or Firm*—Dorsey & Whitney LLP

(57) ABSTRACT

High-strength parts and a method for producing them can be provided, where such parts exhibit hydrogen embrittlement resistance and strength after high-temperature forming. For example, the atmosphere in a heating furnace can contain less than about 10% hydrogen and/or have a dew point of about 30° C. or less. The amount of hydrogen penetrating a steel sheet during heating can thereby be reduced. After forming, quench hardening in a die assembly and post-working can be performed. Post-working can include shearing followed by re-shearing or compression forming; punching with a cutting blade having a continuously reduced base width; punching with a tool having a curved blade and a protrusion at the tip of the cutting blade, where the curved blade may include a shoulder portion of given radius and/or angle; fusion cutting; etc. Tensile residual stresses after punching can be reduced and resistance to hydrogen embrittlement can be improved.

32 Claims, 25 Drawing Sheets

U.S. PATENT DOCUMENTS

| | | | | |
|---|---|---|---|---|
| 4,992,113 | A * | 2/1991 | Baldo et al. | 148/208 |
| 6,309,482 | B1 * | 10/2001 | Dorricott et al. | 148/654 |
| 6,410,163 | B1 * | 6/2002 | Suzuki et al. | 428/659 |
| 2006/0057417 | A1 * | 3/2006 | Tada et al. | 428/612 |

FOREIGN PATENT DOCUMENTS

| | | |
|---|---|---|
| JP | 1128915 | 1/1989 |
| JP | 475622 | 7/1992 |
| JP | 06238361 | 8/1994 |
| JP | 07214193 | 8/1995 |
| JP | 10263720 | 10/1998 |
| JP | 11333530 | 12/1999 |
| JP | 2000 301220 | 10/2000 |
| JP | 2002339054 | 11/2002 |
| JP | 2003 138343 | 5/2003 |
| JP | 2003 181549 | 7/2003 |
| JP | 2004 027290 | 1/2004 |
| JP | 2004 083927 | 3/2004 |
| JP | 2004 124221 | 4/2004 |
| JP | 2004 176181 | 6/2004 |
| KR | 20040058830 | 7/2004 |
| WO | WO 97/40196 | 10/1997 |
| WO | WO 2006/006742 | 1/2006 |

OTHER PUBLICATIONS

Office Action of associated Korean Patent Application No. 9-5-2008-056937565.

Japanese language International Search Report for PCT/JP2005/017441 International filing date Sep. 15, 2005 and Priority date Sep. 15, 2004.

Supplementary European Search Report for associated European Patent Application No. 05785864.9.

* cited by examiner

HIGH STRENGTH PART AND METHOD FOR PRODUCING THE SAME

CROSS-REFERENCE TO RELATED APPLICATION(S)

This application is a national stage application of PCT Application No. PCT/JP2005/017441 which was filed on Sep. 15, 2005 and published on Mar. 23, 2006 as International Publication No. WO 2006/030971, the entire disclosure of which is incorporated herein by reference. This application claims priority from the International Application pursuant to 35 U.S.C. §365, and from Japanese Patent Application No. 2004-267797 filed Sep. 15, 2004, Japanese Patent Application No. 2004-267795 filed Sep. 15, 2004, Japanese Patent Application No. 2004-267792 filed Sep. 15, 2004, and Japanese Patent Application No. 2004-309779 filed Oct. 25, 2004, under 35 U.S.C. §119, the entire disclosures of which are incorporated herein by reference.

FIELD OF THE INVENTION

The present invention relates to members in which high strength is required, such as structural or reinforcing members which maybe used in an automobile, and more particularly to a part or component having superior strength after high temperature shaping, and methods for producing the same.

BACKGROUND INFORMATION

To lighten the weight of automobiles, which may have a beneficial effect on global environmental problems, it can be desirable to make the steel used in automobiles as high in strength as possible. However, steel sheet having a high strength may often exhibit a reduced elongation or r values and lower formability. One approach to solve this problem relates to a technique for hot shaping steel and utilizing the heat to raise the strength, which is described, e.g., in Japanese Patent Publication (A) No. 2000-234153. This technique includes suitably controlling the steel composition, heating the steel in the ferrite temperature region, and utilizing precipitation hardening in that temperature region to increase strength.

Further, it has be proposed to provide a high strength steel sheet having a yield strength that is greatly reduced at a shaping temperature to a value much lower than the yield strength at ordinary temperature, which may improve precision of press-forming as described, e.g., in Japanese Patent Publication (A) No. 2000-87183. However, such techniques may be limited with respect to the strength that can be obtained. Alternatively, a high strength may be obtained by heating steel to a high-temperature single-phase austenite region after shaping and, in a subsequent cooling process, transforming the steel to a hard phase as described, e.g., in Japanese Patent Publication (A) No. 2000-38640.

However, heating and rapid cooling after shaping may lead to problems in obtaining shape precision. Techniques which may be used to address this issue by heating steel sheet to a single-phase austenite region and cooling the steel in the subsequent press-forming process are described, e.g., in SAE, 2001-01-0078 and in Japanese Patent Publication (A) No. 2001-181833.

When processing high-strength steel sheet which may be used, for example, automobiles etc., formability (or shapeability) can be more significantly reduced at higher strengths. For example, a member having a high strength, e.g., of over 1000 MPa, may exhibit undesirable hydrogen embrittlement (which may also be referred to as season cracking or delayed fracture). When such materials are used as hot-press steel sheet, there may be little residual stress due to the high temperature pressing, but hydrogen may enters the steel at the time of heating before pressing. Further, residual stress associated with subsequent working can lead to greater susceptibility to hydrogen embrittlement. Therefore, merely pressing at a high temperature may not solve such problems. It may be desirable to optimize process conditions for the heating process and for subsequent integrated processes.

To reduce residual stress in shearing and other post-processing operations, it may be sufficient to provide a reduced strength of the parts to be post-processed. Techniques for lowering the cooling rate of material regions to be post-processed, so as to reduce hardening and thereby lower strength in these regions, are described, e.g., in Japanese Patent Publication (A) No. 2003-328031. When using such techniques, the strength of certain portions of a workpiece may be lowered, which can in turn allow for easier shearing or other post-processing mechanisms. However, the mold structure may become complicated—which can be economically disadvantageous. Further, hydrogen embrittlement is not alluded to at all in this reference. Thus, even if the steel sheet strength can be reduced somewhat and the residual stress after post-processing may also be reduced to a certain extent, hydrogen embrittlement may still occur if hydrogen remains in the steel.

Thus, there may be a need for improved high-strength materials and methods for providing them which overcome the above-mentioned deficiencies.

SUMMARY OF EXEMPLARY EMBODIMENTS OF THE INVENTION

One object of the present invention is to address the problems described above and to provide high-strength parts which may be superior in resistance to hydrogen embrittlement and which may exhibit a strength of about 1200 MPa or more after high-temperature shaping, and to provide methods for production of such parts.

For example, hydrogen embrittlement may be suppressed by controlling an atmosphere in the heating furnace before shaping so as to reduce the amount of hydrogen in the steel, and then reduce or eliminate residual stress using post-processing techniques. For example, exemplary embodiments of the present invention can include the following features:

(1) A method of producing a high-strength part characterized by providing steel sheet containing, by wt %, C: about 0.05 to 0.55%, and Mn: about 0.1 to 3% in chemical composition; heating the steel sheet in an atmosphere containing, by volume percent, hydrogen in an amount of about 10% or less (where the amount of hydrogen may be 0%), where the atmosphere may have a dew point of about 30° C. or less between the Ac3 temperature and the melting point; starting a shaping of the steel sheet at a temperature higher than the temperature at which ferrite, pearlite, bainite, and martensite transformations occur; cooling and hardening the steel after shaping in a mold to produce a high-strength part; and performing further post-processing of the part.

(2) A method of producing a high-strength part characterized by providing steel sheet containing, by wt %, C: about 0.05 to 0.55%, and Mn: about 0.1 to 3% and having a balance of Fe and unavoidable impurities in chemical composition; heating the steel sheet in an atmosphere containing, by volume percent, hydrogen in an amount of about 10% or less (where the amount of hydrogen may be 0%), where the atmosphere may have a dew point of about 30° C. or less and can be at a temperature between the Ac3 temperature and the melting point; starting a shaping of the steel sheet at a temperature higher than the temperature where ferrite, pearlite, bainite, and martensite transformations occur; cooling and hardening the steel after shaping in a mold to produce a high-strength part; shearing it; and shearing it again about 1 to 2000 μm from a worked end.

(3) A method of producing a high-strength part characterized by providing steel sheet containing, by wt %, C: about 0.05 to 0.55%, and Mn: about 0.1 to 3% and having a balance of Fe and unavoidable impurities in chemical composition; heating the steel sheet in an atmosphere with an amount of hydrogen in an amount of about 10% or less (where the amount of hydrogen may be 0%), where the atmosphere may have a dew point of about 30° C. or less and can be at a temperature between the Ac3 temperature and the melting point; starting a shaping of the steel sheet at a temperature higher than the temperature where ferrite, pearlite, bainite, and martensite transformations occur; cooling and hardening the steel after shaping in a mold to produce a high strength part; and then shearing and pressing the sheared end face.

(4) A method of producing a high-strength part as described in paragraph (3) above, where pressing is performed by coining.

(5) A method of producing a high-strength part characterized by providing steel sheet containing, by wt %, C: about 0.05 to 0.55% and Mn: about 0.1 to 3% and having a balance of Fe and unavoidable impurities in chemical composition; heating the steel sheet in an atmosphere containing, by volume percent, hydrogen in an amount of about 10% or less (where the amount of hydrogen may be 0%), where the atmosphere may have a dew point of about 30° C. or less and can be at a temperature between the Ac3 temperature and the melting point; then starting a shaping of the steel sheet at a temperature higher than the temperature where ferrite, pearlite, bainite, and martensite transformations occur; cooling and hardening the steel after shaping in a mold to produce a high-strength part; and punching or cutting the part using a cutting blade having a step difference which continuously decreases from a radius of curvature or width of the blade base by about 0.01 to 3.0 mm in the direction from the blade base to the blade tip, and having a height of about half the thickness of the steel sheet up to about 100 mm to be used for the punching or cutting.

(6) A method of producing a high-strength part as described in paragraph (5) above, characterized by having a step difference which continuously decreases from a radius of curvature or width of the blade base by about 0.01 to 3.0 mm in the direction from the blade base to the blade tip, and having a D/H ratio of about 0.5 or less, where H can refer to a height of the step difference, and D can refer to a difference of a radius of curvature or width between a blade base and blade tip.

(7) A method of producing a high-strength part characterized by using steel sheet containing, by wt %, C: about 0.05 to 0.55% and Mn: about 0.1 to 3%, and having a balance of Fe and unavoidable impurities in chemical composition; heating the steel sheet in an atmosphere containing, by volume percent, hydrogen in an amount of about 10% or less (where the amount of hydrogen may be 0%), where the atmosphere may have a dew point of about 30° C. or less and can be at a temperature between the Ac3 temperature and the melting point; starting a shaping of the steel sheet at a temperature higher than a temperature where ferrite, pearlite, bainite, and martensite transformations occur; cooling and hardening the steel after shaping in a mold to produce a high-strength part; then punching the steel sheet forming the worked material using a die and punch to cut it into shearing and sheared parts, thereby forming the worked material to a predetermined shape using a punching tool having a bending blade which includes a shape projecting out at a front of the punch and/or die, where a radius of curvature of the shoulder of the bending blade is about 0.2 mm or more, thus providing a clearance of about 25% or less.

(8) A method of producing a high-strength part characterized by providing steel sheet containing, by wt %, C: about 0.05 to 0.55%, and Mn: about 0.1 to 3%, and having a balance of Fe and unavoidable impurities in chemical composition; heating the steel sheet in an atmosphere containing, by volume percent, hydrogen in an amount of about 10% or less (where the amount of hydrogen may be 0%), where the atmosphere may have a dew point of about 30° C. or less and can be at a temperature between the Ac3 temperature and the melting point; starting a shaping of the steel at a temperature higher than the temperature where ferrite, pearlite, bainite, and martensite transformations occur; cooling and hardening the steel after shaping in a mold to produce a high-strength part; then punching the steel sheet forming the worked material using a die and punch to cut it to shearing and sheared parts to form the worked material to a predetermined shape, using a punching tool having a shape projecting out at the front of the punch and/or die and having an angle of the shoulder of the bending blade of about 100° to 170° to provide a clearance of about 25% or less.

(9) A method of producing a high strength part characterized by using steel sheet containing, by wt %, C: about 0.05 to 0.55% and Mn: about 0.1 to 3%, and having a balance of Fe and unavoidable impurities in chemical composition; heating the steel sheet in an atmosphere containing, by volume percent, hydrogen in an amount of about 10% or less (where the amount of hydrogen may be 0%), where the atmosphere may have a dew point of about 30° C. or less and can be at a temperature between the Ac3 temperature and the melting point; starting a shaping of the steel at a temperature higher than the temperature where ferrite, pearlite, bainite, and martensite transformations occur; cooling and hardening the steel after shaping in a mold to produce a high-strength part; then punching the steel sheet to form the worked material, using a die and punch to cut it into a shearing part and a sheared part, thereby forming the worked material into a predetermined shape using a punching tool having a bending blade, where the blade has a shape projecting out at the front of the punch and/or die, and where a shoulder of the bending blade has a radius of curvature of about 0.2 mm or more and an angle of about 100° to 170° to make the clearance about 25% or less.

(10) A method of producing a high-strength part characterized by using steel sheet containing, by wt %, C: about 0.05 to 0.55% and Mn: about 0.1 to 3%, and having a balance of Fe and unavoidable impurities in chemical composition, heating the steel sheet in an atmosphere containing, by volume percent, hydrogen in an amount of about 10% or less (where the amount of hydrogen may be 0%), where the atmosphere may have a dew point of about 30° C. or less and can be at a temperature between the Ac3 temperature and the melting point; then starting a press-forming of the steel at a temperature higher than the temperature where ferrite, pearlite, bainite, and martensite transformations occur; and cooling and hardening the steel after shaping in a mold to produce a high-strength part, and applying a shearing near a bottom dead point during the cooling and hardening.

(11) A method of producing a high strength part characterized by using steel sheet containing, by wt %, C: about 0.05 to 0.55% and Mn: about 0.1 to 3%, and having a balance of Fe and unavoidable impurities in chemical composition; heating the steel sheet in an atmosphere containing, by volume percent, hydrogen in an amount of about 10% or less, where the atmosphere may have a dew point of about 30° C. or less and can be at a temperature between the Ac3 temperature and the melting point; starting a shaping of the steel at a temperature higher than the temperature where ferrite, pearlite, bainite, and martensite transformations occur; cooling and hardening the steel after shaping in a mold to produce a high-strength part; and then melting a portion of the part to cut it.

(12) A method of production of a high strength part as set forth in paragraph (11) above, characterized by using a laser to melt a portion of the part to cut it.

(13) A method of production of a high strength part as set forth in paragraph (11) above, characterized by using a plasma cutting technique to melt a portion of the part to cut it.

(14) A method of producing a high-strength part characterized by using steel sheet containing, by wt %, C: about 0.05 to 0.55% and Mn: about 0.1 to 3%, and having a balance of Fe and unavoidable impurities in chemical composition; heating the steel sheet in an atmosphere containing, by volume percent, hydrogen in an amount of about 10% or less, where the atmosphere may have a dew point of about 30° C. or less and can be at a temperature between the Ac3 temperature and the melting point; starting a shaping of the steel at a temperature higher than the temperature where ferrite, pearlite, bainite, and martensite transformations occur; cooling and hardening the steel after shaping in a mold to produce a high-strength part; and then machining the part to perforate it or to cut around the part.

(15) A method of producing a high-strength part characterized by using steel sheet containing, by wt %, C: about 0.05 to 0.55% and Mn: about 0.1 to 3%, and having a balance of Fe and unavoidable impurities in chemical composition; heating the steel sheet in an atmosphere containing, by volume percent, hydrogen in an amount of about 10% or less, where the atmosphere may have a dew point of about 30° C. or less and can be at a temperature between the Ac3 temperature and the melting point; starting a shaping of the steel at a temperature higher than the temperature where ferrite, pearlite, bainite, and martensite transformations occur; cooling and hardening the steel after shaping in a mold to produce a high-strength part; then shearing and mechanically differentially cutting a cut surface of the sheared part to remove a thickness of about 0.05 mm or more.

(16) A method of producing a high-strength part as set forth in any one of paragraphs (1) to (15) above, characterized in that the chemical composition of the steel sheet is, by wt %, C: about 0.05 to 0.55%, Mn: about 0.1 to 3%, Al: about 0.005 to 0.1%, S: about 0.02% or less, P: about 0.03% or less, and N: about 0.01% or less, and the balance being Fe and unavoidable impurities.

(17) A method of producing a high-strength part as set forth in any one of paragraphs (1) to (15) above, characterized in that the chemical composition of said steel sheet is, by wt %, C: about 0.05 to 0.55%, Mn: about 0.1 to 3%, Si: about 1.0% or less, Al: about 0.005 to 0.1%, S: about 0.02% or less, P: about 0.03% or less, Cr: about 0.01 to 1.0%, and N: about 0.01% or less, and the balance being Fe and unavoidable impurities.

(18) A method of production of a high strength part as set forth in any one of paragraphs (1) to (15) above, characterized in that the chemical composition of said steel sheet is, by wt %, C: about 0.05 to 0.55%, Mn: about 0.1 to 3%, Si: about 1.0% or less, Al: about 0.005 to 0.1%, S: about 0.02% or less, P: about 0.03% or less, Cr: about 0.01 to 1.0%, B: about 0.0002% to 0.0050%, Ti: between about (3.42×N+0.001) % and about 3.99×(C−0.1) %, and N: about 0.01% or less, and the balance being Fe and unavoidable impurities.

(19) A method of producing a high-strength part as set forth in any one of paragraphs (1) to (15) above, characterized in that the chemical composition of said steel sheet is, by wt %, C: about 0.05 to 0.55%, Mn: about 0.1 to 3%, Si: about 1.0% or less, Al: about 0.005 to 0.1%, S: about 0.02% or less, P: about 0.03% or less, Cr: about 0.01 to 1.0%, B: about 0.0002% to 0.0050%, Ti: between about (3.42×N+0.001) % and about 3.99×(C−0.1) %, N: about 0.01% or less, and 0: about 0.015% or less, and the balance being Fe and unavoidable impurities.

(20) A method of producing a high-strength part as set forth in any one of (1) to (15) above, characterized in that the steel sheet is treated with at least one of aluminum plating, aluminum-zinc plating, or zinc plating.

(21) A high strength part characterized by being produced by a method as set forth in any one of paragraphs (1) to (20) above.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figures showing illustrative embodiments, results and/or features of the exemplary embodiments of the present invention, in which.

Figure 1:
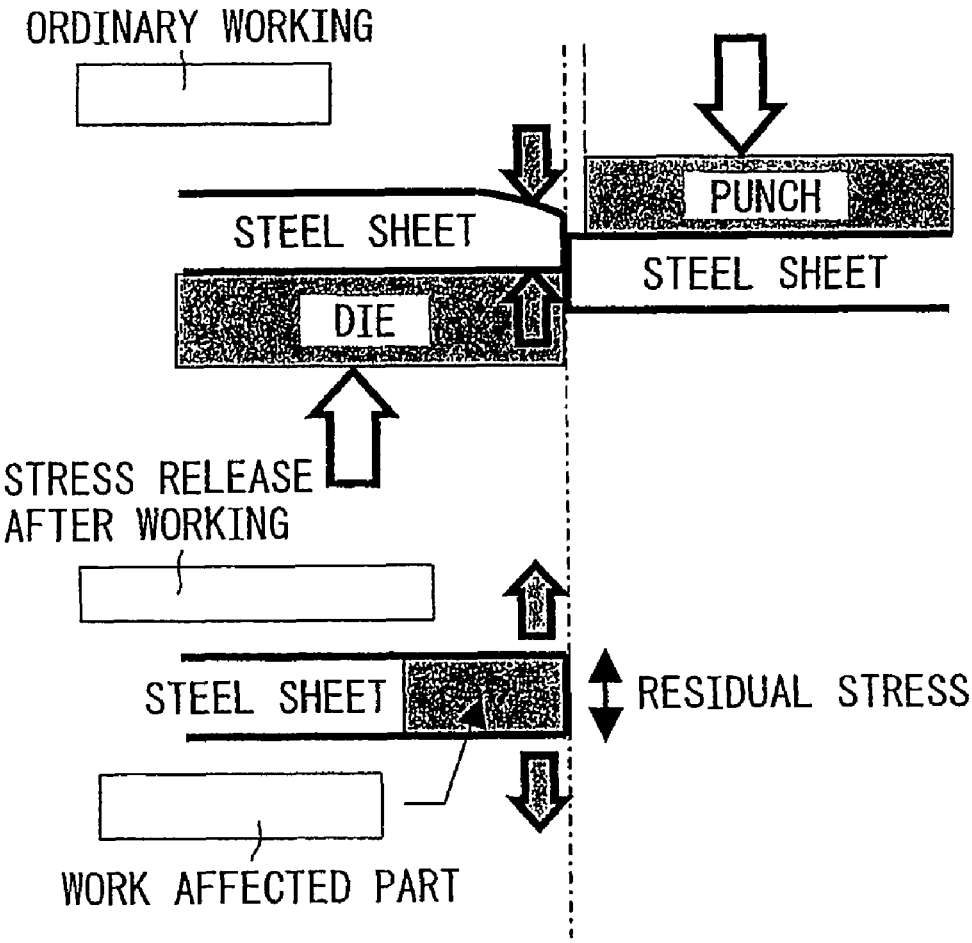
FIG. 1 is a schematic diagram showing an exemplary generation of tensile residual stress due to punching.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION OF EXEMPLARY EMBODIMENTS OF INVENTION

Exemplary embodiments of the present invention can provide high-strength parts, which may be superior in resistance to hydrogen embrittlement, by controlling the atmosphere in a heating furnace when heating steel sheet before shaping so as to reduce the amount of hydrogen in the steel, and by reducing residual stress using post-processing techniques, and a method of producing such parts.

The amount of hydrogen at the time of heating can be, by volume percent, about 10% or less because when the amount of hydrogen is greater than about 10%, the amount of hydrogen entering the steel sheet during heating can become large and the resistance to hydrogen embrittlement can diminish. Further, the dew point in the atmosphere can be about 30° C. or less because, with a higher dew point, the amount of hydrogen entering the steel sheet during heating can also increase and the resistance to hydrogen embrittlement can diminish.

The heating temperature of the steel sheet can be between the Ac3 temperature and the melting point so as to provide an austenitic structure of the steel sheet for hardening and strengthening after shaping. Further, if the heating temperature is higher than the melting point, press-forming becomes impossible.

The shaping starting temperature can be provided at a temperature higher than the temperature where ferrite, pearlite, bainite, and martensite transformations occur because, if shaped at a temperature lower than this, hardness after shaping may be insufficient.

By heating steel sheet under the above conditions and using a press technique to shape it, cooling and hardening after shaping in a mold, and then post-processing the steel, a high-strength part can be produced. "Hardening" can refer to a technique of strengthening steel by cooling at a cooling rate which is faster than a critical cooling rate determined by the steel composition so as to cause a martensite transformation.

Other post-processing techniques may also be used in accordance with exemplary embodiments of the present invention to produce high-strength parts.

Figure 2:
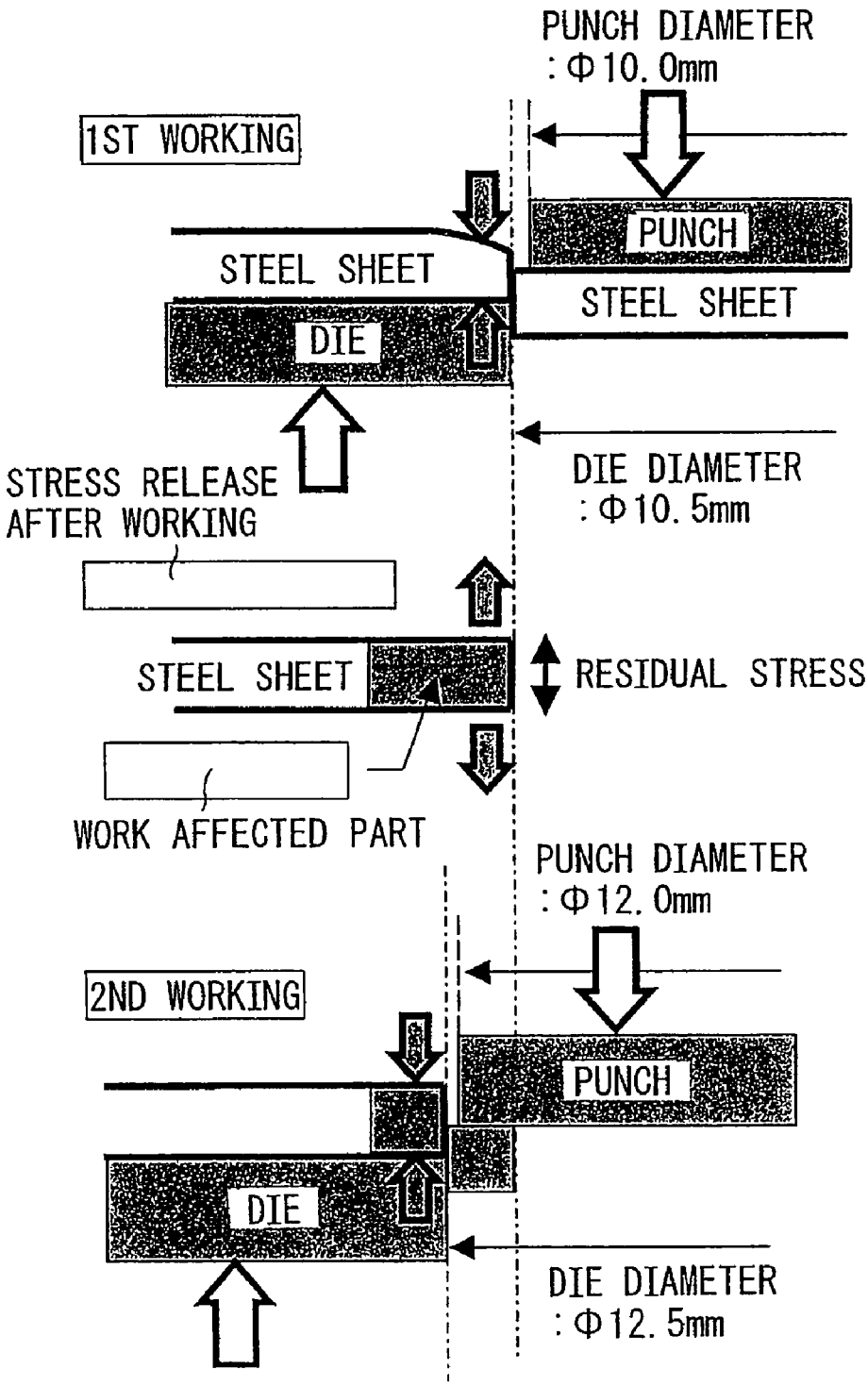
FIG. 2 is a schematic diagram showing an exemplary removal of a plastic worked layer or other affected parts.

For example, there may be a plastic worked layer present which can extend about 2000 μm from a worked end that can be related to a residual stress affected zone at the worked end face. This layer can arise, e.g., from shearing such as that which can occur during a punch piercing and cutting. As shown in FIG. 1, at the time of shearing, a steel sheet can be worked in a compressed state. After working, the compressed state may be released, and residual stress of tension can occur. Therefore, as shown in FIG. 2, in the plastic worked layer or another affected zone, a partial rise in strength due to the plastic working or the resistance to the compression force due to the tensile residual stress due to the second working can reduce the amount of compression at the time of working and also reduce the amount of deformation of the opening after cutting, so the residual stress can be reduced. Therefore, if a part is worked more than about 2000 μm from the worked end in range again, there may be no plastic worked layer or other affected zone, so the part can be worked while again receiving a large compression force. When this force is released after working, the residual stress may not be reduced and the cracking resistance may not be improved, so the upper limit for a working distance can be about 2000 μm. Further, a lower limit of a working range can be set to about 1 μm, since working a part while controlling to a range of less than 1 μm may be difficult. Therefore, a preferable range of working can be about 200 to 1000 μm.

Further, the residual stress at a cross-section of the worked part can be measured by an X-ray residual stress measurement apparatus as described, e.g., in "X-Ray Stress Measurement Method Standard (2002 Edition)—Ferrous Metal Section", Japan Society of Materials Science, March 2002. A parallel tilt method can be used to measure $2\theta-\sin^2\psi$ using the reflection X-rays of the 211 plane of a body centered cubic lattice. The 2θ measurement range can be about 150 to 162°. Cr—Kα was used as the X-ray target, the tube current and tube voltage were 10 mA and 30 kV, respectively, and the X-ray incidence slit was made 1 μm square. The value obtained by multiplying the stress constant K with the inclination of the $2\theta-\sin^2\psi$ curve was considered to represent the residual stress. The stress constant K was set equal to −32.44 kgf/deg.

Under the above conditions, for a pierced hole cross-section, values at y=20, 25, 30, 35, 40, 45 (in mm) was measured, while in the case of a cut surface, y=0, 20, 25, 30, 35, 40, 45 (in mm) was measured. The measurement was conducted in a thickness direction of 0° and directions inclined by 23° and 45° from that direction for a total of three measurements. The average measurement value was used as the residual stress.

The method of shearing, such as punching or cutting, may not be particularly limited. For example, a variety of conventional techniques can be used. The working temperature can be set between room temperature and about 1000° C.

By using post-processing procedures described above, the residual tensile stress at the worked end face can be about 600 MPa or less. Therefore, if a steel sheet has a yield stress of about 980 MPa or more, the residual stress can become less than the yield stress and cracks may no longer occur. Further, a residual compressive stress may not act in a direction where cracks form in the steel sheet at the ends, so cracks may no longer occur. For this reason, a residual tensile stress at the end face resulting from shearing such as punching or cutting can preferably be made about 600 MPa or less, or the residual stress can be compressive.

To suppress hydrogen embrittlement, in addition to press working parts where residual stress may arise due to shearing, it can be effective to impart a residual compressive stress. The end faces which were sheared can be press worked because the residual stress of tension believed to cause hydrogen embrittlement after shearing may be high at sheared ends, and press working such regions can reduce residual tensile stresses and improve resistance to hydrogen embrittlement. Any conventional techniques can be used for press working the sheared end faces, and coining techniques may be economically superior.

Figure 3:
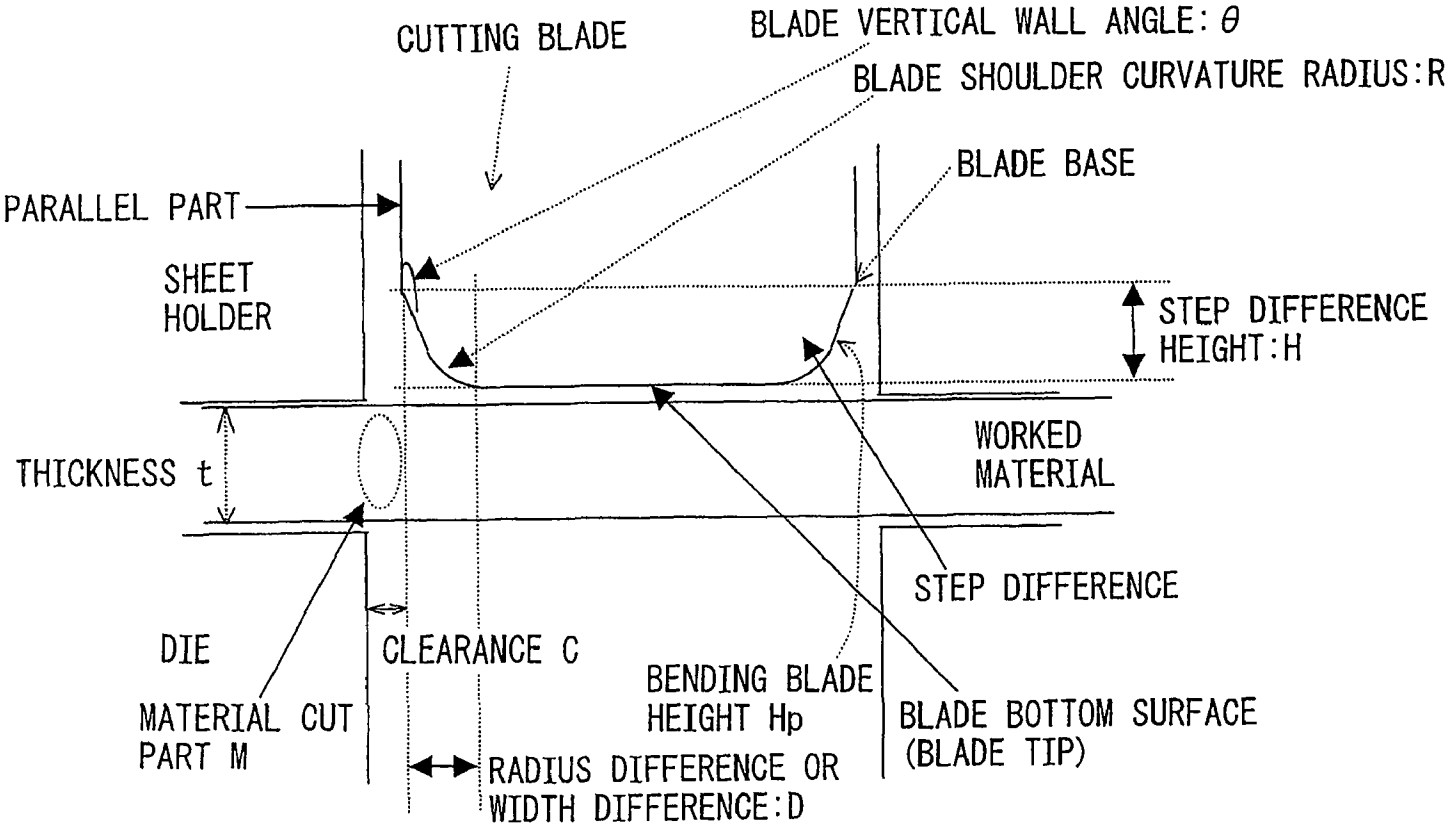
FIG. 3 is a schematic diagram showing an exemplary cut state formed by a cutting blade having a blade tip shape which includes a step difference.

Sheared end faces can be worked in a state with the steel sheet compressed, as shown in FIG. 1. After working, the compressed state may be released, so residual tensile stresses can be generated. By widening holes or pressing front surfaces of the end faces over the entire cross-section of the plastic worked layer or other affected zone, the partial rise in strength due to plastic working or the resistance to the compression force due to the residual tensile stress can enable control such that a release displacement after complete cutting can become compressive, providing, e.g., a single-step working method. That is, if enlarging a hole or pressing over a part in a range greater than 2000 μm from the worked end, the hole can be widened and the end face may be simultaneously pressed. Since this force can be released after working, a compressive residual stress can result at the end face. To obtain this result in a single working operation using a die and punch, the shape of the blade tip such as, e.g., the shapes shown in FIGS. 3 and 4, can be important. For example, FIG. 3 shows a step difference forming a blade tip, while FIG. 4 has a parallel tip portion at the tip of the step difference.

When providing a step difference that is continuously decreasing from the radius of curvature or width of the blade base in a direction from the blade base to the blade tip, if the reduction in the radius of curvature or width is less than 0.01 mm, the use of such a blade can be comparable to ordinary punching or cutting, such that a large tensile stress may remain at the end face. Alternatively, if the amount of reduction of the radius of curvature or width is greater than about 3.0 mm, the clearance may become large, and burring of the worked end face may also become larger.

Further, if the height of the blade vertical wall (e.g., the height of a step difference) is less than about half of the thickness of the worked steel sheet, after punching once, it may no longer be possible to press the worked end face from the side face of the step difference, so the procedure may be comparable to ordinary punching or cutting and a large tensile stress may remain at the worked end face. Alternatively, if the height is over 100 mm, the stroke can become larger and/or a shorter lifetime of the blade itself may be a concern.

Further, the angle formed by the parallel part of the cutting blade and the step difference (blade vertical wall angle q) can be preferably between about 95° to 179°, or more preferably at least about 140°.

Figure 4:
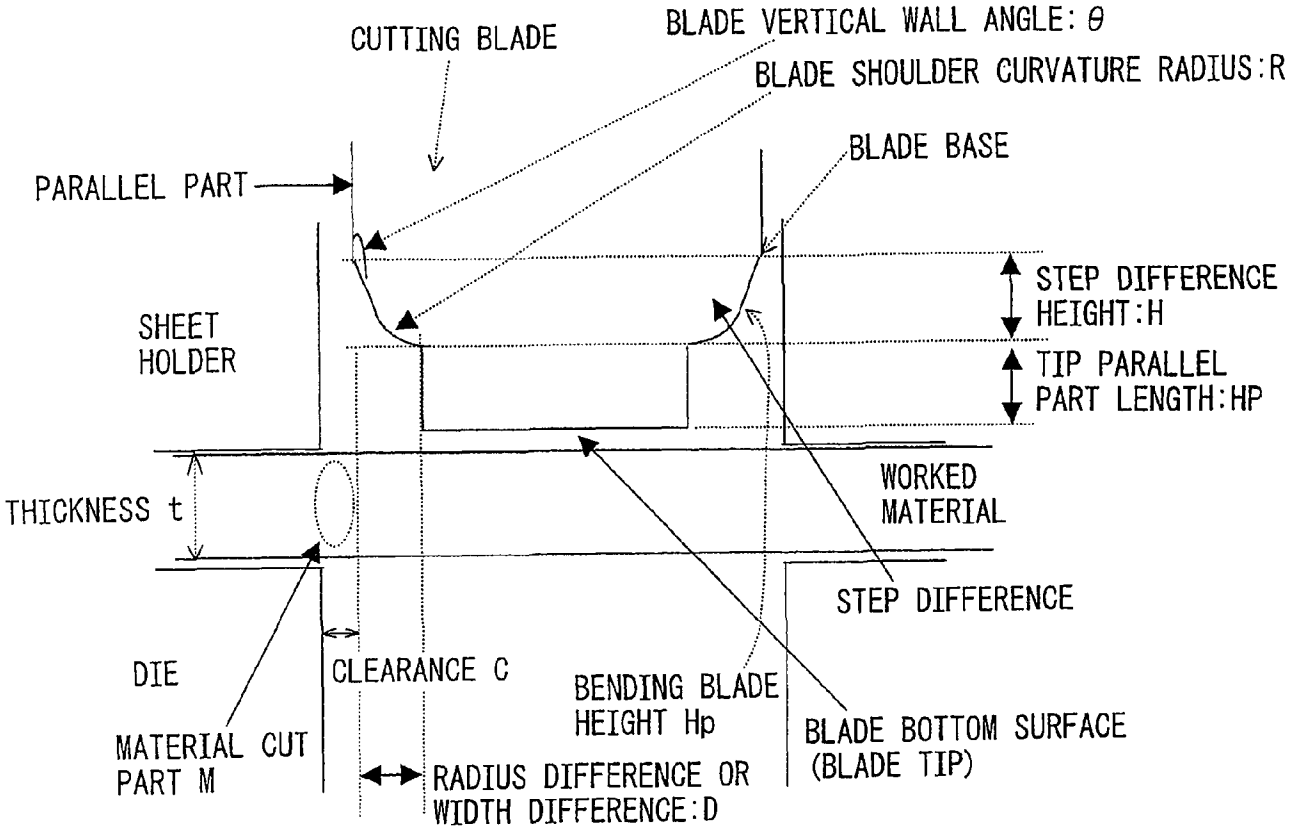
FIG. 4 is a schematic diagram showing an exemplary cut state formed by a cutting blade having a blade tip shape which includes a parallel portion at the tip of a step difference.

In FIG. 3 and FIG. 4, the step difference of a blade is shown having a radius of curvature, but a blade that has a linear reduction in width from the blade base can also be used.

The D/H ratio of a cutting blade can be important, where D can represent a difference of the radius of curvature or width between the blade base and blade tip, and the height of the step difference can be represented by H (mm). If the D/H ratio is less than about 0.5, a reduction in blade life or burring can be suppressed, so the value of this ratio may preferably be about 0.5 or less.

On the other hand, chamfering of the blade tip can be effective for reducing burring, prolonging blade life, and preventing cracking of relatively low strength steel sheet as described, e.g., in Japanese Patent Publication (A) No. 5-23755 and Japanese Patent Publication (A) No. 8-57557. However, it can be important that the steel sheet be shaped under predetermined conditions, and the once-punched end face or cut end face be again pushed apart, so it may not be particularly necessary to chamfer the blade tip in order to reduce the residual stress or make it compressive.

Further, the residual stress at the worked end face can be measured under the above-mentioned conditions by an X-ray residual stress measurement apparatus using techniques described, e.g., in "X-Ray Stress Measurement Method Standards (2002 edition)—Ferrous Metal Section", Japan Society of Materials Science, March 2002.

A variety of conventional shearing techniques may be used such as, e.g., punching or cutting. Working temperatures can preferably be between room temperature and about 1000° C.

Further, if the residual stress is zero or compressive, there may be essentially no forces acting at the end in the direction where the steel sheet may crack, so cracks may no longer occur. Further, pressing at not more than about 600 MPa can be effective for preventing cracks.

Figure 6:
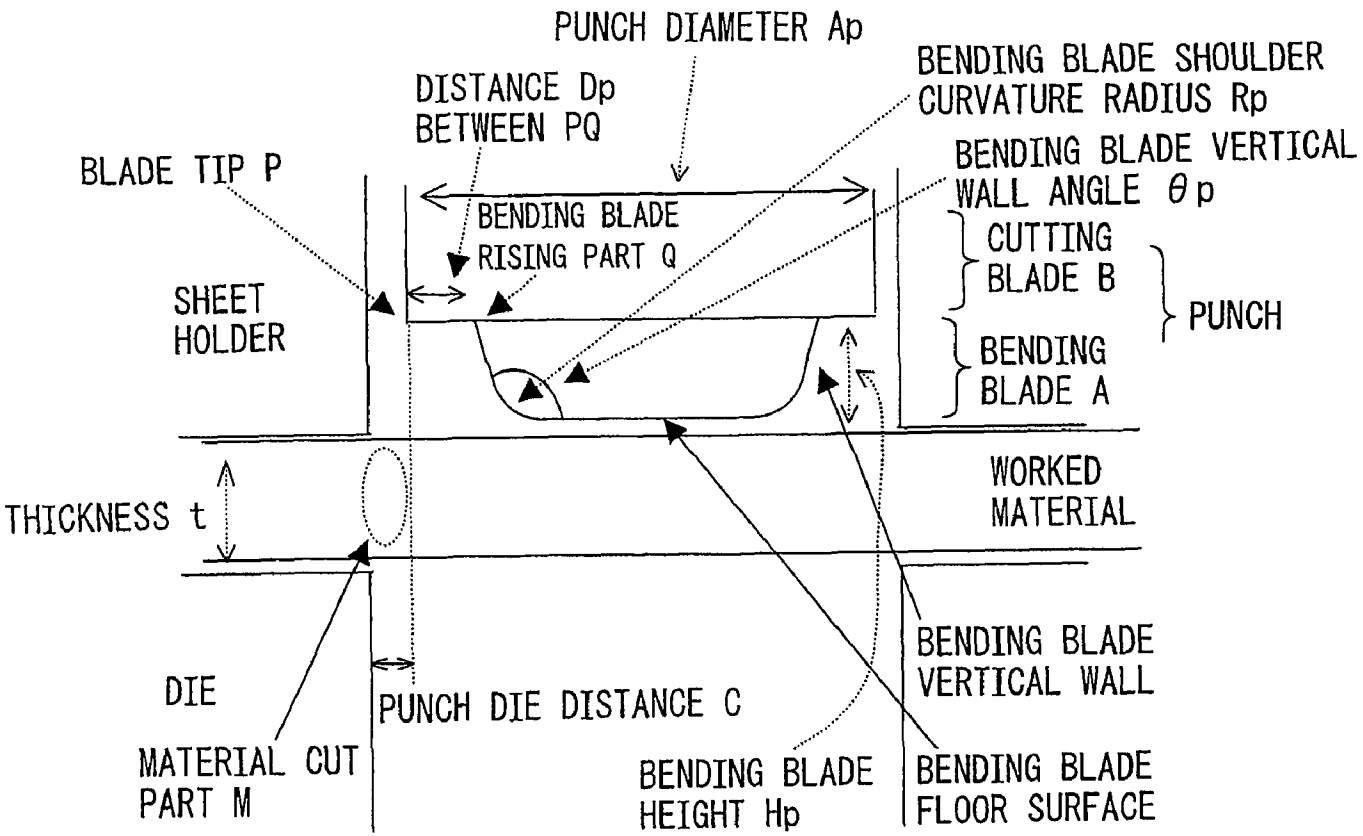
FIG. 6 is a schematic diagram showing a cut state formed by a punch having a two-step structure.

Residual stress at the punched end face can also be reduced, e.g., by providing the punch shape as a two-step structure including a bending blade A and a cutting blade B, as shown in FIG. 6.

Figure 5:
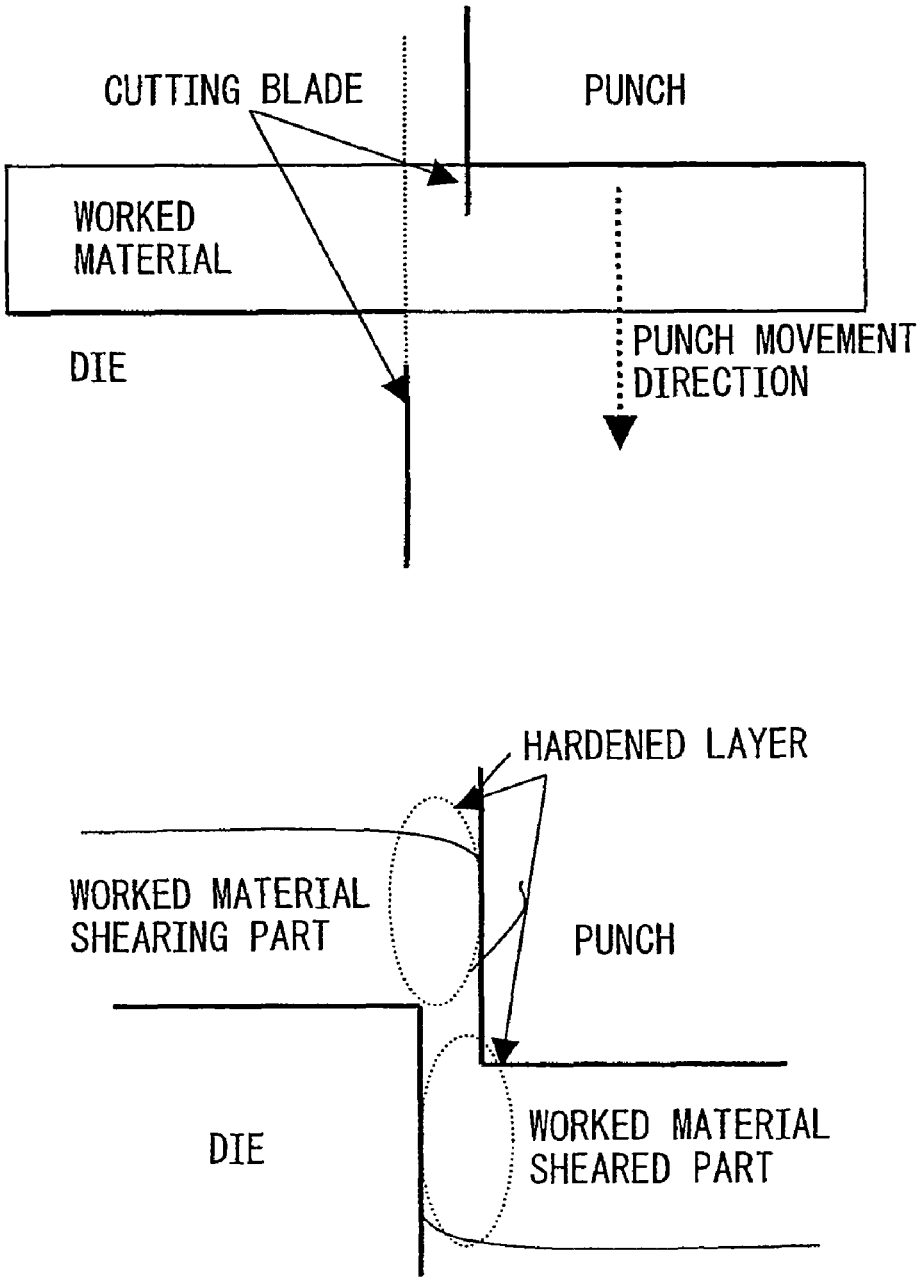
FIG. 5 is a schematic diagram showing a conventional punching technique.
Figure 7:
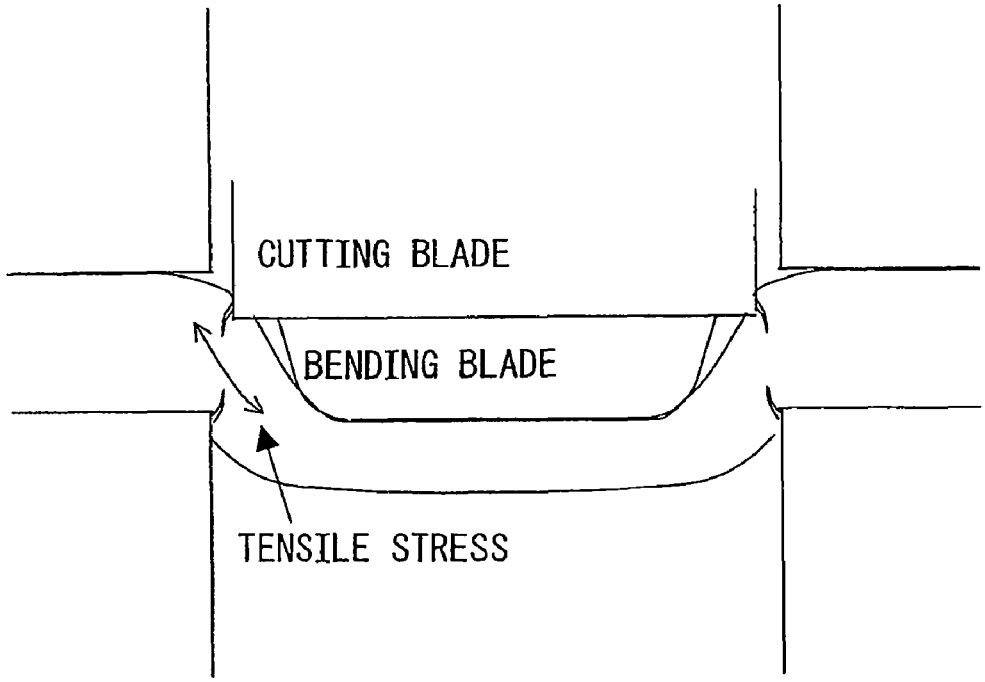
FIG. 7 is a schematic diagram showing an exemplary material deformation behavior generated using a bending blade.

A material deformed by a punch and die using conventional punching techniques as shown, e.g., in FIG. 5 (an exemplary hardened layer) can be subjected to a large tensile or compressive strain. Thus, the work hardening of the deformed region can become significant, and the ductility of the end face may deteriorate. However, a punch having a two-step structure may be used which includes a cutting blade B and a bending blade A, such as that shown in FIG. 6. For example, as shown in FIG. 7, when a part cut by the cutting blade B (e.g., an exemplary material cut part M) is given a tensile stress by the bending blade A, the progression of cracks arising due to the cutting blade B and die shoulder can be promoted by the tensile stress and the material may be cut by the cutting blade B without compression. In this manner, the residual stress of tension after punching can be reduced and a reduction in the allowable amount of hydrogen entering from the environment can be suppressed.

Further, a sufficient reduction of the residual stress may not be obtainable unless the bending blade has a predetermined shape. For example, when the shape of the bending blade A is not the predetermined shape, the material can be cut by the bending blade A, so the part M cut by the cutting blade B may not be given sufficient tensile stress by the bending. However, by shaping the bending blade such that the material is not cut by the bending blade itself, the residual stress can be reduced.

Figure 8:
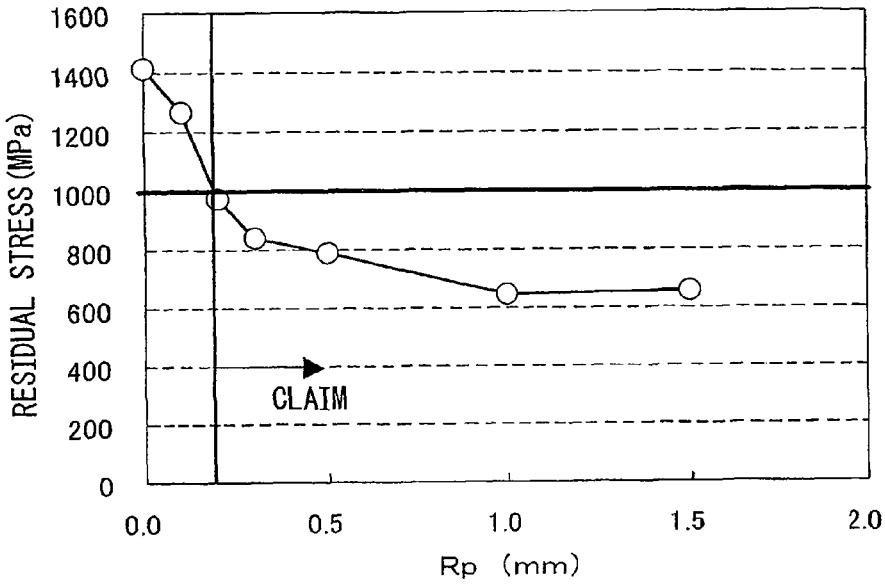
FIG. 8 is a diagram showing an exemplary relationship between a radius of curvature Rp of a bending blade and a residual stress.

FIG. 8 shows an exemplary relationship between a radius of curvature Rp and a residual stress in a TS1470 MPa grade hardened steel sheet of thickness 2.0 mm using a height, Hp, of the bending blade of 0.3 mm, a clearance of 5%, a vertical wall angle, θp, of the bending blade of 90°, and a predetermined radius of curvature, Rp, provided to the shoulder of the bending blade A. If the radius of curvature is about 0.2 mm or more, the residual stress can be reduced. Here, the residual stress can be determined by measuring the change in lattice distance using an X-ray diffraction method at the cut surface. The measurement area can be a 1 mm square region and the measurement may be conducted at the center of thickness at the cut surface. When using a punch to make holes, it may not be possible to provide X-rays from a direction vertical to the cutting surface, so the angle of emission of the X-rays can be varied to enable measurement of the residual stress in the thickness direction. Further, the clearance can be the punch and die clearance, e.g., C/thickness t×100 (%). The other punching conditions can be, e.g., a punch diameter Ap=20 mm and a distance Dp=1.0 mm between the cutting blade end P and the bending blade rising position D.

Figure 9:
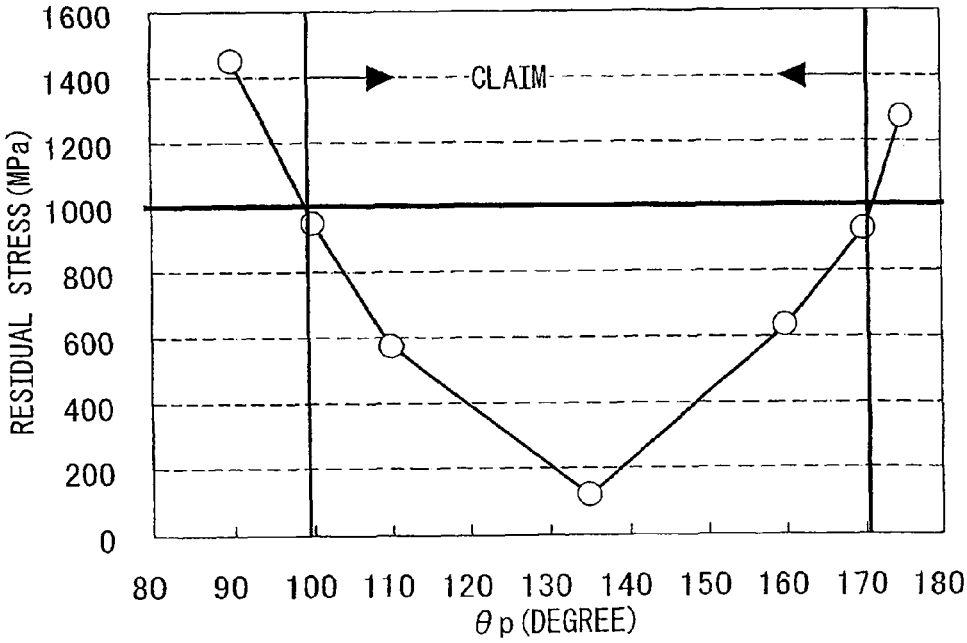
FIG. 9 is a diagram showing an exemplary relationship between an angle θp of a vertical wall of a bending blade A and the residual stress.

FIG. 9 shows an exemplary relationship between the angle θp and the residual stress in a TS1470 MPa grade hardened steel sheet having a thickness of 1.8 mm, with a bending blade having a height Hp of 0.3 mm, a clearance of 5.6%, a radius of curvature of the bending blade shoulder of 0.2 mm, and a vertical wall part of the bending blade A of a predetermined angle Op. For example, residual stress can be reduced by providing the angle θp of the vertical wall of the bending blade between about 100° and 170°. The other punching conditions can include, e.g., a punch diameter Ap=20 mm and a distance Dp=1.0 mm between the cutting blade end P and the bending blade rising position D.

Figure 10:
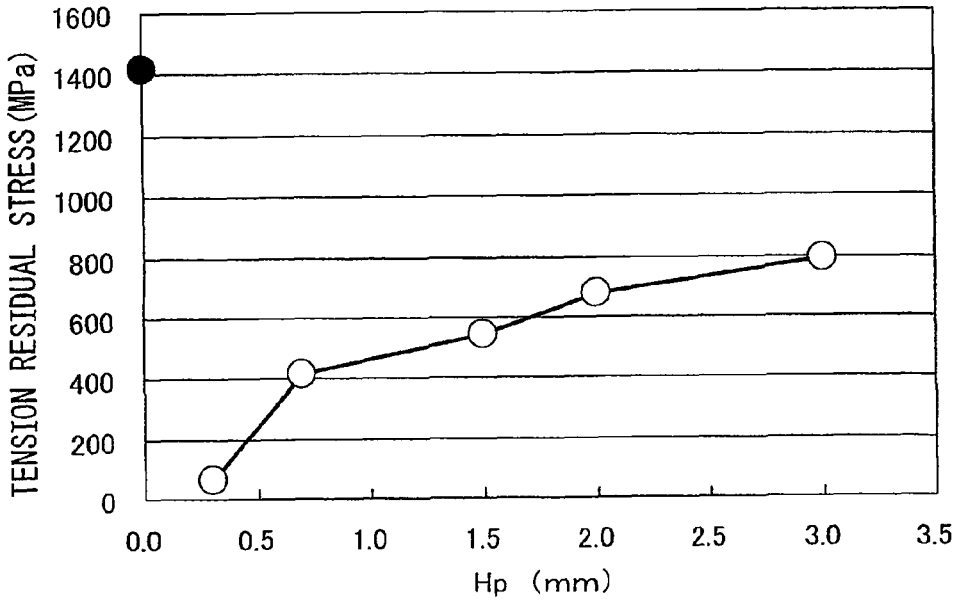
FIG. 10 is a diagram showing an exemplary relationship of a height of the bending blade and the residual stress.

FIG. 10 shows an exemplary relationship between the height Hp of the bending blade and the residual stress for a TS1470 MPa grade hardened steel sheet having a thickness of 1.4 mm, with a shoulder of the bending blade A having a radius of curvature Rp of 0.3 mm, an angle θp of the vertical wall of the bending blade A of 135°, a clearance of 7.1%, and a height Hp of the bending blade of 0.3 to 3 mm. The residual stress can be reduced as compared with the ordinary case of no bending blade, that is, Hp=0, by using a radius of curvature Rp of the shoulder of the bending blade of 0.2 mm or more and/or providing the angle θp of the vertical wall of the bending blade as 100° to 170°. The remaining punching conditions can include a punch diameter Ap=20 mm and a distance Dp=1.0 mm between the cutting blade end P and bending blade rising position D.

Figure 11:
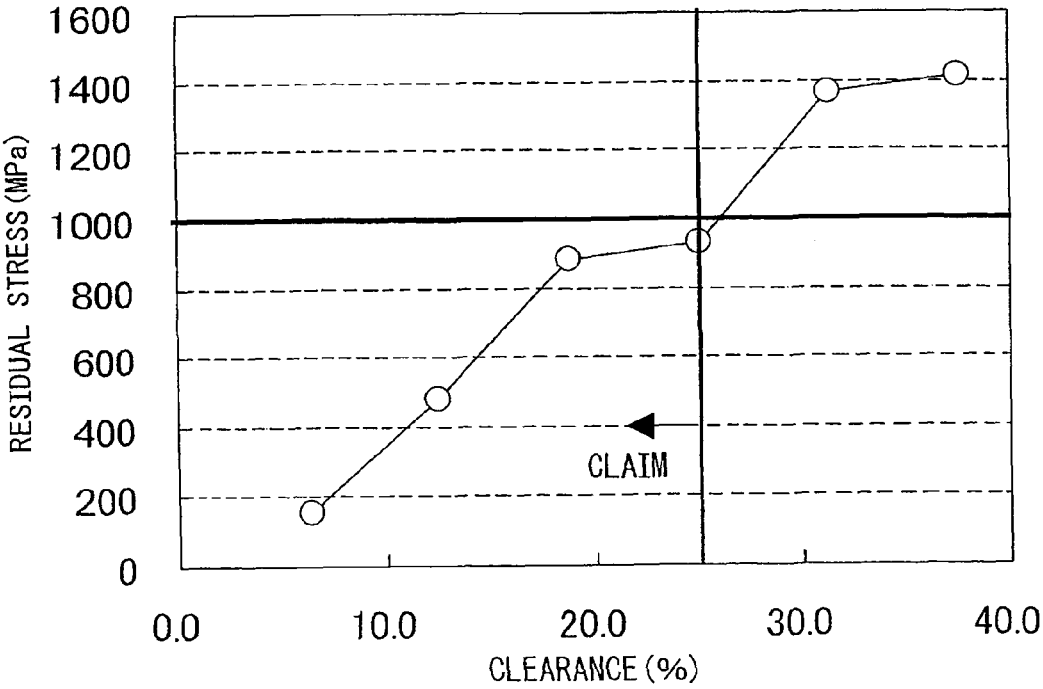
FIG. 11 is a diagram showing an exemplary relationship between a clearance and the residual stress.

Further, FIG. 11 shows an exemplary effect of punching clearance on the residual stress when using a TS1470 MPa grade hardened steel sheet having a thickness of 1.6 mm, with the shoulder of the bending blade A having a radius of curvature Rp of 0.3 mm, an angle θp of the vertical wall of the bending blade A of 135°, and a height Hp of the bending blade of 0.3 mm. The remaining punching conditions can include a punch diameter of Ap=20 mm and a distance Dp=1.0 mm between the cutting blade end P and the bending blade rising position D. The clearance also can have an effect on the residual stress. If the clearance becomes large, e.g., greater than about 25%, the residual stress may also become larger. This may result from a tensile effect of the bending blade becoming smaller, so the clearance can preferably be about 25% or less.

The punching punch or die can have a two-step structure of the bending blade A and cutting blade B. This configuration can allow the bending blade A to provide a tensile stress to the cut part M of the worked material before the cutting blade B shears the worked material, which can reduce the residual stress of the tension remaining at the cut end surface of the worked material after cutting.

The radius of curvature Rp of the bending shoulder can be at least about 0.2 mm. If the radius of curvature Rp of the shoulder of the bending blade is less than about 0.2 mm, the worked material may not be sheared by the bending blade A, and the part M sheared by the cutting blade B may not be provided with sufficient tensile stress.

The angle θp of the shoulder of the bending blade can be about 100° to 170°. If the angle θp of the shoulder of the bending blade is about 100° or less, the material may be sheared by the bending blade A, so a sufficient tensile stress may not be provided to the part M sheared by the cutting blade B. Further, if the angle θp of the shoulder of the bending blade is about 170° or more, sufficient tensile stress may not be provided to the part to be sheared by the cutting blade B.

If either of the above conditions relating to the radius of curvature Rp of the shoulder of the bending blade and the angle θp of the shoulder of the bending blade is met, a large effect can be obtained, but when both conditions are met, the contact pressure of the material contacting the alloy mold may be reduced, so the mold wear can be suppressed. Therefore, it may be preferred to have both conditions met for maintenance considerations.

Further, in conventional punching processes a sheet holder can be used for fastening the material to the die, but it may also be possible to use a sheet holder when punching in accordance with exemplary embodiments of the present invention. A wrinkle suppressing load (e.g., a load applied to material by a sheet holder) may not have a particularly large effect on the residual stress, so it may be used in a conventional range.

The punch speed may not have a great effect on the residual stress even if it is varied anywhere within a conventional industrial range, for example, 0.01 m/sec to several m/sec. Therefore, any reasonable value of the punch speed may be used.

Further, to suppress mold wear in a punching process, the mold or material can be coated with lubrication oil. Any suitable lubrication oil may be used for this purpose.

To give sufficient tensile stress to the bending blade A, the height Hp of the bending blade may preferably be at least about 10% of the thickness of the worked material.

Further, the distance Dp between the cutting blade end P and the rising position Q of the bending blade can preferably be at least about 0.1 mm. This is because if the distance is less than this, when shearing the worked material by the cutting blade B, the cracks which usually occur near the shoulder of the cutting blade can become difficult to form and strain can be provided to the cutting position by the cutting blade.

Further, the part between the cutting blade end P and rising position Q of the bending blade in the punch, the bottom part of the bending blade A, and the vertical wall part of the bending blade A may each preferably have flat shapes in terms of the production of the punch, but even if there is some relief shape, the effect can be the same even if the above requirements are satisfied.

The residual stress of the end face at the time of punching can be further reduced by also adding the bending blade A to a conventional punch of the cutting blade B. By adding the bending blade A and further making the height Hp of the bending blade larger, the facial pressure where the cutting blade B and worked material contact each other can be reduced, so the amount of wear of the cutting blade end P may also be reduced. If Hp is too large, before the cutting blade B and worked material contact each other, the material may break between the bending blade A and the cutting blade B and beneficial effects may not be obtained. In this case, the height Hp of the bending blade is preferably about 10 mm or less.

There may be no particular upper limit to the radius of curvature Rp of the shoulder of the bending blade shoulder, but it may depend on the size of the punch. For example, if the radius of curvature Rp is too large, it can become difficult to increase the height Hp of the bending blade, so a radius of curvature of about 5 mm or less may b preferable.

Above, the effect in the case of adding a bending blade to the punch was explained, but both when adding bending blades to both of the punch and die and when adding a bending blade to only the die, since a tensile stress is given to the material in the same way as when adding a bending blade to only the punch as explained above, similar effects are obtained. The limitations on the dimensions of the bending blade in this case are the same as the limitations in the case of adding a bending blade to only the punch as explained above.

The steel can be hot shaped and then sheared near bottom dead center to reduce the residual stress. When shearing during hot working, the shearing tool may contact the steel sheet with a high facial pressure. The cooling rate may then become large and the steel can be transformed from austenite to a low temperature transformed structure with a high deformation resistance. Residual stress can remain which may be smaller than that from working hardened material at room temperature, but larger than that of austenite. Therefore, the plate may be sheared near bottom dead center because during hot shaping, the deformation resistance of the steel sheet can be small and the residual stress after working may become low. Further, if it is not near bottom dead center, after shearing, the steel sheet may deform and the shape and positional precision can be reduced. "Near bottom dead point" can refer to within about 10 mm, or preferably within about 5 mm, of the bottom dead point.

To suppress hydrogen embrittlement, it may be effective to control the atmosphere in the heating furnace before shaping to reduce the amount of hydrogen in the steel and then post-process it by fusion cutting with its little residual stress after working.

Cooling and hardening the steel after shaping in the mold to produce a high strength part, then melting a portion of the part to cut it is can lead to a small residual stress after working and good resistance to hydrogen embrittlement.

Any conventional techniques for melting a portion of the part to cut it may be used, but industrially, laser working and plasma cutting with small heat affected zones may be preferable. Gas cutting can have a small residual stress after working, but it may be disadvantageous in that it can require a large input heat and may have larger regions where the strength of the part falls.

To suppress hydrogen embrittlement, it can be effective to control the atmosphere in the heating furnace before shaping so as to reduce the amount of hydrogen in the steel, and to post-process the steel by machining with a small residual stress after working.

Cooling and hardening the steel after shaping in the mold to produce a high strength part, then machining it to perforate it or cut around the part can also provide a reduced residual stress after working and good resistance to hydrogen embrittlement. Any conventional technique may be used for machining to perforate or cut around the part, and drilling or cutting by a saw may be economically superior.

Even if prior working is used for post-processing, it may be sufficient to mechanically cut the location having a high residual stress at the end face of the sheared part. The cut surface of the sheared part can be removed to a thickness of about 0.05 mm or more because, with less removal than this, the location where residual stress remains may not be sufficiently removed and the resistance to hydrogen embrittlement can be reduced.

Any conventional technique can be used for removing a thickness of 0.05 mm or more from the cut surface of the sheared part by mechanical cutting. For example, a mechanical cutting method such as reaming may be economically superior.

It may be desirable to limit the chemical composition of the steel sheet forming the material for various reasons, is described below.

C may be added to help in the formation of martensite after cooling and securing desirable material properties. To generate a strength of 1000 MPa or more, it can be desirable to add C in an amount of about 0.05% or more. However, if the amount added is too large, it may be difficult to provide strength at the time of impact deformation, so an upper limit of C concentration can be about 0.55%.

Mn is an element which can improve strength and hardenability. Less than 0.1% Mn may not provide sufficient strength at the time of hardening. Further, the strength effect can become saturated when there is more than about 3% Mn. Therefore, Mn may preferably be provided in a range between about 0.1% and 3%.

Si is a solution hardening type alloy element, but surface scale can become a problem if there is more than about 1.0% Si. Further, when plating the surface of steel sheet, if the amount of Si added is large, the plateability can deteriorate, so the upper limit Si can preferably be about 0.5%.

Al is an element which can be used for deoxidizing molten steel and can also be used for fixing N. The amount of Al can have an effect on the crystal grain size and/or mechanical properties. To provide such an effect, an Al content of about 0.005% or more can be provided, but an Al content greater than about 0.1% can lead to large nonmetallic inclusions and surface flaws. For this reason, Al can preferably be provided in a range between about 0.005% and 0.1%.

S can have an effect on nonmetallic inclusions in the steel. For example, it can lead to deterioration of workability and of toughness, and may increase anisotropy and susceptibility to repeat heat cracking. For this reason, the amount of S present can preferably be about 0.02% or less, or more preferably about 0.01% or less. Further, limiting S to about 0.005% or less can provide improved impact characteristics.

P is an element which can have a detrimental effect on weld cracking and toughness. Therefore, P can be present preferably in an amount of about 0.03% or less, or more preferably about 0.02% or less, or even more preferably about 0.015% or less.

If the amount of N present exceeds about 0.01%, coarsening of nitrides and age hardening by the solute N can reduce toughness. For this reason, N is preferably present in an amount of about 0.01% or less.

The amount of O present may not be particularly limited, but excessive addition of O can lead to formation of oxides which may have a detrimental effect on toughness. To suppress oxides which may initiate fatigue fracture, the amount of O present may preferably be about 0.015% or less.

Cr is an element which can improve hardenability. Further, it can cause precipitation of M23C6 type carbides in the matrix. It can raise strength and make carbides finer. Cr may be added to obtain these effects. If the amount of Cr is less than about 0.01%, these effects may not be sufficiently produced. Further, if there is more than about 1.2% Cr, the yield strength may rise excessively, so Cr can be preferably present in a range of about 0.01% to 1.0%, or more preferably between about 0.05% and 1%.

B may be added for the purpose of improving hardenability during press-forming or when cooling after press-forming. To achieve this effect, addition of about 0.0002% or more may be necessary. However, if too much B is added, this beneficial effect may become saturated and propensity for hot cracking may increase, so an upper limit for the amount of B present may preferably be about 0.0050%.

Ti may be added to fasten N and prevent its forming a compound with B to allow beneficial effects of B to appear. To bring out such effects, the quantity (Ti−3.42×N) can be at least about 0.001%. However, if large amounts of Ti are present, the amount of C not bonding with Ti can decrease and, after cooling, a sufficient strength may no longer be obtained. Therefore, an upper limit can be provided for which the Ti equivalent leads to an amount of C not bound with Ti of at least 0.1%, that is, an upper Ti limit of about 3.99×(C−0.1) % may be preferable.

Ni, Cu, Sn, and other elements which may be present in scrap may also be included. Further, to control the shape of inclusions, Ca, Mg, Y, As, Sb, and/or REM may also be added. Also, to improve strength, Ti, Nb, Zr, Mo, and/or V may also be added. In particular, Mo can also improve hardenability, so it may also be added for this purpose. However, if larger amounts of these elements are present, the amount of C not bonding with such elements can decrease and a sufficient strength may no longer be obtained after cooling, so addition of not more than 1% of each of these elements may be preferable.

The elements Cr, B, Ti, and Mo can have an effect on hardenability. The amounts of each of these elements added may be optimized by considering the desired hardenability, the cost at the time of production, etc. For example, it can be possible to optimize the above elements, including Mn, etc. to reduce alloy cost, reduce the number of steel types to reduce costs even if the alloy cost itself is not minimized, or use other various combinations of elements in accordance with the circumstances at the time of production. Inclusion of unavoidable impurities may not be detrimental to the overall properties of parts formed in accordance with exemplary embodiments of the present invention.

Steel sheet having compositions such as those described above may also be treated by aluminum plating, aluminum-zinc plating, or zinc plating. Pickling and cold rolling may be performed using conventional techniques. Aluminum, aluminum-zinc and/or zinc plating procedures may also be performed using conventional techniques. For example, aluminum plating using an Si concentration in the bath of about 5-12% may be suitable, while aluminum-zinc plating using a Zn concentration in the bath of about 40-50% may also be suitable. Further, there may be no particular problem even if the aluminum plating layer includes Mg or Zn, or the aluminum-zinc plating layer includes Mg.

Plating processes can be performed under conventional conditions, both in a continuous plating facility having a nonoxidizing furnace and in a noncontinuous plating facility having a nonoxidizing furnace. Since no special control may be required when processing steel sheet alone, productivity may also not be inhibited. Further, zinc plating techniques, hot dip galvanization, electrolytic zinc coating, alloying hot dip galvanization, and/or other techniques may be used. Using production conditions described above, the surface of the steel sheet may not be pre-plated with metal before the plating, but the steel sheet may be pre-plated, e.g., with nickel, iron, or another metal to improve platability. Further, the surface of the plated layer may be treated by plating with a different metal or by coating it with an inorganic or organic compound.

Specific examples will now be presented in more detail to better describe exemplary embodiments of the present invention.

EXAMPLES

Example 1

Slabs of steel having the chemical compositions shown in Table 1 were cast. These slabs were heated to between 1050 and 1350° C. and hot rolled at a finishing temperature between 800 and 900° C. and a coiling temperature between 450 and 680° C. to obtain hot rolled steel sheets having a thickness of 4 mm. Next, these sheets were pickled, then cold rolled to obtain cold rolled steel sheets having a thickness of 1.6 mm. These sheets were then heated to the austenite region of 950° C., above the Ac3 point, and hot shaped. The atmosphere of the heating furnace was varied with respect to the amount of hydrogen and the dew point. The conditions used are shown in Table 2 and Table 3. The tensile strengths were 1523 MPa and 1751 MPa.

Figure 12:
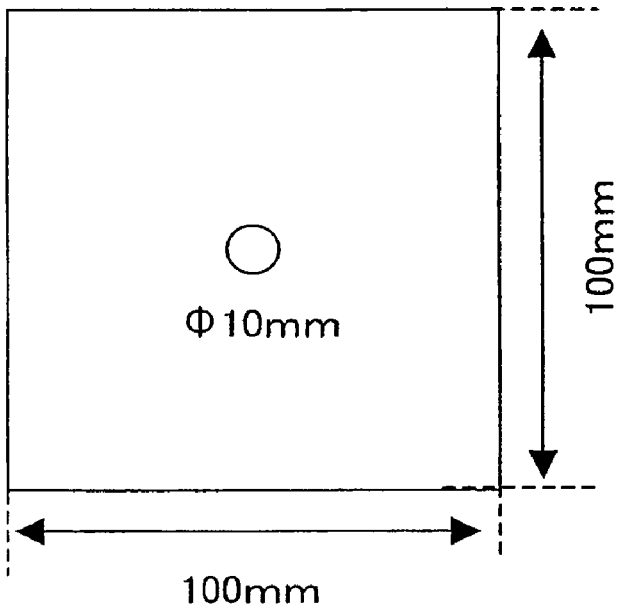
FIG. 12 is a schematic diagram of an exemplary piercing test piece.
Figure 13:
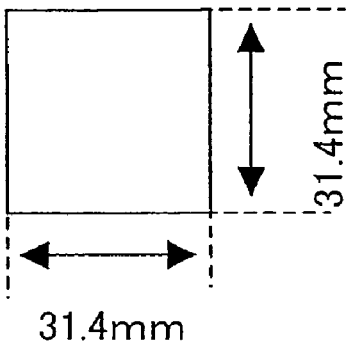
FIG. 13 is a schematic diagram of an exemplary shearing test piece.

When evaluating punch pieced parts, 100 mm×100 mm size pieces were cut from these shaped parts to obtain test pieces. The center parts were punched out by a F10 mm punch at a clearance of 15%, and the pieces were then secondarily worked under various conditions. Further, when evaluating cut parts, the secondarily worked test pieces were cut to sizes of 31.4 mm×31.4 mm by primary working at a clearance of 15%, and were then secondarily worked under various conditions in a manner similar to punch piercing. Exemplary shapes of the test pieces at this stage are shown in FIGS. 12 and 13. The range of this secondary working was also noted. Mechanical grinding was performed by a reamer for a punch pierced hole, and by a milling machine for a cut end. To evaluate resistance of these test pieces to crack formation, the test pieces were allowed to stand after secondary working for 24 hours at room temperature, and the number of cracks at the worked ends and the residual stress at the punched ends and cut ends were measured using X-rays. The number of cracks was measured for the entire circumference of the hole for a punch pierced hole. For cut ends, the number of cracks on one side was measured.

Under conditions of both punch piercing and cutting, cracking was observed to occur frequently under the production condition nos. 1, 2, 3, 5, 6, 7, 8, and 10 where the amount of hydrogen in the heating atmosphere was 30% or the dew point was 50° C., the primary working was left as-is, or, after the primary working, secondary working was performed more than 3 mm from the worked end. Cracking was not observed under the secondary working production condition nos. 4 and 9, where the amount of hydrogen in the heating atmosphere was 10% or less, the dew point was 30° C. or less, and a distance of 1000 μm from the worked end was secondarily worked after the primary working. Further, trends in the number of cracks occurring under production conditions where an amount of hydrogen in the heating atmosphere was 10% or less and a dew point was 30° C. or less correlate well with the results of measurement of the residual stress using X-rays. Therefore, for improvement of the crack resistance of worked ends, it can be effective to rework a portion between about 1 to 2000 μm from the worked ends after primary working.

TABLE 1

| Steel type | C | Si | Mn | P | S | Al | Cr | N | Ti | (wt % B |
|---|---|---|---|---|---|---|---|---|---|---|
| A | 0.22 | 0.22 | 1.1 | 0.010 | 0.003 | 0.050 | 0.20 | 0.0034 | 0.023 | 0.0023 |
| B | 0.27 | 0.15 | 0.7 | 0.006 | 0.009 | 0.031 | 0.14 | 0.0038 | 0.025 | 0.0025 |

TABLE 2

| Production condition no. | Steel type no. | Thickness | H am't (%) | Dew point (° C.) | Tensile strength (MPa) | Piercing method: Primary working: Punch diameter (mm) | Piercing method: Primary working: Die diameter (mm) | Piercing method: Secondary working: Punch diameter (mm) | Piercing method: Secondary working: Die diameter (mm) | Secondary working range (μm) | Punch end tensile residual stress (MPa) | No. of cracks after standing 24 h | Class |
|---|---|---|---|---|---|---|---|---|---|---|---|---|---|
| 1 | A | 1.6 | 5 | 20 | 1523 | 10.0 | 10.5 | — | — | — | 1240 | 4 | Comp. Ex. |
| 2 | | | 30 | 10 | | 10.0 | 10.5 | 12.0 | 12.5 | 1000 | 435 | 6 | Comp. Ex. |
| 3 | | | 5 | 50 | | 10.0 | 10.5 | 12.0 | 12.5 | 1000 | 395 | 5 | Comp. Ex. |
| 4 | | | 1 | −10 | | 10.0 | 10.5 | 12.0 | 12.5 | 1000 | 420 | 0 | Inv. range |
| 5 | | | 3 | 0 | | 10.0 | 10.5 | 16.0 | 16.5 | 3000 | 1193 | 6 | Comp. Ex. |
| 6 | B | 1.6 | 5 | 20 | 1751 | 10.0 | 10.5 | — | — | — | 1392 | 14 | Comp. Ex. |
| 7 | | | 30 | 10 | | 10.0 | 10.5 | 12.0 | 12.5 | 1000 | 378 | 7 | Comp. Ex. |
| 8 | | | 5 | 50 | | 10.0 | 10.5 | 12.0 | 12.5 | 1000 | 445 | 5 | Comp. Ex. |
| 9 | | | 1 | −10 | | 10.0 | 10.5 | 12.0 | 12.5 | 1000 | 266 | 0 | Inv. range |
| 10 | | | 3 | 0 | | 10.0 | 10.5 | 16.0 | 16.5 | 3000 | 1353 | 13 | Comp. Ex. |

TABLE 3

| Production condition no. | Steel type no. | Thickness | H am't (%) | Dew point (° C.) | Tensile strength (MPa) | End cutting method: Primary working: Method | End cutting method: Primary working: Clearance (%) | End cutting method: Secondary working: Method | Secondary working range (μm) | Cut end tensile residual stress (MPa) | No. of cracks after standing 24 h | Class |
|---|---|---|---|---|---|---|---|---|---|---|---|---|
| 1 | A | 1.6 | 5 | 20 | 1523 | Shearing | 15 | — | — | 1321 | 5 | Comp. Ex. |
| 2 | | | 30 | 10 | | Shearing | 15 | Shearing | 1000 | 378 | 6 | Comp. Ex. |
| 3 | | | 5 | 50 | | Shearing | 15 | Shearing | 1000 | 425 | 8 | Comp. Ex. |
| 4 | | | 1 | −10 | | Shearing | 15 | Shearing | 1000 | 334 | 0 | Inv. range |
| 5 | | | 3 | 0 | | Shearing | 15 | Shearing | 3000 | 1218 | 5 | Comp. Ex. |
| 6 | B | 1.6 | 5 | 20 | 1751 | Shearing | 15 | — | — | 1447 | 16 | Comp. Ex. |
| 7 | | | 30 | 10 | | Shearing | 15 | Shearing | 1000 | 354 | 7 | Comp. Ex. |
| 8 | | | 5 | 50 | | Shearing | 15 | Shearing | 1000 | 405 | 9 | Comp. Ex. |
| 9 | | | 1 | −10 | | Shearing | 15 | Shearing | 1000 | 191 | 0 | Inv. range |
| 10 | | | 3 | 0 | | Shearing | 15 | Shearing | 3000 | 1491 | 15 | Comp. Ex. |

Example 2

Steel slabs having the chemical compositions shown in Table 4 were cast. These slabs were heated to between 1050 and 1350° C. and hot rolled at a finishing temperature of 800 to 900° C. and a coiling temperature of 450 to 680° C. to obtain hot rolled steel sheets having a thickness of 4 mm. Next, these sheets were pickled, then cold rolled to obtain steel sheets having a thickness of 1.6 mm. Further, parts of the cold rolled plates were treated by hot dip aluminum coating, hot dip aluminum-zinc coating, alloying hot dip galvanization, and/or hot dip galvanization. Table 5 shows the type of plating used for various samples. After plating, these cold rolled steel sheets and surface treated steel sheets were heated by furnace heating to the austenite region of the Ac3 point, e.g., to 950° C., and then were hot shaped. The atmosphere of the heating furnace was varied with respect to the amount of hydrogen and the dew point. The conditions used to process these samples are shown in Table 6.

Figure 14:
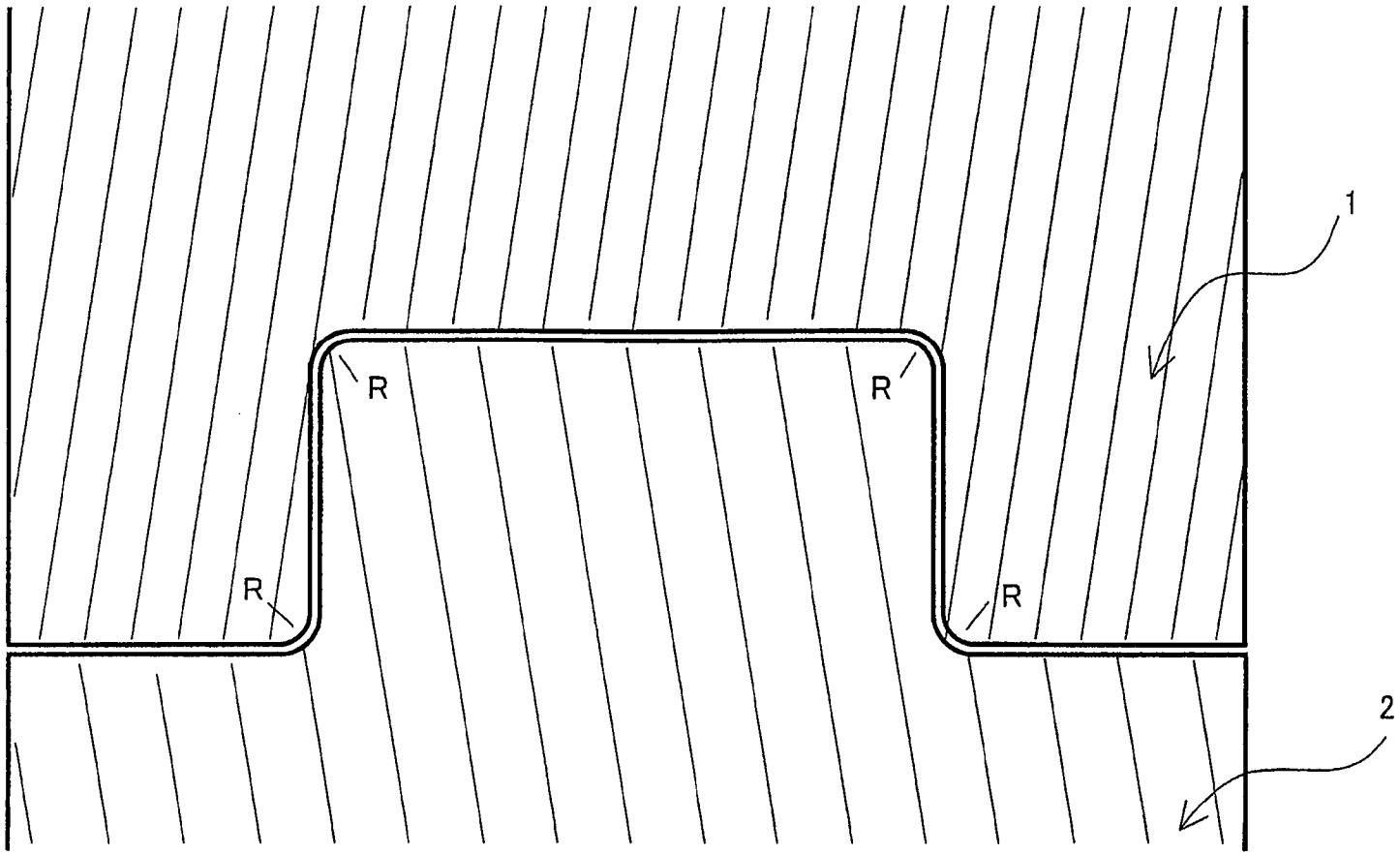
FIG. 14 is a schematic diagram of an exemplary tool cross-sectional shape.
Figure 15:
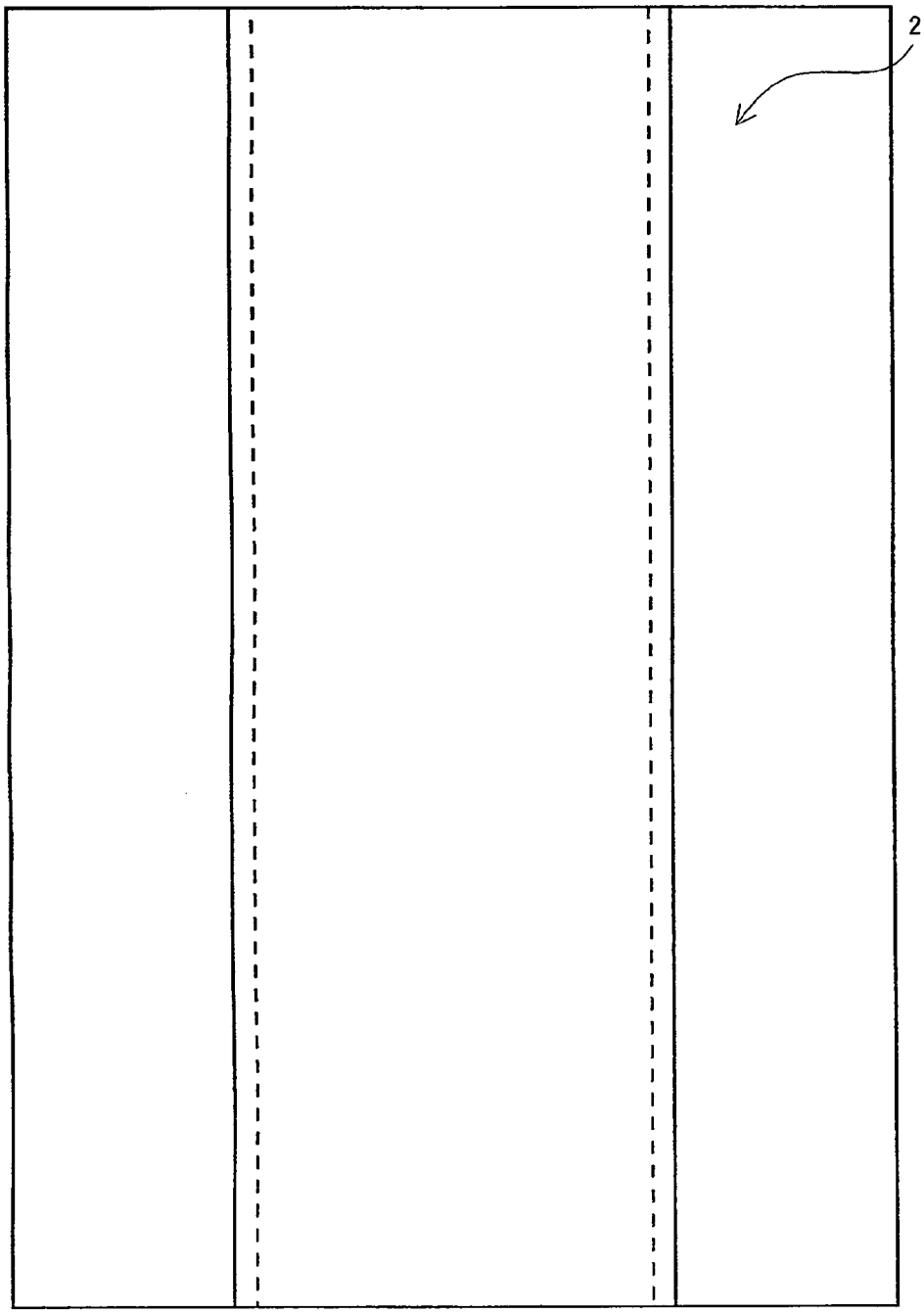
FIG. 15 is a schematic diagram of an exemplary shape of a punch.
Figure 16:
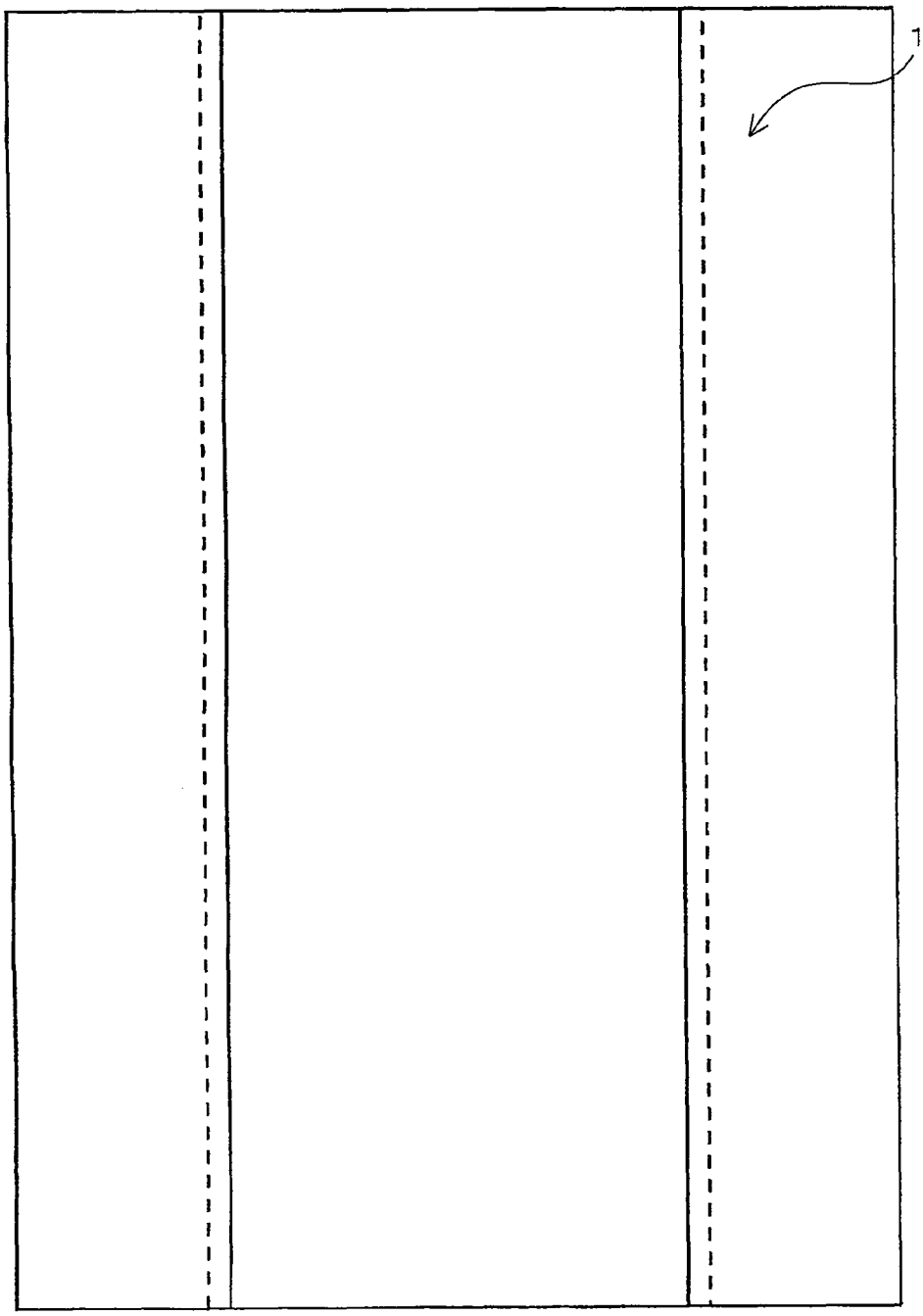
FIG. 16 is a schematic diagram of an exemplary shape of a die.
Figure 17:
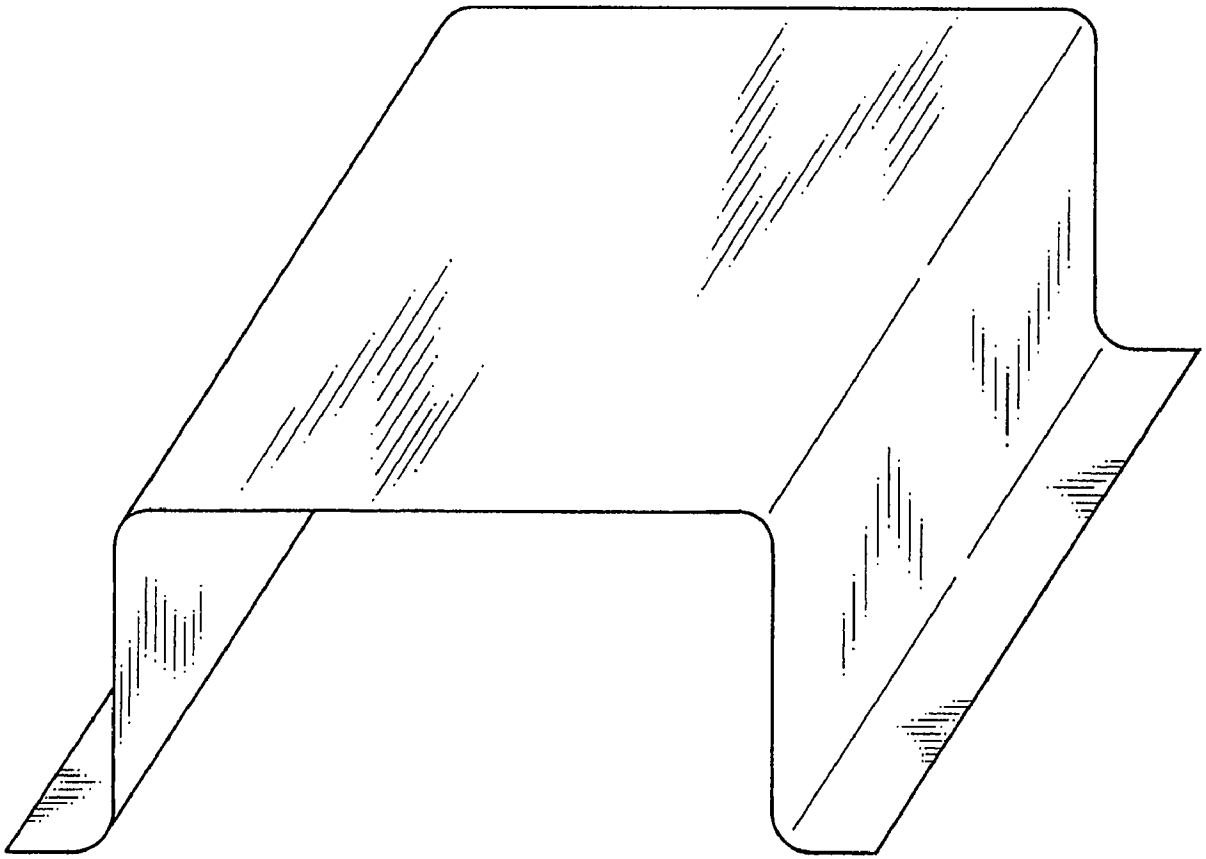
FIG. 17 is a schematic diagram of an exemplary shape of a shaped article.
Figure 18:
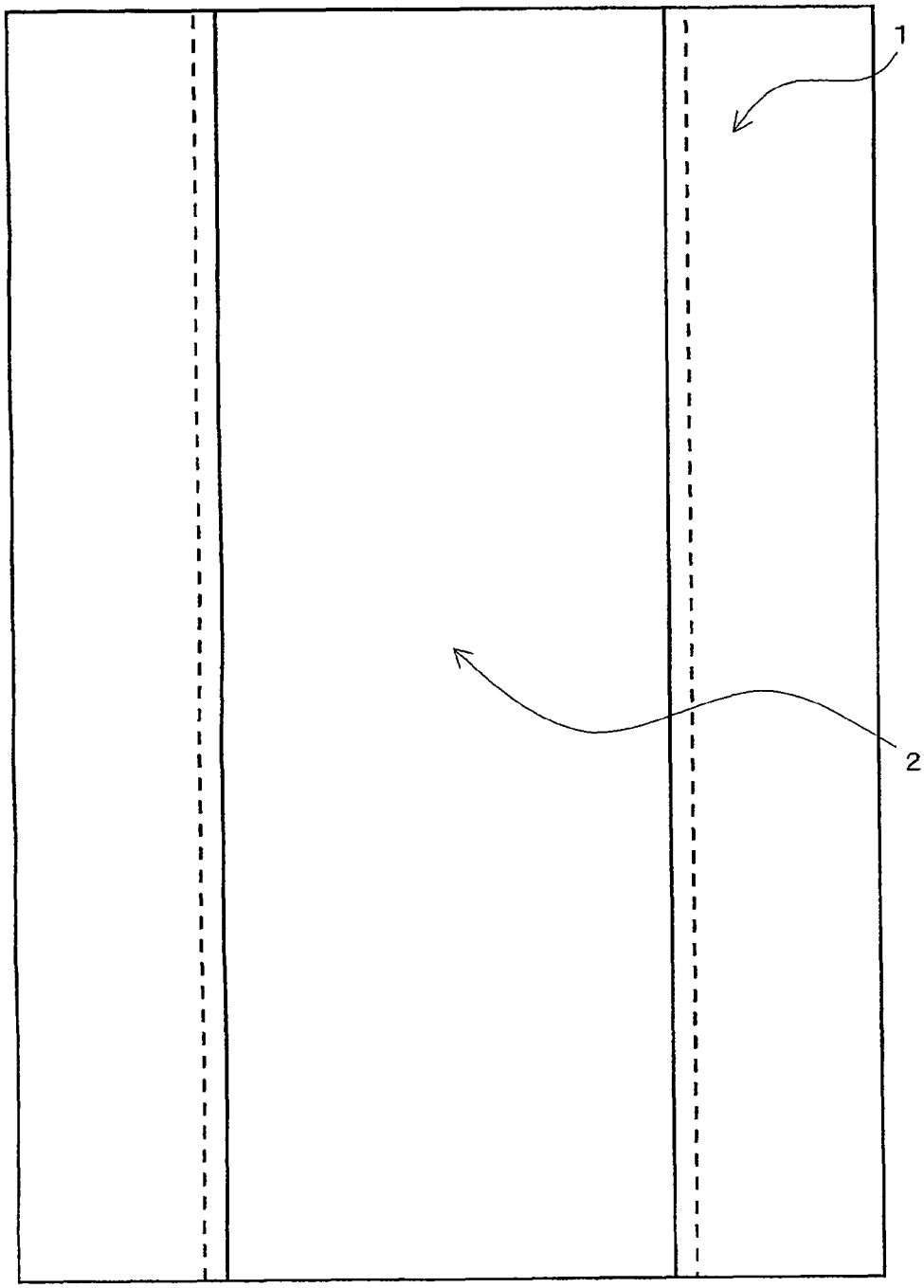
FIG. 18 is a diagram of a state of an exemplary shearing position.

A cross-section of an exemplary mold shape is shown in FIG. 14. The legend in FIG. 14 is shown here (1: die, 2: punch). The shape of the punch as seen from above is shown in FIG. 15. The legend in FIG. 15 is shown here (2: punch). The shape of the die as seen from below is shown in FIG. 16. The legend in FIG. 16 is shown here (1: die). The mold followed the shape of the punch. The shape of the die was determined by providing a clearance of a thickness of 1.6 mm. The blank size, in mm, was 1.6 (thickness)×300×500. Shaping conditions were as follows: the punch speed was 10 mm/s, the pressing force was 200 tons, and the holding time until the bottom dead point was 5 seconds. A schematic view of an exemplary shaped part is shown in FIG. 17. A tensile test piece was then cut out from the shaped part. The tensile strength of the shaped part was observed to be 1470 MPa or more. Shearing was produced by piercing the samples. The position shown in FIG. 18 was pierced using a punch having a diameter of 10 mm and a die having a diameter of 10.5 mm. FIG. 18 shows the shape of the part as seen from above. The legend in FIG. 18 is shown here (1: part, 2: center of pieced hole). The piercing was performed within 30 minutes after the hot shaping. After the piercing, shaping was performed. The working techniques used are also shown in Table 6. In the legend, shaping is indicated by "S", while no working is indicated by "N". At this time, the finished hole diameter was changed and the effect of the removed thickness was studied. The conditions used are shown together in Table 6. The shaping was performed within 30 minutes after the piercing. The resistance to hydrogen embrittlement was evaluated by examining the entire circumference of the hole one week after the shaping to evaluate the presence of any cracks. The examination was performed using a loupe or an electron microscope. The results of these observations are shown together in Table 6. The press used was a general crank press.

Experiment Nos. 1 to 249 show the effects of the steel type, plating type, concentration of hydrogen in the atmosphere, and dew point for steel sheets that were worked by shaping. No cracks were observed after piercing for samples processed in accordance with exemplary embodiments of the present invention. Experiment Nos. 250 to 277 are comparative examples in which no working was performed. In all of these cases, no cracks were observed.

TABLE 4

| Steel type | C | Si | Mn | P | S | Al | Cr | N | Ti | (wt %) B |
|---|---|---|---|---|---|---|---|---|---|---|
| C | 0.22 | 0.2 | 2.2 | 0.015 | 0.008 | 0.040 | — | 0.0040 | — | — |
| D | 0.22 | 0.22 | 1.1 | 0.010 | 0.003 | 0.050 | 0.20 | 0.0034 | 0.023 | 0.0023 |
| E | 0.21 | 0.18 | 1.3 | 0.006 | 0.004 | 0.031 | 1.10 | 0.0038 | — | — |

TABLE 5

| Plating type | Legend |
|---|---|
| No plating | CR |
| Aluminum plating | AL |
| Alloying hot dip galvanization | GA |
| Hot dip galvanization | GI |

TABLE 6

| Ex. no. | Steel type | Plating type | H am't (%) | Dew point (° C.) | Work Method | Am't of work (mm) | Cracks | Class |
|---|---|---|---|---|---|---|---|---|
| (Part 1) | | | | | | | | |
| 1 | C | CR | 80 | −40 | S | 0.1 | Yes | Comp. Ex. |
| 2 | C | CR | 80 | −20 | S | 0.1 | Yes | Comp. Ex. |
| 3 | C | CR | 80 | 0 | S | 0.1 | Yes | Comp. Ex. |
| 4 | C | CR | 80 | 5 | S | 0.1 | Yes | Comp. Ex. |
| 5 | C | CR | 80 | 15 | S | 0.1 | Yes | Comp. Ex. |
| 6 | C | CR | 80 | 25 | S | 0.1 | Yes | Comp. Ex. |
| 7 | C | CR | 80 | 40 | S | 0.1 | Yes | Comp. Ex. |
| 8 | C | AL | 80 | −40 | S | 0.1 | Yes | Comp. Ex. |
| 9 | C | AL | 80 | −20 | S | 0.1 | Yes | Comp. Ex. |
| 10 | C | AL | 80 | 0 | S | 0.1 | Yes | Comp. Ex. |
| 11 | C | AL | 80 | 5 | S | 0.1 | Yes | Comp. Ex. |
| 12 | C | AL | 80 | 15 | S | 0.1 | Yes | Comp. Ex. |
| 13 | C | AL | 80 | 25 | S | 0.1 | Yes | Comp. Ex. |
| 14 | C | AL | 80 | 40 | S | 0.1 | Yes | Comp. Ex. |
| 15 | C | GI | 80 | −20 | S | 0.1 | Yes | Comp. Ex. |
| 16 | C | GA | 80 | −20 | S | 0.1 | Yes | Comp. Ex. |
| 17 | D | CR | 80 | −40 | S | 0.1 | Yes | Comp. Ex. |
| 18 | D | CR | 80 | −20 | S | 0.1 | Yes | Comp. Ex. |
| 19 | D | CR | 80 | 0 | S | 0.1 | Yes | Comp. Ex. |
| 20 | D | CR | 80 | 5 | S | 0.1 | Yes | Comp. Ex. |
| 21 | D | CR | 80 | 15 | S | 0.1 | Yes | Comp. Ex. |
| 22 | D | CR | 80 | 25 | S | 0.1 | Yes | Comp. Ex. |
| 23 | D | CR | 80 | 40 | S | 0.1 | Yes | Comp. Ex. |
| 24 | D | AL | 80 | −40 | S | 0.1 | Yes | Comp. Ex. |
| 25 | D | AL | 80 | −20 | S | 0.1 | Yes | Comp. Ex. |
| 26 | D | AL | 80 | 0 | S | 0.1 | Yes | Comp. Ex. |
| 27 | D | AL | 80 | 5 | S | 0.1 | Yes | Comp. Ex. |
| 28 | D | AL | 80 | 15 | S | 0.1 | Yes | Comp. Ex. |
| 29 | D | AL | 80 | 25 | S | 0.1 | Yes | Comp. Ex. |
| 30 | D | AL | 80 | 40 | S | 0.1 | Yes | Comp. Ex. |
| 31 | D | GI | 80 | −20 | S | 0.1 | Yes | Comp. Ex. |
| 32 | D | GA | 80 | −20 | S | 0.1 | Yes | Comp. Ex. |
| 33 | E | CR | 80 | −40 | S | 0.1 | Yes | Comp. Ex. |
| 34 | E | CR | 80 | −20 | S | 0.1 | Yes | Comp. Ex. |
| 35 | E | CR | 80 | 0 | S | 0.1 | Yes | Comp. Ex. |
| 36 | E | CR | 80 | 5 | S | 0.1 | Yes | Comp. Ex. |
| 37 | E | CR | 80 | 15 | S | 0.1 | Yes | Comp. Ex. |
| 38 | E | CR | 80 | 25 | S | 0.1 | Yes | Comp. Ex. |
| 39 | E | CR | 80 | 40 | S | 0.1 | Yes | Comp. Ex. |
| 40 | E | AL | 80 | −40 | S | 0.1 | Yes | Comp. Ex. |
| 41 | E | AL | 80 | −20 | S | 0.1 | Yes | Comp. Ex. |
| 42 | E | AL | 80 | 0 | S | 0.1 | Yes | Comp. Ex. |
| 43 | E | AL | 80 | 5 | S | 0.1 | Yes | Comp. Ex. |
| 44 | E | AL | 80 | 15 | S | 0.1 | Yes | Comp. Ex. |
| 45 | E | AL | 80 | 25 | S | 0.1 | Yes | Comp. Ex. |
| 46 | E | AL | 80 | 40 | S | 0.1 | Yes | Comp. Ex. |
| 47 | E | GI | 80 | −20 | S | 0.1 | Yes | Comp. Ex. |
| 48 | E | GA | 80 | −20 | S | 0.1 | Yes | Comp. Ex. |
| 49 | C | CR | 80 | −40 | S | 0.1 | Yes | Comp. Ex. |

TABLE 6-continued

| Ex. no. | Steel type | Plating type | H am't (%) | Dew point (° C.) | Work Method | Am't of work (mm) | Cracks | Class |
|---|---|---|---|---|---|---|---|---|
| 50 | C | CR | 80 | 0 | S | 0.1 | Yes | Comp. Ex. |
| 51 | C | CR | 40 | 15 | S | 0.1 | Yes | Comp. Ex. |
| 52 | C | CR | 40 | 40 | S | 0.1 | Yes | Comp. Ex. |
| 53 | D | CR | 40 | −40 | S | 0.1 | Yes | Comp. Ex. |
| 54 | D | CR | 40 | 0 | S | 0.1 | Yes | Comp. Ex. |
| 55 | D | CR | 40 | 15 | S | 0.1 | Yes | Comp. Ex. |
| 56 | D | CR | 40 | 40 | S | 0.1 | Yes | Comp. Ex. |
| 57 | E | CR | 40 | −40 | S | 0.1 | Yes | Comp. Ex. |
| 58 | E | CR | 40 | 0 | S | 0.1 | Yes | Comp. Ex. |
| 59 | E | CR | 40 | 15 | S | 0.1 | Yes | Comp. Ex. |
| 60 | E | CR | 40 | 40 | S | 0.1 | Yes | Comp. Ex. |
| 61 | C | CR | 8 | −40 | S | 0.1 | None | Inv. range |
| 62 | C | CR | 8 | −20 | S | 0.1 | None | Inv. range |
| 63 | C | CR | 8 | 0 | S | 0.1 | None | Inv. range |
| 64 | C | CR | 8 | 5 | S | 0.1 | None | Inv. range |
| 65 | C | CR | 8 | 15 | S | 0.1 | None | Inv. range |
| 66 | C | CR | 8 | 25 | S | 0.1 | None | Inv. range |
| 67 | C | CR | 8 | 40 | S | 0.1 | Yes | Comp. Ex. |
| 68 | D | CR | 8 | −40 | S | 0.1 | None | Inv. range |
| 69 | D | CR | 8 | −20 | S | 0.1 | None | Inv. range |
| 70 | D | CR | 8 | 0 | S | 0.1 | None | Inv. range |
| 71 | D | CR | 8 | 5 | S | 0.1 | None | Inv. range |
| 72 | D | CR | 8 | 15 | S | 0.1 | None | Inv. range |
| 73 | D | CR | 8 | 25 | S | 0.1 | None | Inv. range |
| 74 | D | CR | 8 | 40 | S | 0.1 | Yes | Comp. Ex. |
| 75 | E | CR | 8 | −40 | S | 0.1 | None | Inv. range |
| 76 | E | CR | 8 | −20 | S | 0.1 | None | Inv. range |
| 77 | E | CR | 8 | 0 | S | 0.1 | None | Inv. range |
| 78 | E | CR | 8 | 5 | S | 0.1 | None | Inv. range |
| 79 | E | CR | 8 | 15 | S | 0.1 | None | Inv. range |
| 80 | E | CR | 8 | 25 | S | 0.1 | None | Inv. range |
| 81 | E | CR | 8 | 40 | S | 0.1 | Yes | Comp. Ex. |
| 82 | C | CR | 4 | −40 | S | 0.1 | None | Inv. range |
| 83 | C | CR | 4 | 0 | S | 0.1 | None | Inv. range |
| 84 | C | CR | 4 | 15 | S | 0.1 | None | Inv. range |
| 85 | C | CR | 4 | 40 | S | 0.1 | Yes | Comp. Ex. |
| 86 | D | CR | 4 | −40 | S | 0.1 | None | Inv. range |
| 87 | D | CR | 4 | 0 | S | 0.1 | None | Inv. range |
| 88 | D | CR | 4 | 15 | S | 0.1 | None | Inv. range |
| 89 | D | CR | 4 | 40 | S | 0.1 | Yes | Comp. Ex. |
| 90 | E | CR | 4 | −40 | S | 0.1 | None | Inv. range |
| 91 | E | CR | 4 | 0 | S | 0.1 | None | Inv. range |
| 92 | E | CR | 4 | 15 | S | 0.1 | None | Inv. range |
| 93 | E | CR | 4 | 40 | S | 0.1 | Yes | Comp. Ex. |
| 94 | C | CR | 2 | −40 | S | 0.1 | None | Inv. range |
| 95 | C | CR | 2 | −20 | S | 0.1 | None | Inv. range |
| 96 | C | CR | 2 | 0 | S | 0.1 | None | Inv. range |
| 97 | C | CR | 2 | 5 | S | 0.1 | None | Inv. range |
| 98 | C | CR | 2 | 15 | S | 0.1 | None | Inv. range |
| 99 | C | CR | 2 | 25 | S | 0.1 | None | Inv. range |
| 100 | C | CR | 2 | 40 | S | 0.1 | Yes | Comp. Ex. |
| (Part 2) | | | | | | | | |
| 101 | C | AL | 2 | −40 | S | 0.1 | None | Inv. range |
| 102 | C | AL | 2 | −20 | S | 0.1 | None | Inv. range |
| 103 | C | AL | 2 | 0 | S | 0.1 | None | Inv. range |
| 104 | C | AL | 2 | 5 | S | 0.1 | None | Inv. range |
| 105 | C | AL | 2 | 15 | S | 0.1 | None | Inv. range |
| 106 | C | AL | 2 | 25 | S | 0.1 | None | Inv. range |
| 107 | C | AL | 2 | 40 | S | 0.1 | Yes | Comp. Ex. |
| 108 | C | GI | 2 | 15 | S | 0.1 | None | Inv. range |
| 109 | C | GA | 2 | 15 | S | 0.1 | None | Inv. range |

TABLE 6-continued

| Ex. no. | Steel type | Plating type | H am't (%) | Dew point (° C.) | Work Method | Am't of work (mm) | Cracks | Class |
|---|---|---|---|---|---|---|---|---|
| 110 | D | CR | 2 | −40 | S | 0.1 | None | Inv. range |
| 111 | D | CR | 2 | −20 | S | 0.1 | None | Inv. range |
| 112 | D | CR | 2 | 0 | S | 0.1 | None | Inv. range |
| 113 | D | CR | 2 | 5 | S | 0.1 | None | Inv. range |
| 114 | D | CR | 2 | 15 | S | 0.1 | None | Inv. range |
| 115 | D | CR | 2 | 25 | S | 0.1 | None | Inv. range |
| 116 | D | CR | 2 | 40 | S | 0.1 | Yes | Comp. Ex. |
| 117 | D | AL | 2 | −40 | S | 0.1 | None | Inv. range |
| 118 | D | AL | 2 | −20 | S | 0.1 | None | Inv. range |
| 119 | D | AL | 2 | 0 | S | 0.1 | None | Inv. range |
| 120 | D | AL | 2 | 5 | S | 0.1 | None | Inv. range |
| 121 | D | AL | 2 | 15 | S | 0.1 | None | Inv. range |
| 122 | D | AL | 2 | 25 | S | 0.1 | None | Inv. range |
| 123 | D | AL | 2 | 40 | S | 0.1 | Yes | Comp. Ex. |
| 124 | D | GI | 2 | 15 | S | 0.1 | None | Inv. range |
| 125 | D | GA | 2 | 15 | S | 0.1 | None | Inv. range |
| 126 | D | CR | 2 | −40 | S | 0.1 | None | Inv. range |
| 127 | E | CR | 2 | 20 | S | 0.1 | None | Inv. range |
| 128 | E | CR | 2 | 0 | S | 0.1 | None | Inv. range |
| 129 | E | CR | 2 | 5 | S | 0.1 | None | Inv. range |
| 130 | E | CR | 2 | 15 | S | 0.1 | None | Inv. range |
| 131 | E | CR | 2 | 25 | S | 0.1 | None | Inv. range |
| 132 | E | CR | 2 | 40 | S | 0.1 | Yes | Comp. Ex. |
| 133 | E | AL | 2 | −40 | S | 0.1 | None | Inv. range |
| 134 | E | AL | 2 | −20 | S | 0.1 | None | Inv. range |
| 135 | E | AL | 2 | 0 | S | 0.1 | None | Inv. range |
| 136 | E | AL | 2 | 5 | S | 0.1 | None | Inv. range |
| 137 | E | AL | 2 | 15 | S | 0.1 | None | Inv. range |
| 138 | E | AL | 2 | 25 | S | 0.1 | None | Inv. range |
| 139 | E | AL | 2 | 40 | S | 0.1 | Yes | Comp. Ex. |
| 140 | E | GI | 2 | 15 | S | 0.1 | None | Inv. range |
| 141 | E | GA | 2 | 15 | S | 0.1 | None | Inv. range |
| 142 | C | CR | 0.5 | −40 | S | 0.1 | None | Inv. range |
| 143 | C | CR | 0.5 | 0 | S | 0.1 | None | Inv. range |
| 144 | C | CR | 0.5 | 15 | S | 0.1 | None | Inv. range |
| 145 | C | CR | 0.5 | 40 | S | 0.1 | Yes | Comp. Ex. |
| 146 | D | CR | 0.5 | −40 | S | 0.1 | None | Inv. range |
| 147 | D | CR | 0.5 | 0 | S | 0.1 | None | Inv. range |
| 148 | D | CR | 0.5 | 15 | S | 0.1 | None | Inv. range |
| 149 | D | CR | 0.5 | 40 | S | 0.1 | Yes | Comp. Ex. |
| 150 | E | CR | 0.5 | −40 | S | 0.1 | None | Inv. range |
| 151 | E | CR | 0.5 | 0 | S | 0.1 | None | Inv. range |
| 152 | E | CR | 0.5 | 15 | S | 0.1 | None | Inv. range |
| 153 | E | CR | 0.5 | 40 | S | 0.1 | Yes | Comp. Ex. |
| 154 | E | CR | 0.1 | −40 | S | 0.1 | None | Inv. range |
| 155 | C | CR | 0.1 | −20 | S | 0.1 | None | Inv. range |
| 156 | C | CR | 0.1 | 0 | S | 0.1 | None | Inv. range |
| 157 | C | CR | 0.1 | 5 | S | 0.1 | None | Inv. range |
| 158 | C | CR | 0.1 | 15 | S | 0.1 | None | Inv. range |
| 159 | C | CR | 0.1 | 25 | S | 0.1 | None | Inv. range |
| 160 | C | CR | 0.1 | 40 | S | 0.1 | Yes | Comp. Ex. |
| 161 | C | AL | 0.1 | −40 | S | 0.1 | None | Inv. range |
| 162 | C | AL | 0.1 | −20 | S | 0.1 | None | Inv. range |
| 163 | C | AL | 0.1 | 0 | S | 0.1 | None | Inv. range |
| 164 | C | AL | 0.1 | 5 | S | 0.1 | None | Inv. range |
| 165 | C | AL | 0.1 | 15 | S | 0.1 | None | Inv. range |
| 166 | C | AL | 0.1 | 25 | S | 0.1 | None | Inv. range |
| 167 | C | AL | 0.1 | 40 | S | 0.1 | Yes | Comp. Ex. |
| 168 | C | GI | 0.1 | 15 | S | 0.1 | None | Inv. range |
| 169 | C | GA | 0.1 | 15 | S | 0.1 | None | Inv. range |
| 170 | D | CR | 0.1 | −40 | S | 0.1 | None | Inv. range |
| 171 | D | CR | 0.1 | −20 | S | 0.1 | None | Inv. range |
| 172 | D | CR | 0.1 | 0 | S | 0.1 | None | Inv. range |
| 173 | D | CR | 0.1 | 5 | S | 0.1 | None | Inv. range |
| 174 | D | CR | 0.1 | 15 | S | 0.1 | None | Inv. range |
| 175 | D | CR | 0.1 | 25 | S | 0.1 | None | Inv. range |
| 176 | D | CR | 0.1 | 40 | S | 0.1 | Yes | Comp. Ex. |
| 177 | D | AL | 0.1 | −40 | S | 0.1 | None | Inv. range |
| 178 | D | AL | 0.1 | −20 | S | 0.1 | None | Inv. range |
| 179 | D | AL | 0.1 | 0 | S | 0.1 | None | Inv. range |
| 180 | D | AL | 0.1 | 5 | S | 0.1 | None | Inv. range |
| 181 | D | AL | 0.1 | 15 | S | 0.1 | None | Inv. range |
| 182 | D | AL | 0.1 | 25 | S | 0.1 | None | Inv. range |
| 183 | D | AL | 0.1 | 40 | S | 0.1 | Yes | Comp. Ex. |
| 184 | D | GI | 0.1 | 15 | S | 0.1 | None | Inv. range |

TABLE 6-continued

| Ex. no. | Steel type | Plating type | H am't (%) | Dew point (° C.) | Work Method | Am't of work (mm) | Cracks | Class |
|---|---|---|---|---|---|---|---|---|
| 185 | D | GA | 0.1 | 15 | S | 0.1 | None | Inv. range |
| 186 | E | CR | 0.1 | −40 | S | 0.1 | None | Inv. range |
| 187 | E | CR | 0.1 | −20 | S | 0.1 | None | Inv. range |
| 188 | E | CR | 0.1 | 0 | S | 0.1 | None | Inv. range |
| 189 | E | CR | 0.1 | 5 | S | 0.1 | None | Inv. range |
| 190 | E | CR | 0.1 | 15 | S | 0.1 | None | Inv. range |
| 191 | E | CR | 0.1 | 25 | S | 0.1 | None | Inv. range |
| 192 | E | CR | 0.1 | 40 | S | 0.1 | Yes | Comp. Ex. |
| 193 | E | AL | 0.1 | −40 | S | 0.1 | None | Inv. range |
| 194 | E | AL | 0.1 | −20 | S | 0.1 | None | Inv. range |
| 195 | E | AL | 0.1 | 0 | S | 0.1 | None | Inv. range |
| 196 | E | AL | 0.1 | 5 | S | 0.1 | None | Inv. range |
| 197 | E | AL | 0.1 | 15 | S | 0.1 | None | Inv. range |
| 198 | E | AL | 0.1 | 25 | S | 0.1 | None | Inv. range |
| 199 | E | AL | 0.1 | 40 | S | 0.1 | Yes | Comp. Ex. |
| 200 | E | GI | 0.1 | 15 | S | 0.1 | None | Inv. range |
| (Part 3) | | | | | | | | |
| 201 | E | GA | 0.1 | 15 | S | 0.1 | None | Inv. range |
| 202 | C | CR | 0.05 | −20 | S | 0.1 | None | Inv. range |
| 203 | C | CR | 0.05 | −40 | S | 0.1 | None | Inv. range |
| 204 | C | CR | 0.05 | −20 | S | 0.1 | None | Inv. range |
| 205 | C | CR | 0.05 | 0 | S | 0.1 | None | Inv. range |
| 206 | C | CR | 0.05 | 5 | S | 0.1 | None | Inv. range |
| 207 | C | CR | 0.05 | 15 | S | 0.1 | None | Inv. range |
| 208 | C | CR | 0.05 | 25 | S | 0.1 | None | Inv. range |
| 209 | C | CR | 0.05 | 40 | S | 0.1 | Yes | Comp. Ex. |
| 210 | D | CR | 0.05 | −20 | S | 0.1 | None | Inv. range |
| 211 | D | CR | 0.05 | −40 | S | 0.1 | None | Inv. range |
| 212 | D | CR | 0.05 | −20 | S | 0.1 | None | Inv. range |
| 213 | D | CR | 0.05 | 0 | S | 0.1 | None | Inv. range |
| 214 | D | CR | 0.05 | 5 | S | 0.1 | None | Inv. range |
| 215 | D | CR | 0.05 | 15 | S | 0.1 | None | Inv. range |
| 216 | D | CR | 0.05 | 25 | S | 0.1 | None | Inv. range |
| 217 | D | CR | 0.05 | 40 | S | 0.1 | Yes | Comp. Ex. |
| 218 | E | CR | 0.05 | −20 | S | 0.1 | None | Inv. range |
| 219 | E | CR | 0.05 | −40 | S | 0.1 | None | Inv. range |
| 220 | E | CR | 0.05 | −20 | S | 0.1 | None | Inv. range |
| 221 | E | CR | 0.05 | 0 | S | 0.1 | None | Inv. range |
| 222 | E | CR | 0.05 | 5 | S | 0.1 | None | Inv. range |
| 223 | E | CR | 0.05 | 15 | S | 0.1 | None | Inv. range |
| 224 | E | CR | 0.05 | 25 | S | 0.1 | None | Inv. range |
| 225 | E | CR | 0.05 | 40 | S | 0.1 | Yes | Comp. Ex. |
| 226 | C | CR | 0.01 | −40 | S | 0.1 | None | Inv. range |
| 227 | C | CR | 0.01 | 0 | S | 0.1 | None | Inv. range |
| 228 | C | CR | 0.01 | 15 | S | 0.1 | None | Inv. range |
| 229 | C | CR | 0.01 | 40 | S | 0.1 | Yes | Comp. Ex. |
| 230 | D | CR | 0.01 | −40 | S | 0.1 | None | Inv. range |
| 231 | D | CR | 0.01 | 0 | S | 0.1 | None | Inv. range |
| 232 | D | CR | 0.01 | 15 | S | 0.1 | None | Inv. range |
| 233 | D | CR | 0.01 | 40 | S | 0.1 | Yes | Comp. Ex. |
| 234 | E | CR | 0.01 | −40 | S | 0.1 | None | Inv. range |
| 235 | E | CR | 0.01 | 0 | S | 0.1 | None | Inv. range |
| 236 | E | CR | 0.01 | 15 | S | 0.1 | None | Inv. range |
| 237 | E | CR | 0.01 | 40 | S | 0.1 | Yes | Comp. Ex. |
| 238 | C | CR | 0.005 | −40 | S | 0.1 | None | Inv. range |
| 239 | C | CR | 0.005 | 0 | S | 0.1 | None | Inv. range |
| 240 | C | CR | 0.005 | 15 | S | 0.1 | None | Inv. range |
| 241 | C | CR | 0.005 | 40 | S | 0.1 | Yes | Comp. Ex. |
| 242 | D | CR | 0.005 | −40 | S | 0.1 | None | Inv. range |
| 243 | D | CR | 0.005 | 0 | S | 0.1 | None | Inv. range |
| 244 | D | CR | 0.005 | 15 | S | 0.1 | None | Inv. range |
| 245 | D | CR | 0.005 | 40 | S | 0.1 | Yes | Comp. Ex. |
| 246 | E | CR | 0.005 | −40 | S | 0.1 | None | Inv. range |
| 247 | E | CR | 0.005 | 0 | S | 0.1 | None | Inv. range |
| 248 | E | CR | 0.005 | 15 | S | 0.1 | None | Inv. range |
| 249 | E | CR | 0.005 | 40 | S | 0.1 | Yes | Comp. Ex. |
| 250 | D | CR | 80 | −40 | S | 0.1 | Yes | Comp. Ex. |
| 251 | D | CR | 80 | −20 | N | 0 | Yes | Comp. Ex. |
| 252 | D | CR | 80 | 0 | N | 0 | Yes | Comp. Ex. |
| 253 | D | CR | 80 | 5 | N | 0 | Yes | Comp. Ex. |
| 254 | D | CR | 80 | 15 | N | 0 | Yes | Comp. Ex. |
| 255 | D | CR | 80 | 25 | N | 0 | Yes | Comp. Ex. |
| 256 | D | CR | 80 | 40 | N | 0 | Yes | Comp. Ex. |
| 257 | D | AL | 80 | −40 | N | 0 | Yes | Comp. Ex. |

TABLE 6-continued

| Ex. no. | Steel type | Plating type | H am't (%) | Dew point (° C.) | Work Method | Am't of work (mm) | Cracks | Class |
|---|---|---|---|---|---|---|---|---|
| 258 | D | AL | 80 | −20 | N | 0 | Yes | Comp. Ex. |
| 259 | D | AL | 80 | 0 | N | 0 | Yes | Comp. Ex. |
| 260 | D | AL | 80 | 5 | N | 0 | Yes | Comp. Ex. |
| 261 | D | AL | 80 | 15 | N | 0 | Yes | Comp. Ex. |
| 262 | D | AL | 80 | 25 | N | 0 | Yes | Comp. Ex. |
| 263 | D | AL | 80 | 40 | N | 0 | Yes | Comp. Ex. |
| 264 | D | CR | 8 | −40 | N | 0 | Yes | Comp. Ex. |
| 265 | D | CR | 8 | −20 | N | 0 | Yes | Comp. Ex. |
| 266 | D | CR | 8 | 0 | N | 0 | Yes | Comp. Ex. |
| 267 | D | CR | 8 | 5 | N | 0 | Yes | Comp. Ex. |
| 268 | D | CR | 8 | 15 | N | 0 | Yes | Comp. Ex. |
| 269 | D | CR | 8 | 25 | N | 0 | Yes | Comp. Ex. |
| 270 | D | CR | 8 | 40 | N | 0 | Yes | Comp. Ex. |
| 271 | D | AL | 8 | −40 | N | 0 | Yes | Comp. Ex. |
| 272 | D | AL | 8 | −20 | N | 0 | Yes | Comp. Ex. |
| 273 | D | AL | 8 | 0 | N | 0 | Yes | Comp. Ex. |
| 274 | D | AL | 8 | 5 | N | 0 | Yes | Comp. Ex. |
| 275 | D | AL | 8 | 15 | N | 0 | Yes | Comp. Ex. |
| 276 | D | AL | 8 | 25 | N | 0 | Yes | Comp. Ex. |
| 277 | D | AL | 8 | 40 | N | 0 | Yes | Comp. Ex. |

Example 3

Slabs having the chemical compositions shown in Table 4 were cast. These slabs were heated to 1050 to 1350° C. and hot rolled at a finishing temperature of 800 to 900° C. and a coiling temperature of 450 to 680° C. to obtain hot rolled steel sheets having a thickness of 4 mm. Next, these sheets were pickled, then cold rolled to obtain cold rolled steel sheets having a thickness of 1.6 mm. Further, parts of these cold rolled sheets were treated by hot dip aluminum coating, hot dip aluminum-zinc coating, alloying hot dip galvanization, and/or hot dip galvanization. Table 5 indicates the legends used for the plating types. After plating, these cold rolled steel sheets and surface treated steel sheets were heated in a furnace to above the Ac3 point, that is, above 950° C. and into the austenite region, then hot shaped. The atmosphere of the heating furnace was varied with respect to the amount of hydrogen present and the dew point. The conditions used are shown in Table 7.

A cross-section of the shape of the mold is shown in FIG. 14. The legend in FIG. 14 is shown here (1: die, 2: punch). The shape of the punch as seen from above is shown in FIG. 15. FIG. 15 shows the legend (2: punch). The shape of the die as seen from the bottom is shown in FIG. 16. The legend in FIG. 16 is shown here (1: die). The mold followed the shape of the punch. The shape of the die was determined by providing a clearance of a thickness of 1.6 mm. The blank size (in mm) was 1.6 (thickness)×300×500. The shaping conditions included a punch speed of 10 mm/s, a pressing force of 200 tons, and a holding time at bottom dead center of 5 seconds. A schematic view of the shaped part is shown in FIG. 17. Using tensile test pieces cut out from the shaped part, the tensile strength of the shaped part was observed to be 1470 MPa or more.

Figure 19:
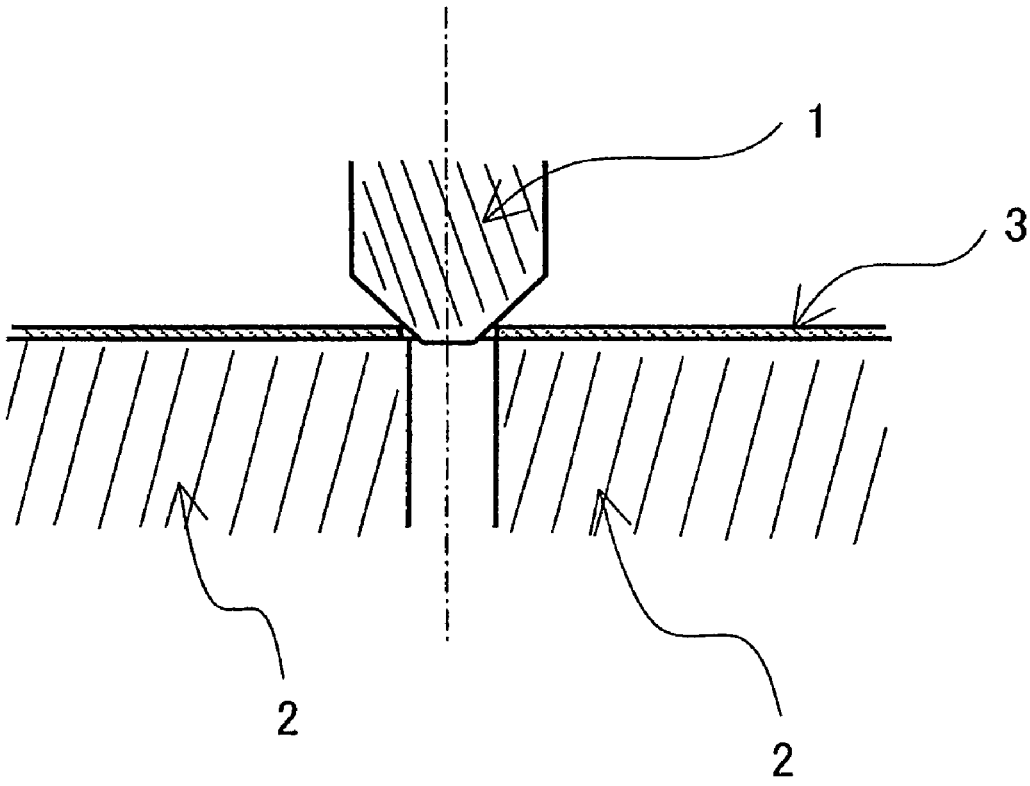
FIG. 19 is a schematic diagram of an exemplary cross-sectional shape of a coining tool.
Figure 20A:
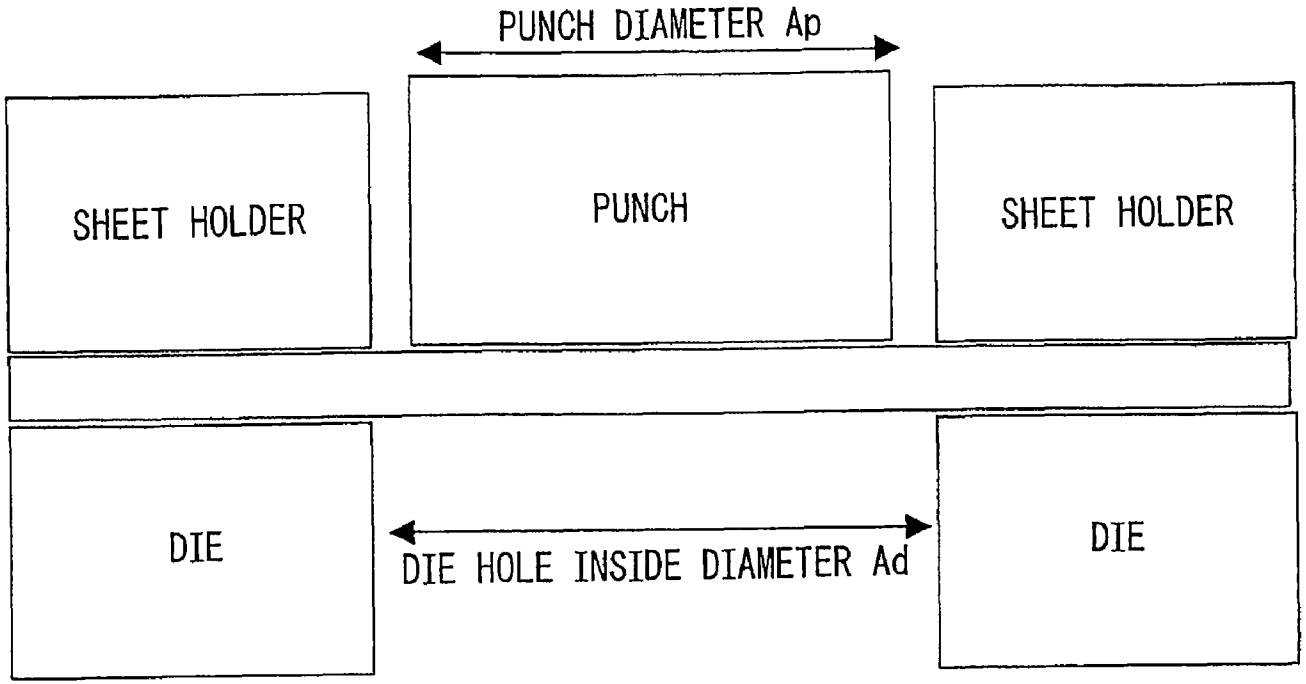
FIG. 20 is a schematic diagram of an exemplary cross-sectional shape of a mold described in Example 4.
Figure 20B:
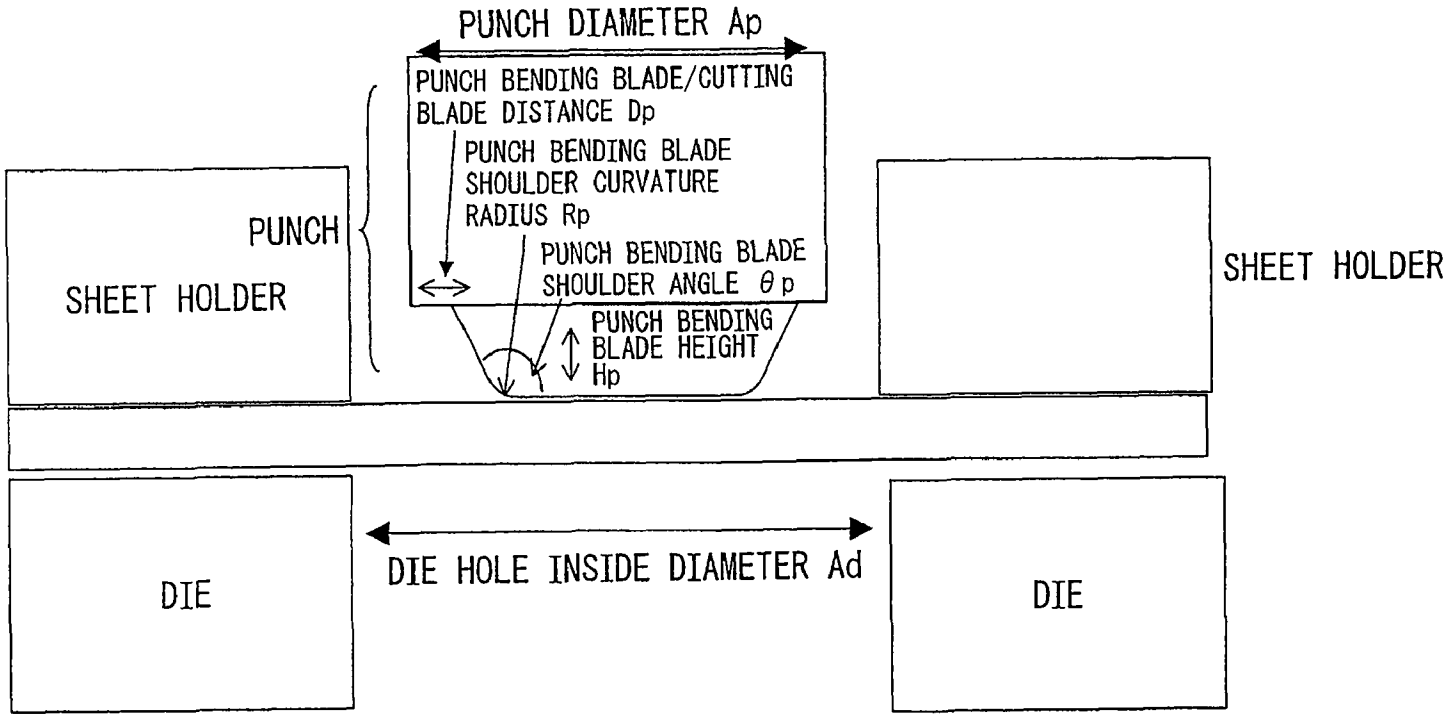
Figure 20C:
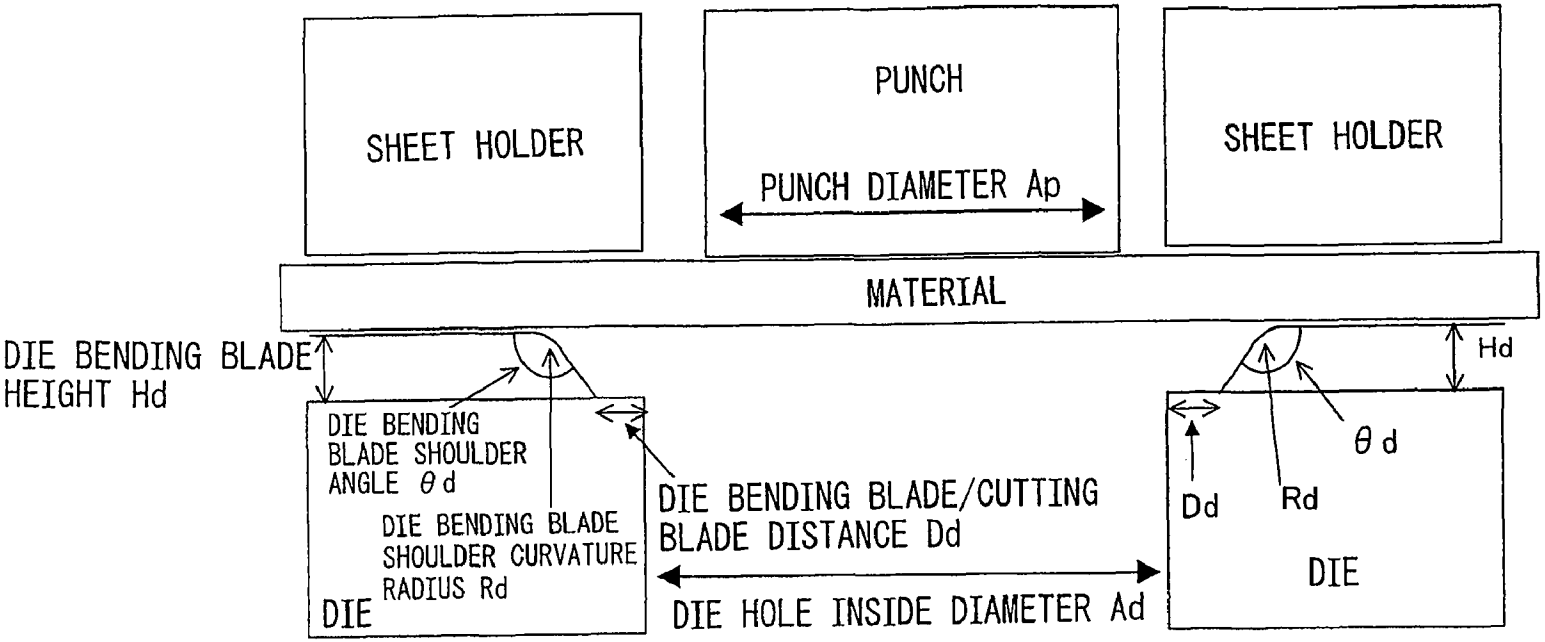
Figure 20D:
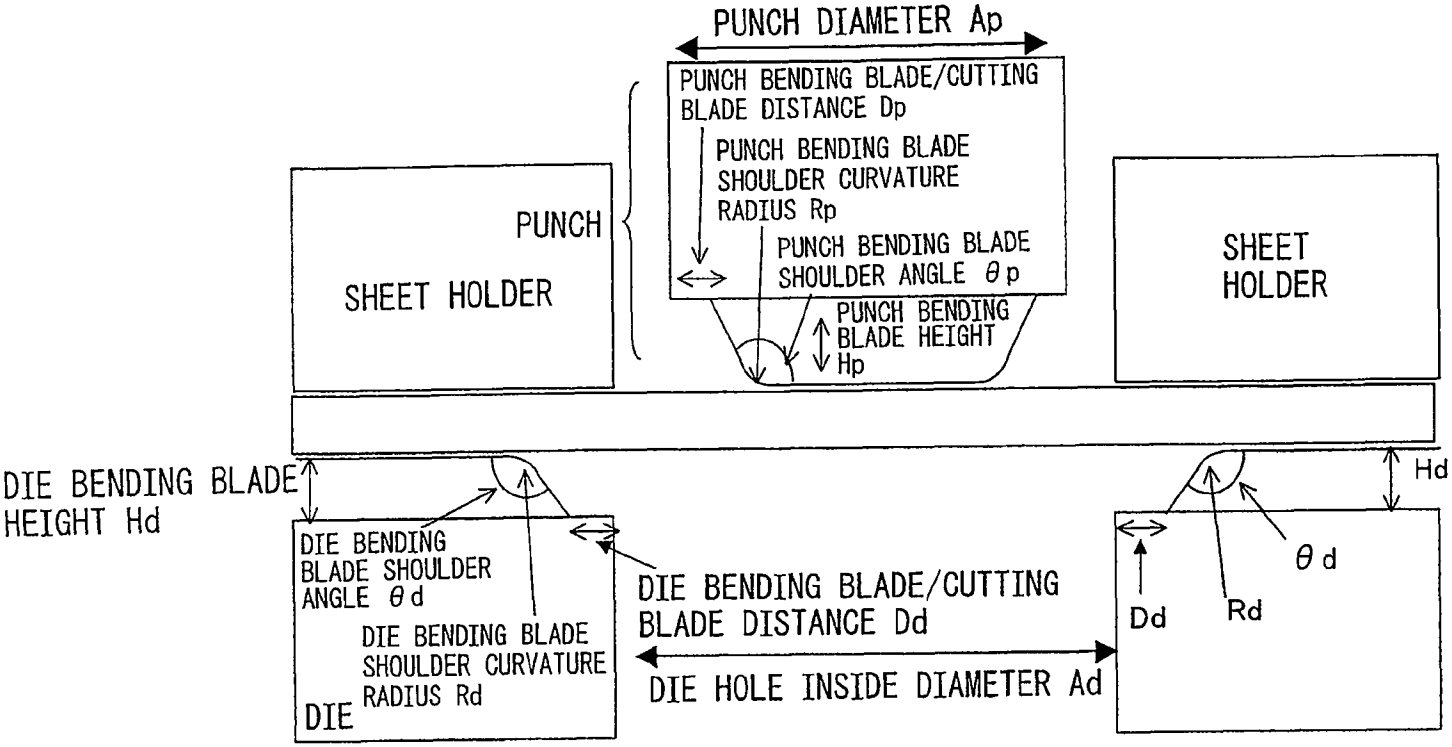

Shearing was performed by piercing. The position shown in FIG. 18 was pierced using a punch having a diameter of 10 mm and a die having a diameter of 10.5 mm. FIG. 18 shows the shape of the part as seen from above. The legend in FIG. 18 is shown here (1: part, 2: center of pierce hole). The piercing was performed within 30 minutes after hot shaping. After piercing, coining was performed. The coining was performed by sandwiching a plate to be worked between a conical punch having an angle of 45° with respect to the plate surface and a die having a flat surface. FIG. 19 shows the tool which was used. The legend in FIG. 19 is shown here (1: punch, 2: die, 3: blank after piercing). The coining was performed within 30 seconds after piercing. Resistance to hydrogen embrittlement was evaluated one week after coining by observing the entire circumference of the hole and evaluating the presence of cracks. The cracks were observed using a loupe or an electron microscope. The results of these observations are shown together in Table 7.

Experiment Nos. 1 to 249 show the results based on different steel types, plating types, concentrations of hydrogen in the atmosphere, and dew points for the case of coining. No cracks were observed after piercing for samples processed in accordance with exemplary embodiments of the present invention. Experiment Nos. 250 to 277 are comparative examples in which no coining was performed. These samples were not processed in accordance with exemplary embodiments of the present invention, and cracks were observed in these samples after piercing.

TABLE 7

| Ex. no. | Steel type | Plating type | H am't (%) | Dew point (° C.) | Work method | Cracks | Class |
|---|---|---|---|---|---|---|---|
| | | | | (Part 1) | | | |
| 1 | C | CR | 80 | −40 | Coining | Yes | Comp. Ex. |
| 2 | C | CR | 80 | −20 | Coining | Yes | Comp. Ex. |
| 3 | C | CR | 80 | 0 | Coining | Yes | Comp. Ex. |
| 4 | C | CR | 80 | 5 | Coining | Yes | Comp. Ex. |
| 5 | C | CR | 80 | 15 | Coining | Yes | Comp. Ex. |
| 6 | C | CR | 80 | 25 | Coining | Yes | Comp. Ex. |
| 7 | C | CR | 80 | 40 | Coining | Yes | Comp. Ex. |
| 8 | C | AL | 80 | −40 | Coining | Yes | Comp. Ex. |
| 9 | C | AL | 80 | −20 | Coining | Yes | Comp. Ex. |
| 10 | C | AL | 80 | 0 | Coining | Yes | Comp. Ex. |
| 11 | C | AL | 80 | 5 | Coining | Yes | Comp. Ex. |
| 12 | C | AL | 80 | 15 | Coining | Yes | Comp. Ex. |
| 13 | C | AL | 80 | 25 | Coining | Yes | Comp. Ex. |
| 14 | C | AL | 80 | 40 | Coining | Yes | Comp. Ex. |
| 15 | C | GI | 80 | −20 | Coining | Yes | Comp. Ex. |
| 16 | C | GA | 80 | −20 | Coining | Yes | Comp. Ex. |
| 17 | D | CR | 80 | −40 | Coining | Yes | Comp. Ex. |
| 18 | D | CR | 80 | −20 | Coining | Yes | Comp. Ex. |
| 19 | D | CR | 80 | 0 | Coining | Yes | Comp. Ex. |
| 20 | D | CR | 80 | 5 | Coining | Yes | Comp. Ex. |
| 21 | D | CR | 80 | 15 | Coining | Yes | Comp. Ex. |
| 22 | D | CR | 80 | 25 | Coining | Yes | Comp. Ex. |
| 23 | D | CR | 80 | 40 | Coining | Yes | Comp. Ex. |
| 24 | D | AL | 80 | −40 | Coining | Yes | Comp. Ex. |
| 25 | D | AL | 80 | −20 | Coining | Yes | Comp. Ex. |
| 26 | D | AL | 80 | 0 | Coining | Yes | Comp. Ex. |
| 27 | D | AL | 80 | 5 | Coining | Yes | Comp. Ex. |
| 28 | D | AL | 80 | 15 | Coining | Yes | Comp. Ex. |
| 29 | D | AL | 80 | 25 | Coining | Yes | Comp. Ex. |
| 30 | D | AL | 80 | 40 | Coining | Yes | Comp. Ex. |
| 31 | D | GI | 80 | −20 | Coining | Yes | Comp. Ex. |
| 32 | E | GA | 80 | −20 | Coining | Yes | Comp. Ex. |
| 33 | E | CR | 80 | −40 | Coining | Yes | Comp. Ex. |
| 34 | E | CR | 80 | −20 | Coining | Yes | Comp. Ex. |
| 35 | E | CR | 80 | 0 | Coining | Yes | Comp. Ex. |
| 36 | E | CR | 80 | 5 | Coining | Yes | Comp. Ex. |
| 37 | E | CR | 80 | 15 | Coining | Yes | Comp. Ex. |
| 38 | E | CR | 80 | 25 | Coining | Yes | Comp. Ex. |
| 39 | E | CR | 80 | 40 | Coining | Yes | Comp. Ex. |
| 40 | E | AL | 80 | −40 | Coining | Yes | Comp. Ex. |
| 41 | E | AL | 80 | −20 | Coining | Yes | Comp. Ex. |
| 42 | E | AL | 80 | 0 | Coining | Yes | Comp. Ex. |
| 43 | E | AL | 80 | 5 | Coining | Yes | Comp. Ex. |
| 44 | E | AL | 80 | 15 | Coining | Yes | Comp. Ex. |
| 45 | E | AL | 80 | 25 | Coining | Yes | Comp. Ex. |
| 46 | E | AL | 80 | 40 | Coining | Yes | Comp. Ex. |
| 47 | E | GI | 80 | −20 | Coining | Yes | Comp. Ex. |
| 48 | E | GA | 80 | −20 | Coining | Yes | Comp. Ex. |

TABLE 7-continued

| Ex. no. | Steel type | Plating type | H am't (%) | Dew point (° C.) | Work method | Cracks | Class |
|---|---|---|---|---|---|---|---|
| 49 | C | CR | 40 | −40 | Coining | Yes | Comp. Ex. |
| 50 | C | CR | 40 | 0 | Coining | Yes | Comp. Ex. |
| 51 | C | CR | 40 | 15 | Coining | Yes | Comp. Ex. |
| 52 | C | CR | 40 | 40 | Coining | Yes | Comp. Ex. |
| 53 | D | CR | 40 | −40 | Coining | Yes | Comp. Ex. |
| 54 | D | CR | 40 | 0 | Coining | Yes | Comp. Ex. |
| 55 | D | CR | 40 | 15 | Coining | Yes | Comp. Ex. |
| 56 | D | CR | 40 | 40 | Coining | Yes | Comp. Ex. |
| 57 | E | CR | 40 | −40 | Coining | Yes | Comp. Ex. |
| 58 | E | CR | 40 | 0 | Coining | Yes | Comp. Ex. |
| 59 | E | CR | 40 | 15 | Coining | Yes | Comp. Ex. |
| 60 | E | CR | 40 | 40 | Coining | Yes | Comp. Ex. |
| 61 | C | CR | 8 | −40 | Coining | None | Inv. range |
| 62 | C | CR | 8 | −20 | Coining | None | Inv. range |
| 63 | C | CR | 8 | 0 | Coining | None | Inv. range |
| 64 | C | CR | 8 | 5 | Coining | None | Inv. range |
| 65 | C | CR | 8 | 15 | Coining | None | Inv. range |
| 66 | C | CR | 8 | 25 | Coining | None | Inv. range |
| 67 | C | CR | 8 | 40 | Coining | Yes | Comp. Ex. |
| 68 | D | CR | 8 | −40 | Coining | None | Inv. range |
| 69 | D | CR | 8 | −20 | Coining | None | Inv. range |
| 70 | D | CR | 8 | 0 | Coining | None | Inv. range |
| 71 | D | CR | 8 | 5 | Coining | None | Inv. range |
| 72 | D | CR | 8 | 15 | Coining | None | Inv. range |
| 73 | D | CR | 8 | 25 | Coining | None | Inv. range |
| 74 | D | CR | 8 | 40 | Coining | Yes | Comp. Ex. |
| 75 | E | CR | 8 | −40 | Coining | None | Inv. range |
| 76 | E | CR | 8 | −20 | Coining | None | Inv. range |
| 77 | E | CR | 8 | 0 | Coining | None | Inv. range |
| 78 | E | CR | 8 | 5 | Coining | None | Inv. range |
| 79 | E | CR | 8 | 15 | Coining | None | Inv. range |
| 80 | E | CR | 8 | 25 | Coining | None | Inv. range |
| 81 | E | CR | 8 | 40 | Coining | Yes | Comp. Ex. |
| 82 | C | CR | 4 | −40 | Coining | None | Inv. range |
| 83 | C | CR | 4 | 0 | Coining | None | Inv. range |
| 84 | C | CR | 4 | 15 | Coining | None | Inv. range |
| 85 | C | CR | 4 | 40 | Coining | Yes | Comp. Ex. |
| 86 | D | CR | 4 | −40 | Coining | None | Inv. range |
| 87 | D | CR | 4 | 0 | Coining | None | Inv. range |
| 88 | D | CR | 4 | 15 | Coining | None | Inv. range |
| 89 | D | CR | 4 | 40 | Coining | Yes | Comp. Ex. |
| 90 | E | CR | 4 | −40 | Coining | None | Inv. range |
| 91 | E | CR | 4 | 0 | Coining | None | Inv. range |
| 92 | E | CR | 4 | 15 | Coining | None | Inv. range |
| 93 | E | CR | 4 | 40 | Coining | Yes | Comp. Ex. |
| 94 | C | CR | 2 | −40 | Coining | None | Inv. range |
| 95 | C | CR | 2 | −20 | Coining | None | Inv. range |
| 96 | C | CR | 2 | 0 | Coining | None | Inv. range |
| 97 | C | CR | 2 | 5 | Coining | None | Inv. range |
| 98 | C | CR | 2 | 15 | Coining | None | Inv. range |
| 99 | C | CR | 2 | 25 | Coining | None | Inv. range |
| 100 | C | CR | 2 | 40 | Coining | Yes | Comp. Ex. |
| | | | | (Part 2) | | | |
| 101 | C | AL | 2 | −40 | Coining | None | Inv. range |
| 102 | C | AL | 2 | −20 | Coining | None | Inv. range |
| 103 | C | AL | 2 | 0 | Coining | None | Inv. range |
| 104 | C | AL | 2 | 5 | Coining | None | Inv. range |
| 105 | C | AL | 2 | 15 | Coining | None | Inv. range |
| 106 | C | AL | 2 | 25 | Coining | None | Inv. range |
| 107 | C | AL | 2 | 40 | Coining | Yes | Comp. Ex. |
| 108 | C | GI | 2 | 15 | Coining | None | Inv. range |
| 109 | C | GA | 2 | −15 | Coining | None | Inv. range |
| 110 | D | CR | 2 | −40 | Coining | None | Inv. range |
| 111 | D | CR | 2 | 20 | Coining | None | Inv. range |
| 112 | D | CR | 2 | 0 | Coining | None | Inv. range |
| 113 | D | CR | 2 | 5 | Coining | None | Inv. range |
| 114 | D | CR | 2 | 15 | Coining | None | Inv. range |
| 115 | D | CR | 2 | 25 | Coining | None | Inv. range |
| 116 | D | CR | 2 | 40 | Coining | Yes | Comp. Ex. |
| 117 | D | AL | 2 | −40 | Coining | None | Inv. range |
| 118 | D | AL | 2 | −20 | Coining | None | Inv. range |
| 119 | D | AL | 2 | 0 | Coining | None | Inv. range |
| 120 | D | AL | 2 | 5 | Coining | None | Inv. range |
| 121 | D | AL | 2 | 15 | Coining | None | Inv. range |

TABLE 7-continued

| Ex. no. | Steel type | Plating type | H am't (%) | Dew point (° C.) | Work method | Cracks | Class |
|---|---|---|---|---|---|---|---|
| 122 | D | AL | 2 | 25 | Coining | None | Inv. range |
| 123 | D | AL | 2 | 40 | Coining | Yes | Comp. Ex. |
| 124 | D | GI | 2 | 15 | Coining | None | Inv. range |
| 125 | D | GA | 2 | 15 | Coining | None | Inv. range |
| 126 | E | CR | 2 | −40 | Coining | None | Inv. range |
| 127 | E | CR | 2 | −20 | Coining | None | Inv. range |
| 128 | E | CR | 2 | 0 | Coining | None | Inv. range |
| 129 | E | CR | 2 | 5 | Coining | None | Inv. range |
| 130 | E | CR | 2 | 15 | Coining | None | Inv. range |
| 131 | E | CR | 2 | 25 | Coining | None | Inv. range |
| 132 | E | CR | 2 | 40 | Coining | Yes | Comp. Ex. |
| 133 | E | AL | 2 | −40 | Coining | None | Inv. range |
| 134 | E | AL | 2 | −20 | Coining | None | Inv. range |
| 135 | E | AL | 2 | 0 | Coining | None | Inv. range |
| 136 | E | AL | 2 | 5 | Coining | None | Inv. range |
| 137 | E | AL | 2 | 15 | Coining | None | Inv. range |
| 138 | E | AL | 2 | 25 | Coining | None | Inv. range |
| 139 | E | AL | 2 | 40 | Coining | Yes | Comp. Ex. |
| 140 | E | GI | 2 | 15 | Coining | None | Inv. range |
| 141 | E | GA | 2 | 15 | Coining | None | Inv. range |
| 142 | C | CR | 0.5 | −40 | Coining | None | Inv. range |
| 143 | C | CR | 0.5 | 0 | Coining | None | Inv. range |
| 144 | C | CR | 0.5 | 15 | Coining | None | Inv. range |
| 145 | C | CR | 0.5 | 40 | Coining | Yes | Comp. Ex. |
| 146 | D | CR | 0.5 | −40 | Coining | None | Inv. range |
| 147 | D | CR | 0.5 | 0 | Coining | None | Inv. range |
| 148 | D | CR | 0.5 | 15 | Coining | None | Inv. range |
| 149 | D | CR | 0.5 | 40 | Coining | Yes | Comp. Ex. |
| 150 | E | CR | 0.5 | −40 | Coining | None | Inv. range |
| 151 | E | CR | 0.5 | 0 | Coining | None | Inv. range |
| 152 | E | CR | 0.5 | 15 | Coining | None | Inv. range |
| 153 | E | CR | 0.5 | 40 | Coining | Yes | Comp. Ex. |
| 154 | C | CR | 0.1 | −40 | Coining | None | Inv. range |
| 155 | C | CR | 0.1 | −20 | Coining | None | Inv. range |
| 156 | C | CR | 0.1 | 0 | Coining | None | Inv. range |
| 157 | C | CR | 0.1 | 5 | Coining | None | Inv. range |
| 158 | C | CR | 0.1 | 15 | Coining | None | Inv. range |
| 159 | C | CR | 0.1 | 25 | Coining | None | Inv. range |
| 160 | C | CR | 0.1 | 40 | Coining | Yes | Comp. Ex. |
| 161 | C | AL | 0.1 | −40 | Coining | None | Inv. range |
| 162 | C | AL | 0.1 | −20 | Coining | None | Inv. range |
| 163 | C | AL | 0.1 | 0 | Coining | None | Inv. range |
| 164 | C | AL | 0.1 | 5 | Coining | None | Inv. range |
| 165 | C | AL | 0.1 | 15 | Coining | None | Inv. range |
| 166 | C | AL | 0.1 | 25 | Coining | None | Inv. range |
| 167 | C | AL | 0.1 | 40 | Coining | Yes | Comp. Ex. |
| 168 | C | GI | 0.1 | 15 | Coining | None | Inv. range |
| 169 | C | GA | 0.1 | 15 | Coining | None | Inv. range |
| 170 | D | CR | 0.1 | −40 | Coining | None | Inv. range |
| 171 | D | CR | 0.1 | −20 | Coining | None | Inv. range |
| 172 | D | CR | 0.1 | 0 | Coining | None | Inv. range |
| 173 | D | CR | 0.1 | 5 | Coining | None | Inv. range |
| 174 | D | CR | 0.1 | 15 | Coining | None | Inv. range |
| 175 | D | CR | 0.1 | 25 | Coining | None | Inv. range |
| 176 | D | CR | 0.1 | 40 | Coining | Yes | Comp. Ex. |
| 177 | D | AL | 0.1 | −40 | Coining | None | Inv. range |
| 178 | D | AL | 0.1 | −20 | Coining | None | Inv. range |
| 179 | D | AL | 0.1 | 0 | Coining | None | Inv. range |
| 180 | D | AL | 0.1 | 5 | Coining | None | Inv. range |
| 181 | D | AL | 0.1 | 15 | Coining | None | Inv. range |
| 182 | D | AL | 0.1 | 25 | Coining | None | Inv. range |
| 183 | D | AL | 0.1 | 40 | Coining | Yes | Comp. Ex. |
| 184 | D | GI | 0.1 | 15 | Coining | None | Inv. range |
| 185 | D | GA | 0.1 | 15 | Coining | None | Inv. range |
| 186 | E | CR | 0.1 | −40 | Coining | None | Inv. range |
| 187 | E | CR | 0.1 | −20 | Coining | None | Inv. range |
| 188 | E | CR | 0.1 | 0 | Coining | None | Inv. range |
| 189 | E | CR | 0.1 | 5 | Coining | None | Inv. range |
| 190 | E | CR | 0.1 | 15 | Coining | None | Inv. range |
| 191 | E | CR | 0.1 | 25 | Coining | None | Inv. range |
| 192 | E | CR | 0.1 | 40 | Coining | Yes | Comp. Ex. |
| 193 | E | AL | 0.1 | −40 | Coining | None | Inv. range |

TABLE 7-continued

| Ex. no. | Steel type | Plating type | H am't (%) | Dew point (° C.) | Work method | Cracks | Class |
|---|---|---|---|---|---|---|---|
| 194 | E | AL | 0.1 | −20 | Coining | None | Inv. range |
| 195 | E | AL | 0.1 | 0 | Coining | None | Inv. range |
| 196 | E | AL | 0.1 | 5 | Coining | None | Inv. range |
| 197 | E | AL | 0.1 | 15 | Coining | None | Inv. range |
| 198 | E | AL | 0.1 | 25 | Coining | None | Inv. range |
| 199 | E | AL | 0.1 | 40 | Coining | Yes | Comp. Ex. |
| 200 | E | GI | 0.1 | 15 | Coining | None | Inv. range |
| | | | | (Part 3) | | | |
| 201 | E | GA | 0.1 | 15 | Coining | None | Inv. range |
| 202 | C | CR | 0.05 | −20 | Coining | None | Inv. range |
| 203 | C | CR | 0.05 | −40 | Coining | None | Inv. range |
| 204 | C | CR | 0.05 | −20 | Coining | None | Inv. range |
| 205 | C | CR | 0.05 | 0 | Coining | None | Inv. range |
| 206 | C | CR | 0.05 | 5 | Coining | None | Inv. range |
| 207 | C | CR | 0.05 | 15 | Coining | None | Inv. range |
| 208 | C | CR | 0.05 | 25 | Coining | None | Inv. range |
| 209 | C | CR | 0.05 | 40 | Coining | Yes | Comp. Ex. |
| 210 | D | CR | 0.05 | −20 | Coining | None | Inv. range |
| 211 | D | CR | 0.05 | −40 | Coining | None | Inv. range |
| 212 | D | CR | 0.05 | −20 | Coining | None | Inv. range |
| 213 | D | CR | 0.05 | 0 | Coining | None | Inv. range |
| 214 | D | CR | 0.05 | 5 | Coining | None | Inv. range |
| 215 | D | CR | 0.05 | 15 | Coining | None | Inv. range |
| 216 | D | CR | 0.05 | 25 | Coining | None | Inv. range |
| 217 | D | CR | 0.05 | 40 | Coining | Yes | Comp. Ex. |
| 218 | E | CR | 0.05 | −20 | Coining | None | Inv. range |
| 219 | E | CR | 0.05 | −40 | Coining | None | Inv. range |
| 220 | E | CR | 0.05 | −20 | Coining | None | Inv. range |
| 221 | E | CR | 0.05 | 0 | Coining | None | Inv. range |
| 222 | E | CR | 0.05 | 5 | Coining | None | Inv. range |
| 223 | E | CR | 0.05 | 15 | Coining | None | Inv. range |
| 224 | E | CR | 0.05 | 25 | Coining | None | Inv. range |
| 225 | E | CR | 0.05 | 40 | Coining | Yes | Comp. Ex. |
| 226 | C | CR | 0.01 | −40 | Coining | None | Inv. range |
| 227 | C | CR | 0.01 | 0 | Coining | None | Inv. range |
| 228 | C | CR | 0.01 | 15 | Coining | None | Inv. range |
| 229 | C | CR | 0.01 | 40 | Coining | Yes | Comp. Ex. |
| 230 | D | CR | 0.01 | −40 | Coining | None | Inv. range |
| 231 | D | CR | 0.01 | 0 | Coining | None | Inv. range |
| 232 | D | CR | 0.01 | 15 | Coining | None | Inv. range |
| 233 | D | CR | 0.01 | 40 | Coining | Yes | Comp. Ex. |
| 234 | E | CR | 0.01 | −40 | Coining | None | Inv. range |
| 235 | E | CR | 0.01 | 0 | Coining | None | Inv. range |
| 236 | E | CR | 0.01 | 15 | Coining | None | Inv. range |
| 237 | E | CR | 0.01 | 40 | Coining | Yes | Comp. Ex. |
| 238 | C | CR | 0.005 | −40 | Coining | None | Inv. range |
| 239 | C | CR | 0.005 | 0 | Coining | None | Inv. range |
| 240 | C | CR | 0.005 | 15 | Coining | None | Inv. range |
| 241 | C | CR | 0.005 | 40 | Coining | Yes | Comp. Ex. |
| 242 | D | CR | 0.005 | −40 | Coining | None | Inv. range |
| 243 | D | CR | 0.005 | 0 | Coining | None | Inv. range |
| 244 | D | CR | 0.005 | 15 | Coining | None | Inv. range |
| 245 | D | CR | 0.005 | 40 | Coining | Yes | Comp. Ex. |
| 246 | E | CR | 0.005 | −40 | Coining | None | Inv. range |
| 247 | E | CR | 0.005 | 0 | Coining | None | Inv. range |
| 248 | E | CR | 0.005 | 15 | Coining | None | Inv. range |
| 249 | E | CR | 0.005 | 40 | Coining | Yes | Comp. Ex. |
| 250 | D | CR | 80 | −40 | Coining | Yes | Comp. Ex. |
| 251 | D | CR | 80 | −20 | No Work | Yes | Comp. Ex. |
| 252 | D | CR | 80 | 0 | No Work | Yes | Comp. Ex. |
| 253 | D | CR | 80 | 5 | No Work | Yes | Comp. Ex. |
| 254 | D | CR | 80 | 15 | No Work | Yes | Comp. Ex. |
| 255 | D | CR | 80 | 25 | No Work | Yes | Comp. Ex. |
| 256 | D | CR | 80 | 40 | No Work | Yes | Comp. Ex. |
| 257 | D | AL | 80 | −40 | No Work | Yes | Comp. Ex. |
| 258 | D | AL | 80 | −20 | No Work | Yes | Comp. Ex. |
| 259 | D | AL | 80 | 0 | No Work | Yes | Comp. Ex. |
| 260 | D | AL | 80 | 5 | No Work | Yes | Comp. Ex. |
| 261 | D | AL | 80 | 15 | No Work | Yes | Comp. Ex. |
| 262 | D | AL | 80 | 25 | No Work | Yes | Comp. Ex. |
| 263 | D | AL | 80 | 40 | No Work | Yes | Comp. Ex. |
| 264 | D | CR | 8 | −40 | No Work | Yes | Comp. Ex. |
| 265 | D | CR | 8 | −20 | No Work | Yes | Comp. Ex. |
| 266 | D | CR | 8 | 0 | No Work | Yes | Comp. Ex. |

TABLE 7-continued

| Ex. no. | Steel type | Plating type | H am't (%) | Dew point (° C.) | Work method | Cracks | Class |
|---|---|---|---|---|---|---|---|
| 267 | D | CR | 8 | 5 | No Work | Yes | Comp. Ex. |
| 268 | D | CR | 8 | 15 | No Work | Yes | Comp. Ex. |
| 269 | D | CR | 8 | 25 | No Work | Yes | Comp. Ex. |
| 270 | D | CR | 8 | 40 | No Work | Yes | Comp. Ex. |
| 271 | D | AL | 8 | −40 | No Work | Yes | Comp. Ex. |
| 272 | D | AL | 8 | −20 | No Work | Yes | Comp. Ex. |
| 273 | D | AL | 8 | 0 | No Work | Yes | Comp. Ex. |
| 274 | D | AL | 8 | 5 | No Work | Yes | Comp. Ex. |
| 275 | D | AL | 8 | 15 | No Work | Yes | Comp. Ex. |
| 276 | D | AL | 8 | 25 | No Work | Yes | Comp. Ex. |
| 277 | D | AL | 8 | 40 | No Work | Yes | Comp. Ex. |

Example 4

Steel slabs having the chemical compositions shown in Table 1 were cast. These slabs were heated to 1050 to 1350° C. and hot rolled at a finishing temperature of 800 to 900° C. and coiling temperature of 450 to 680° C. to obtain hot rolled steel sheets having a thickness of 4 mm. Next, these sheets were pickled and cold rolled to obtain cold rolled steel sheets having a thickness of 1.6 mm. Next, the sheets were heated to above the Ac3 point, e.g., to 950° C. which is in the austenite region, then hot shaped. The atmosphere of the heating furnace was varied with respect to the amount of hydrogen present and the dew point. The conditions used are shown in Table 8. The tensile strengths were observed to be 1525 MPa and 1785 MPa.

To evaluate the punched parts, 100 mm×100 mm size pieces were cut from these shaped parts to obtain test pieces. The centers were punched out in the shapes shown in FIGS. 3 and 4 using a punch having a parallel portion of 10 mm and 20 mm, and a tip of 5 to 13 mm with a clearance of 4.3 to 25%. To evaluate these test pieces for resistance to cracking, the number of cracks at the secondarily worked ends were measured and the residual stress at the punched ends and cut ends was measured using X-rays. The number of cracks was measured over the entire circumference of the punch pieced holes. For the cut ends, the number of cracks observed on single sides were measured. The working conditions and results are also shown in Table 8.

The result of the above study suggest that under both punch piercing and cutting conditions, cracks frequently occurred at samples that were not processed in accordance with exemplary embodiments of the present invention, while no cracks occurred in samples that were processed in accordance with exemplary embodiments of the present invention.

TABLE 8

| Production condition no, | Steel type no. | Thickness | H am't (%) | Dew point (° C.) | Tensile strength (MPa) | Working method | Punch tip diameter or length (mm) | Punch shape: Punch parallel part diameter or length (mm) | Punch shape: Single sided step difference D (mm) | Punch shape: Step difference height H (mm) | Punch shape: D/H | Punch shape: Punch parallel part end angle (degree) |
|---|---|---|---|---|---|---|---|---|---|---|---|---|
| 1 | A | 1.6 | 5 | 20 | 1525 | Piercing | 9.8 | 10.0 | 0.1 | 5.0 | 0.02 | 178.9 |
| 2 | | | 1 | 5 | | Piercing | 9.8 | 10.0 | 0.1 | 5.0 | 0.02 | 178.9 |
| 3 | | | 30 | 10 | | Piercing | 9.8 | 10.0 | 0.1 | 5.0 | 0.02 | 178.9 |
| 4 | | | 5 | −15 | | Piercing | 9.8 | 10.0 | 0.1 | 5.0 | 0.02 | 178.9 |
| 5 | | | 5 | 50 | | Cutting | 9.8 | 10.0 | 0.1 | 5.0 | 0.02 | 178.9 |
| 6 | | | 1 | −10 | | Piercing | 9.8 | 10.0 | 0.1 | 3.0 | 0.03 | 178.1 |
| 7 | | | 3 | 0 | | Piercing | 9.8 | 10.0 | 0.1 | 10.0 | 0.01 | 179.5 |
| 8 | | | 5 | 20 | | Piercing | 9.6 | 10.0 | 0.2 | 5.0 | 0.04 | 177.8 |
| 9 | | | 0.5 | 5 | | Cutting | 9.6 | 10.0 | 0.2 | 1.0 | 0.20 | 168.7 |
| 10 | | | 2 | 0 | | Piercing | 8.0 | 10.0 | 1.0 | 15.0 | 0.07 | 176.2 |
| 11 | | | 4 | −10 | | Piercing | 13.0 | 20.0 | 3.5 | 3.0 | 1.17 | 130.6 |
| 12 | | | 1 | 15 | | Piercing | 8.0 | 10.0 | 1.0 | 10.0 | 0.10 | 174.3 |
| 13 | | | 8 | 2 | | Piercing | 9.6 | 10.0 | 0.2 | 2.0 | 0.10 | 90.0 |
| 14 | | | 6 | 5 | | Piercing | 10.0 | 10.0 | 0.0 | 0.0 | ∞ | 180.0 |
| 1 | B | 1.6 | 5 | 20 | 1785 | Piercing | 9.8 | 10.0 | 0.1 | 5.0 | 0.02 | 178.9 |
| 2 | | | 1 | 5 | | Piercing | 9.8 | 10.0 | 0.1 | 5.0 | 0.02 | 178.9 |
| 3 | | | 30 | 10 | | Cutting | 9.8 | 10.0 | 0.1 | 5.0 | 0.02 | 178.9 |
| 4 | | | 5 | −15 | | Piercing | 9.8 | 10.0 | 0.1 | 5.0 | 0.02 | 178.9 |
| 5 | | | 5 | 50 | | Piercing | 9.8 | 10.0 | 0.1 | 5.0 | 0.02 | 178.9 |
| 6 | | | 1 | −10 | | Piercing | 9.8 | 10.0 | 0.1 | 3.0 | 0.03 | 178.1 |
| 7 | | | 3 | 0 | | Cutting | 9.8 | 10.0 | 0.1 | 10.0 | 0.01 | 179.5 |
| 8 | | | 5 | 20 | | Piercing | 9.6 | 10.0 | 0.2 | 5.0 | 0.04 | 177.8 |
| 9 | | | 0.5 | 5 | | Piercing | 9.6 | 10.0 | 0.2 | 1.0 | 0.20 | 168.7 |
| 10 | | | 2 | 0 | | Piercing | 8.0 | 10.0 | 1.0 | 15.0 | 0.07 | 176.2 |
| 11 | | | 4 | −10 | | Piercing | 9.6 | 10.0 | 0.2 | 2.0 | 0.10 | 90.0 |
| 12 | | | 1 | 15 | | Piercing | 13.0 | 20.0 | 3.5 | 3.0 | 1.17 | 130.6 |
| 13 | | | 8 | 2 | | Piercing | 8.0 | 10.0 | 1.0 | 10.0 | 0.10 | 174.3 |
| 14 | | | 6 | 5 | | Piercing | 10.0 | 10.0 | 0.0 | 0.0 | ∞ | 180.0 |

| Production condition no, | Punch shape Punch tip parallel part length HP (mm) | Die diameter or clearance (mm) | Clearance (%) | Punch end tensile residual stress (MPa) | No. of cracks after standing 24 h | |
|---|---|---|---|---|---|---|
| 1 | 0 | 10.1 | 6.2 | −48 | 0 | Inv. steel |
| 2 | 0 | 10.2 | 12.5 | 365 | 0 | Inv. steel |
| 3 | 0 | 10.2 | 12.5 | 348 | 4 | Comp. steel |
| 4 | 5 | 10.4 | 25.0 | 432 | 0 | Inv. steel |
| 5 | 0 | 10.4 | 25.0 | 441 | 3 | Comp. steel |
| 6 | 0 | 10.2 | 12.5 | 324 | 0 | Inv. steel |
| 7 | 10 | 10.2 | 12.5 | 278 | 0 | Inv. steel |
| 8 | 0 | 10.2 | 12.5 | 164 | 0 | Inv. steel |
| 9 | 0 | 10.2 | 12.5 | 157 | 0 | Inv. steel |
| 10 | 25 | 10.1 | 6.2 | 27 | 0 | Inv. steel |
| 11 | 0 | 20.2 | 12.5 | 680 | 4 | Comp. steel |
| 12 | 0 | 10.1 | 6.2 | −15 | 0 | Inv. steel |
| 13 | 0 | 10.2 | 12.5 | 780 | 3 | Comp. steel |
| 14 | 0 | 10.2 | 12.5 | 989 | 5 | Comp. steel |
| 1 | 0 | 10.1 | 6.2 | −87 | 0 | Inv. steel |
| 2 | 0 | 10.2 | 12.5 | 375 | 0 | Inv. steel |
| 3 | 0 | 10.2 | 12.5 | 395 | 3 | Comp. steel |
| 4 | 0 | 10.4 | 25.0 | 452 | 0 | Inv. steel |
| 5 | 0 | 10.4 | 25.0 | 464 | 2 | Comp. steel |
| 6 | 10 | 10.2 | 12.5 | 365 | 0 | Inv. steel |
| 7 | 5 | 10.2 | 12.5 | 324 | 0 | Inv. steel |
| 8 | 0 | 10.2 | 12.5 | 218 | 0 | Inv. steel |
| 9 | 0 | 10.2 | 12.5 | 158 | 0 | Inv. steel |
| 10 | 15 | 10.1 | 6.2 | 54 | 0 | Inv. steel |
| 11 | 0 | 10.2 | 12.5 | 985 | 4 | Comp. steel |
| 12 | 0 | 20.2 | 12.5 | 785 | 2 | Comp. steel |
| 13 | 25 | 10.1 | 6.2 | −5 | 0 | Inv. steel |
| 14 | 0 | 10.2 | 12.5 | 1245 | 10 | Comp. steel |

Example 5

Aluminum plated steel sheets having the compositions shown in Table 9 (and a thickness of 1.6 mm) were held at 950° C. for 1 minute, then hardened at 800° C. by a sheet mold to prepare test samples. The test samples were observed to have strengths of TS=1540 MPa, YP=1120 MPa, and T-E1=6%. Holes were made in the steel sheets using molds of the types shown in FIGS. 20A-20D using the conditions listed in Table 10. The punching clearance was adjusted to between 5% and 40%. The resistance to hydrogen embrittlement was evaluated by examining the entire circumference of the holes one week after working to evaluate the presence of cracks. The observation was performed using a loupe or an electron microscope. The results of these observations are shown together in Table 10.

Level 1 can refer to a reference stress level for the residual stress resulting from performing a conventional punching test using an A type mold in accordance with exemplary embodiments of the present invention. Cracks occurred due to hydrogen embrittlement.

In a test using a B type mold, level 2 included a large shoulder angle θp of the bending blade, a small radius of curvature Rp of the bending blade shoulder, a small effect of reduction of the residual stress, and cracks due to hydrogen embrittlement. Level 3 included a large clearance, a small effect of reduction of the residual stress, and cracks due to hydrogen embrittlement. Level 4 included a small bending blade shoulder angle θp and a small radius of curvature Rp of the bending blade shoulder. For this reason, the widening value obtained using this punching procedure was not improved over conventional techniques, so cracks occurred due to hydrogen embrittlement.

In a test using a C type mold, level 11 had a punch characterized by an ordinary punch, a shoulder angle θp of the projection of the die, and a radius of curvature Rd of the shoulder selected to satisfy predetermined conditions, such that there was a small reduction of residual stress and cracks occurred due to hydrogen embrittlement. Level 12 had a large clearance and a small reduction of the residual stress, so cracks again occurred due to hydrogen embrittlement.

In a test using a D type mold, level 18 did not meet the predetermined conditions in the angle θp of the shoulder of the projection of the punch, the radius of curvature Rp of the shoulder, the angle θd of the shoulder of the projection of the die, and the radius of curvature Rd of the shoulder. No effect of reduction of the residual stress was observed and no cracks occurred due to hydrogen embrittlement. Further, level 15 had a large clearance and a small reduction of residual stress, so cracks occurred due to hydrogen embrittlement.

Levels 8, 9, 14, 15, 21, 22 used heating atmospheres which were outside of the limited range described herein, so cracks occurred due to hydrogen embrittlement.

The other levels had conditions in accordance with exemplary embodiments of the present invention. The residual stresses at the punched cross-sections were reduced and no cracks occurred due to hydrogen embrittlement.

TABLE 9

| C | Si | Mn | P | S | Cr | Ti | Al | B | (wt %) N |
|---|---|---|---|---|---|---|---|---|---|
| 0.22 | 0.2 | 1.25 | 0.012 | 0.0025 | 0.2 | 0.018 | 0.045 | 0.0022 | 0.0035 |

TABLE 10

| | Heating atmosphere | | Test conditions | | | Punch shape | | | | |
|---|---|---|---|---|---|---|---|---|---|---|
| Level | H am't (%) | Dew point (° C.) | Mold type | Punch speed (m/sec) | Wrinkle suppression Load (tonf) | Punch diameter Ap (Initial hole diameter) (mm) | Bending blade height Hp (mm) | Bending blade/ cutting blade clearance Dp (mm) | Bending blade shoulder angle θp (deg) | Bending blade shoulder radius of curvature Rp (mm) |
| 1 | 3 | 15 | A | 1.0 | 0.5 | 20 | — | — | — | — |
| 2 | 3 | 15 | B | 1.0 | 0.5 | 20 | 3 | 1.0 | *175* | *0* |
| 3 | 3 | 15 | B | 1.0 | 0.5 | 20 | 3 | 1.0 | 135 | 0 |
| 4 | 3 | 15 | B | 1.0 | 0.5 | 20 | 3 | 10 | *95* | *0* |
| 5 | 3 | 15 | B | 1.0 | 0.5 | 20 | 3 | 1.0 | 90 | 0.5 |
| 6 | 3 | 15 | B | 1.0 | 0.5 | 20 | 0.3 | 1.0 | 135 | 0 |
| 7 | 3 | 15 | B | 1.0 | 0.5 | 20 | 0.5 | 1.0 | 135 | 0.5 |
| 8 | *15* | 15 | B | 1.0 | 0.5 | 20 | 0.5 | 1.0 | 135 | 0.5 |
| 9 | 3 | *35* | B | 1.0 | 0.5 | 20 | 0.5 | 1.0 | 135 | 0.5 |
| 10 | 3 | 15 | B | 1.0 | 0.5 | 20 | 1.5 | 1.0 | 110 | 0.2 |
| 11 | 3 | 15 | C | 1.0 | 0.5 | 20 | — | — | — | — |
| 12 | 3 | 15 | C | 1.0 | 0.5 | 20 | — | — | — | — |
| 13 | 3 | 15 | C | 1.0 | 0.5 | 20 | — | — | — | — |
| 14 | *15* | 15 | C | 1.0 | 0.5 | 20 | — | — | — | — |
| 15 | 3 | *35* | C | 1.0 | 0.5 | 20 | — | — | — | — |
| 16 | 3 | 15 | C | 1.0 | 0.5 | 20 | — | — | — | — |
| 17 | 3 | 15 | C | 1.0 | 0.5 | 20 | — | — | — | — |
| 18 | 3 | 15 | D | 1.0 | 0.5 | 20 | 1.5 | 1.0 | *90* | *0* |
| 19 | 3 | 15 | D | 1.0 | 0.5 | 20 | 0.3 | 0.1 | 90 | 0.2 |
| 20 | 3 | 15 | D | 1.0 | 0.5 | 20 | 0.3 | 0.1 | 90 | 0.5 |
| 21 | *15* | 15 | D | 1.0 | 0.5 | 20 | 0.3 | 0.1 | 90 | 0.5 |
| 22 | 3 | *35* | D | 1.0 | 0.5 | 20 | 0.3 | 0.1 | 90 | 0.5 |
| 23 | 3 | 15 | D | 1.0 | 0.5 | 20 | 1.5 | 0.1 | 135 | 0 |
| 24 | 3 | 15 | D | 1.0 | 0.5 | 20 | 0.3 | 0.1 | 135 | 0.2 |

TABLE 10-continued

| Level | Die Shape: Die hole inside diameter Ad (mm) | Bending blade height Hd (mm) | Bending blade/ cutting blade clearance Dd (mm) | Bending blade shoulder angle θd (deg) | Bending blade shoulder radius of curvature Rd (mm) | Clearance (%) | Cracks observed | Remarks |
|---|---|---|---|---|---|---|---|---|
| 1 | 20.5 | — | — | — | — | 15.6 | Yes | Prior art |
| 2 | 20.5 | — | — | — | — | 15.6 | Yes | Comp. Ex. |
| 3 | 21 | — | — | — | — | *31.3* | Yes | Comp. Ex. |
| 4 | 20.8 | — | — | — | — | 25.0 | Yes | Comp. Ex. |
| 5 | 20.2 | — | — | — | — | 62 | None | Inv. ex. |
| 6 | 20.2 | — | — | — | — | 62 | None | Inv. ex. |
| 7 | 20.2 | — | — | — | — | 62 | None | Inv. ex. |
| 8 | 20.2 | — | — | — | — | 62 | Yes | Comp. Ex. |
| 9 | 20.2 | — | — | — | — | 62 | Yes | Comp. Ex. |
| 10 | 20.5 | — | — | — | — | 15.6 | None | Inv. ex. |
| 11 | 20.5 | 1.0 | 1.0 | *90* | *0* | 15.6 | Yes | Comp. Ex. |
| 12 | 21.2 | 0.3 | 0.5 | 135 | 0.2 | *37.5* | Yes | Comp. Ex. |
| 13 | 20.2 | 0.3 | 0.1 | 93 | 0.5 | 62 | None | Inv. ex. |
| 14 | 20.2 | 0.3 | 0.1 | 90 | 0.5 | 62 | Yes | Comp. Ex. |
| 15 | 20.2 | 0.3 | 0.1 | 90 | 0.5 | 62 | Yes | Comp. Ex. |
| 16 | 20.2 | 0.3 | 0.1 | 135 | 0 | 62 | None | Inv. ex. |
| 17 | 20.5 | 0.7 | 0.1 | 135 | 0.5 | 15.6 | None | Inv. ex. |
| 18 | 20.4 | 1.0 | 1.0 | *90* | *0* | 12.5 | Yes | Comp. Ex. |
| 19 | 21 | 0.7 | 1.0 | 90 | 0.2 | *31.3* | Yes | Comp. Ex. |
| 20 | 20.4 | 1.0 | 0.1 | 90 | 0.5 | 12.5 | None | Inv. ex. |
| 21 | 20.4 | 1.0 | 0.1 | 90 | 0.5 | 12.5 | Yes | Comp. Ex. |
| 22 | 20.4 | 1.0 | 0.1 | 90 | 0.5 | 12.5 | Yes | Comp. Ex. |
| 23 | 20.4 | 1.5 | 0.1 | 135 | 0 | 12.5 | None | Inv. ex. |
| 24 | 20.4 | 3.0 | 0.1 | 135 | 0.2 | 12.5 | None | Inv. ex. |

Example 6

Steel slabs having the chemical compositions shown in Table 4 were cast. These slabs were heated to 1050 to 1350° C. and hot rolled at a finishing temperature of 800 to 900° C. and a coiling temperature of 450 to 680° C. to obtain hot rolled steel sheets having a thickness of 4 mm. The steel sheets were then pickled and cold rolled to obtain cold rolled steel sheets having a thickness of 1.6 mm. Further, portions of these cold rolled steel sheets were treated by hot dip aluminum coating, hot dip aluminum-zinc coating, alloying hot dip galvanization, and/or hot dip galvanization. Table 5 shows the legends of the plating types performed. After plating, these cold rolled steel sheets and surface treated steel sheets were heated in a furnace to above the Ac3 point, that is, to 950° C. in the austenite region, and then were hot shaped. The atmosphere of the heating furnace was varied with respect to the amount of hydrogen and the dew point. The conditions are shown in Table 11.

Figure 21:
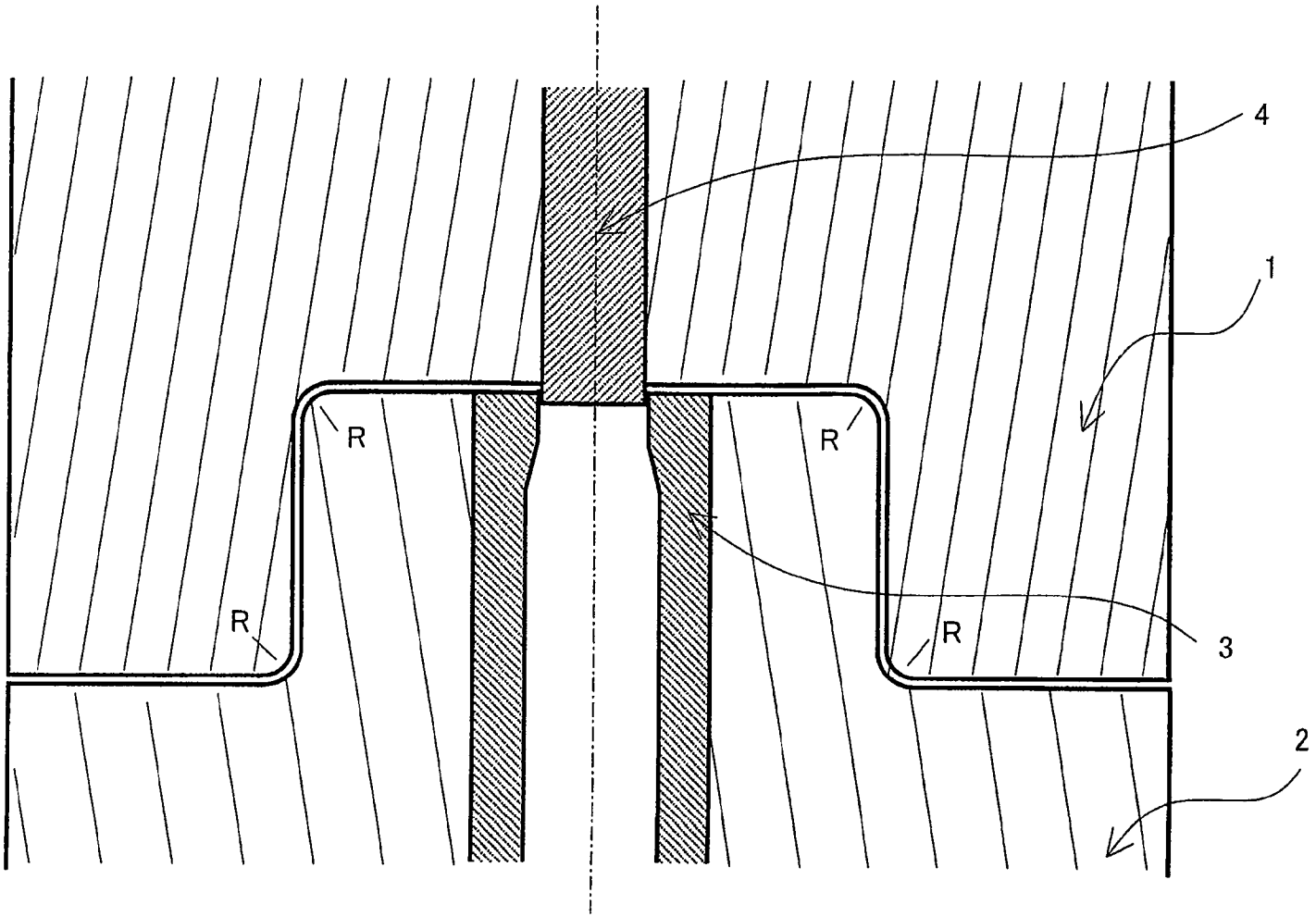
FIG. 21 is a schematic diagram of the cross-sectional shape of a tool described in Example 5.
Figure 22:
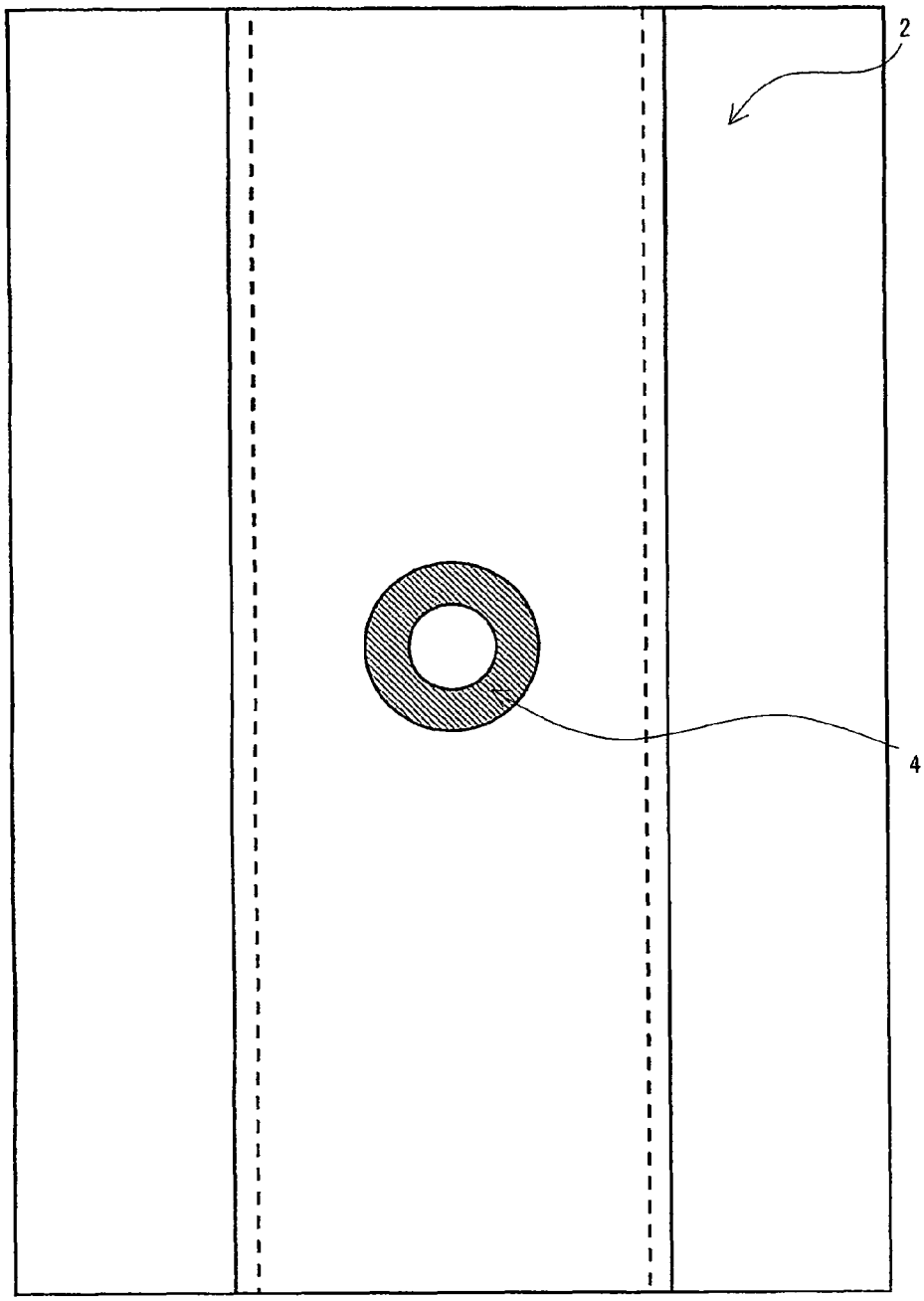
FIG. 22 is a schematic diagram of an exemplary shaping punch described in Example 5.
Figure 23:
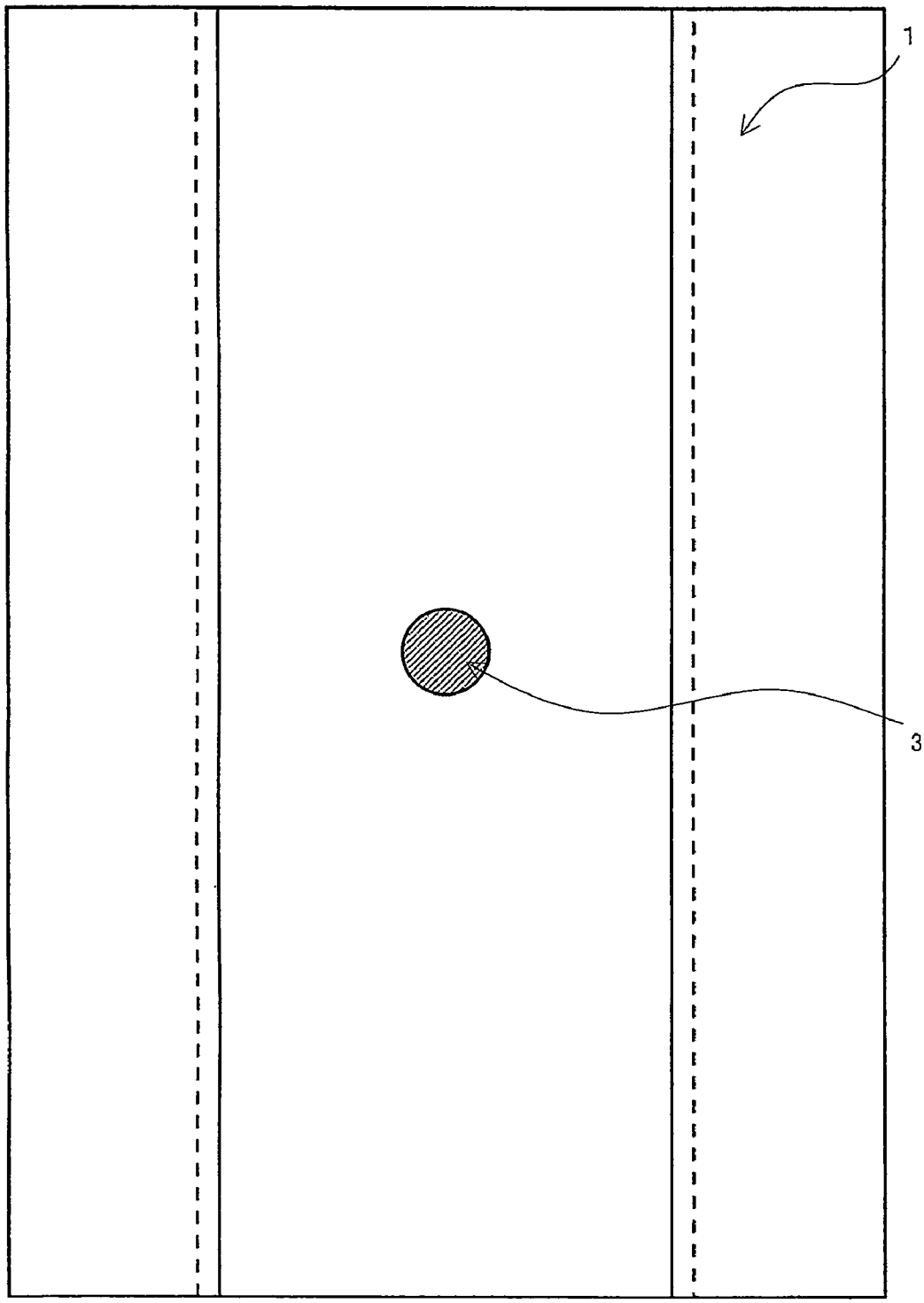
FIG. 23 is a schematic diagram of an exemplary shaping die described in Example 5.
Figure 24:
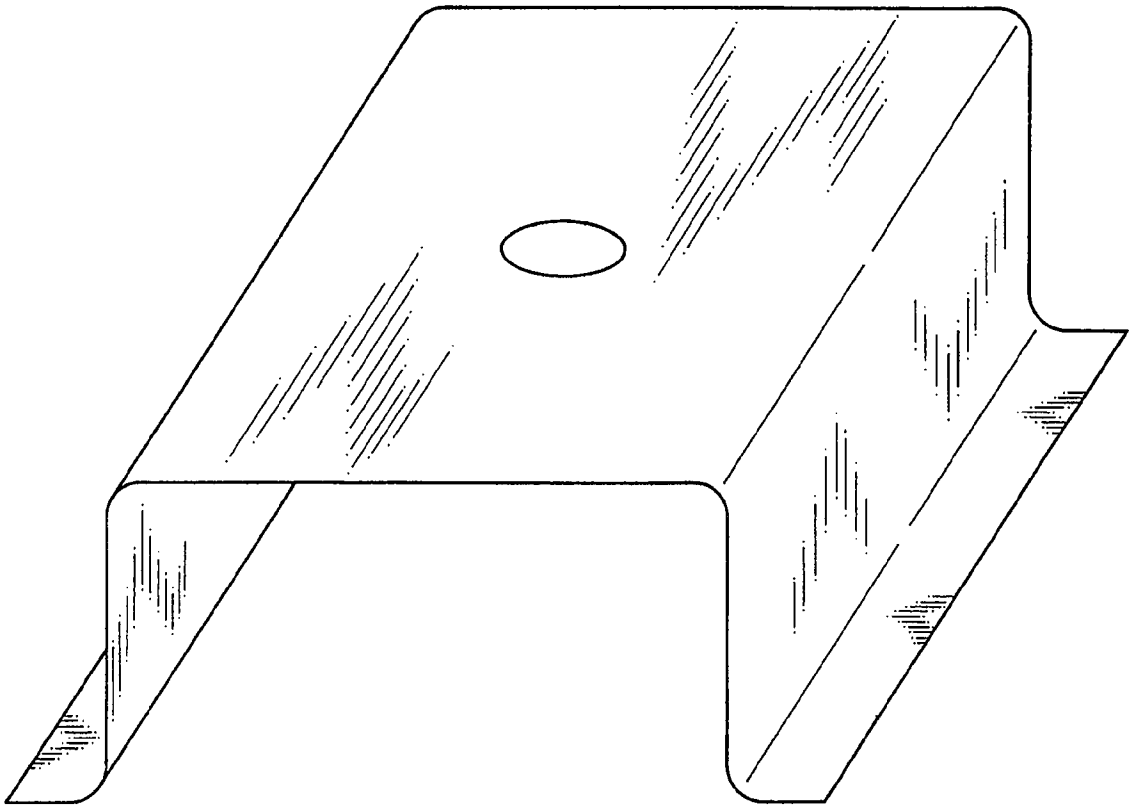
FIG. 24 is a schematic diagram of an exemplary shaped part described in Example 5.

An exemplary cross-sectional shape of the mold is shown in FIG. 21. The legend in FIG. 21 is shown here (1: press-forming die, 2: press-forming punch, 3: piercing punch, 4: button die). The shape of the punch as seen from above is shown in FIG. 22. The legend in FIG. 22 is shown here (2: press-forming punch, 4: button die). The shape of the die as seen from the bottom is shown in FIG. 23. The legend in FIG. 23 is shown here (1: press-forming die, 3: piercing punch). The mold generally followed the shape of the punch. The shape of the die was determined by providing a clearance having a thickness of 1.6 mm. Piercing was performed using a punch having a diameter of 20 mm and a die having a diameter of 20.5 mm. The blank size, in mm, was 1.6 (thickness)×300×500. The shaping conditions include a punch speed of 10 mm/s, a pressing force of 200 tons, and a holding time at bottom dead center of 5 seconds. A schematic view of an exemplary shaped part is shown in FIG. 24. From tensile test pieces cut out from the shaped part, the tensile strength of the shaped part was observed to be 1470 MPa or more.

The effect of timing of the start of piercing was studied by changing the length of the piercing punch. Table 11 shows the depth of shaping where the piercing is started by the distance from bottom dead center as the shearing timing. To hold the shape after working, this value is within about 10 mm, or preferably within about 5 mm.

The resistance to hydrogen embrittlement was evaluated by observing the entire circumference of the pieced holes one week after shaping to determine the presence of cracks. The observation was performed using a loupe or an electron microscope. The results of the evaluation are shown together in Table 11. Further, the precision of the hole shape was measured using a caliper and the deviation from a reference shape was found. A difference of less than 1.0 mm was considered good. The results of these evaluations are shown together in Table 11. Further, the legend is shown in Table 12.

Experiment Nos. 1 to 249 show the results of consideration of the effects of the steel type, plating type, concentration of hydrogen in the atmosphere, and dew point. No cracks occurred in samples. Experiment Nos. 250 to 277 show results which include consideration of the timing of start of the shearing. No cracks occurred in samples processed in accordance with exemplary embodiments of the present invention, and the shape precision was also good for these samples.

TABLE 11

| Ex. no. | Steel type | Plating type | H am't (%) | Dew point (° C.) | Shearing timing (mm) | Cracks | Shape precision | Class |
|---|---|---|---|---|---|---|---|---|
| | | | | (Part 1) | | | | |
| 1 | C | CR | 80 | −40 | 4 | Yes | VG | Comp. Ex. |
| 2 | C | CR | 80 | −20 | 4 | Yes | VG | Comp. Ex. |
| 3 | C | CR | 80 | 0 | 4 | Yes | VG | Comp. Ex. |
| 4 | C | CR | 80 | 5 | 4 | Yes | VG | Comp. Ex. |
| 5 | C | CR | 80 | 15 | 4 | Yes | VG | Comp. Ex. |
| 6 | C | CR | 80 | 25 | 4 | Yes | VG | Comp. Ex. |
| 7 | C | CR | 80 | 40 | 4 | Yes | VG | Comp. Ex. |
| 8 | C | AL | 80 | −40 | 4 | Yes | VG | Comp. Ex. |
| 9 | C | AL | 80 | −20 | 4 | Yes | VG | Comp. Ex. |
| 10 | C | AL | 80 | 0 | 4 | Yes | VG | Comp. Ex. |
| 11 | C | AL | 80 | 5 | 4 | Yes | VG | Comp. Ex. |
| 12 | C | AL | 80 | 15 | 4 | Yes | VG | Comp. Ex. |
| 13 | C | AL | 80 | 25 | 4 | Yes | VG | Comp. Ex. |
| 14 | C | AL | 80 | 40 | 4 | Yes | VG | Comp. Ex. |
| 15 | C | GI | 80 | −20 | 4 | Yes | VG | Comp. Ex. |
| 16 | C | GA | 80 | −20 | 4 | Yes | VG | Comp. Ex. |
| 17 | D | CR | 80 | −40 | 4 | Yes | VG | Comp. Ex. |
| 18 | D | CR | 80 | −20 | 4 | Yes | VG | Comp. Ex. |
| 19 | D | CR | 80 | 0 | 4 | Yes | VG | Comp. Ex. |
| 20 | D | CR | 80 | 5 | 4 | Yes | VG | Comp. Ex. |
| 21 | D | CR | 80 | 15 | 4 | Yes | VG | Comp. Ex. |
| 22 | D | CR | 80 | 25 | 4 | Yes | VG | Comp. Ex. |
| 23 | D | CR | 80 | 40 | 4 | Yes | VG | Comp. Ex. |
| 24 | D | AL | 80 | −40 | 4 | Yes | VG | Comp. Ex. |
| 25 | D | AL | 80 | −20 | 4 | Yes | VG | Comp. Ex. |
| 26 | D | AL | 80 | 0 | 4 | Yes | VG | Comp. Ex. |
| 27 | D | AL | 80 | 5 | 4 | Yes | VG | Comp. Ex. |
| 28 | D | AL | 80 | 15 | 4 | Yes | VG | Comp. Ex. |
| 29 | D | AL | 80 | 25 | 4 | Yes | VG | Comp. Ex. |
| 30 | D | AL | 80 | 40 | 4 | Yes | VG | Comp. Ex. |
| 31 | D | GI | 80 | −20 | 4 | Yes | VG | Comp. Ex. |
| 32 | D | GA | 80 | −20 | 4 | Yes | VG | Comp. Ex. |
| 33 | E | CR | 80 | −40 | 4 | Yes | VG | Comp. Ex. |
| 34 | E | CR | 80 | −20 | 4 | Yes | VG | Comp. Ex. |
| 35 | E | CR | 80 | 0 | 4 | Yes | VG | Comp. Ex. |
| 36 | E | CR | 80 | 5 | 4 | Yes | VG | Comp. Ex. |
| 37 | E | CR | 80 | 15 | 4 | Yes | VG | Comp. Ex. |
| 38 | E | CR | 80 | 25 | 4 | Yes | VG | Comp. Ex. |
| 39 | E | CR | 80 | 40 | 4 | Yes | VG | Comp. Ex. |
| 40 | E | AL | 80 | −40 | 4 | Yes | VG | Comp. Ex. |
| 41 | E | AL | 80 | −20 | 4 | Yes | VG | Comp. Ex. |
| 42 | E | AL | 80 | 0 | 4 | Yes | VG | Comp. Ex. |
| 43 | E | AL | 80 | 5 | 4 | Yes | VG | Comp. Ex. |
| 44 | E | AL | 80 | 15 | 4 | Yes | VG | Comp. Ex. |
| 45 | E | AL | 80 | 25 | 4 | Yes | VG | Comp. Ex. |
| 46 | E | AL | 80 | 40 | 4 | Yes | VG | Comp. Ex. |
| 47 | E | GI | 80 | −20 | 4 | Yes | VG | Comp. Ex. |
| 48 | E | GA | 80 | −20 | 4 | Yes | VG | Comp. Ex. |
| 49 | C | CR | 40 | −40 | 4 | Yes | VG | Comp. Ex. |
| 50 | C | CR | 40 | 0 | 4 | Yes | VG | Comp. Ex. |
| 51 | C | CR | 40 | 15 | 4 | Yes | VG | Comp. Ex. |
| 52 | C | CR | 40 | 40 | 4 | Yes | VG | Comp. Ex. |
| 53 | D | CR | 40 | −40 | 4 | Yes | VG | Comp. Ex. |
| 54 | D | CR | 40 | 0 | 4 | Yes | VG | Comp. Ex. |
| 55 | D | CR | 40 | 15 | 4 | Yes | VG | Comp. Ex. |
| 56 | D | CR | 40 | 40 | 4 | Yes | VG | Comp. Ex. |
| 57 | E | CR | 40 | −40 | 4 | Yes | VG | Comp. Ex. |
| 58 | E | CR | 40 | 0 | 4 | Yes | VG | Comp. Ex. |
| 59 | E | CR | 40 | 15 | 4 | Yes | VG | Comp. Ex. |
| 60 | E | CR | 40 | 40 | 4 | None | VG | Inv. range |
| 61 | C | CR | 8 | −40 | 4 | None | VG | Inv. range |
| 62 | C | CR | 8 | −20 | 4 | None | VG | Inv. range |
| 63 | C | CR | 8 | 0 | 4 | None | VG | Inv. range |
| 64 | C | CR | 8 | 5 | 4 | None | VG | Inv. range |
| 65 | C | CR | 8 | 15 | 4 | None | VG | Inv. range |
| 66 | C | CR | 8 | 25 | 4 | None | VG | Inv. range |
| 67 | C | CR | 8 | 40 | 4 | Yes | VG | Comp. Ex. |
| 68 | D | CR | 8 | −40 | 4 | None | VG | Inv. range |
| 69 | D | CR | 8 | −20 | 4 | None | VG | Inv. range |
| 70 | D | CR | 8 | 0 | 4 | None | VG | Inv. range |
| 71 | D | CR | 8 | 5 | 4 | None | VG | Inv. range |
| 72 | D | CR | 8 | 15 | 4 | None | VG | Inv. range |
| 73 | D | CR | 8 | 25 | 4 | None | VG | Inv. range |
| 74 | D | CR | 8 | 40 | 4 | Yes | VG | Comp. Ex. |

TABLE 11-continued

| Ex. no. | Steel type | Plating type | H am't (%) | Dew point (° C.) | Shearing timing (mm) | Cracks | Shape precision | Class |
|---|---|---|---|---|---|---|---|---|
| 75 | E | CR | 8 | −40 | 4 | None | VG | Inv. range |
| 76 | E | CR | 8 | −20 | 4 | None | VG | Inv. range |
| 77 | E | CR | 8 | 0 | 4 | None | VG | Inv. range |
| 78 | E | CR | 8 | 5 | 4 | None | VG | Inv. range |
| 79 | E | CR | 8 | 15 | 4 | None | VG | Inv. range |
| 80 | E | CR | 8 | 25 | 4 | None | VG | Inv. range |
| 81 | E | CR | 8 | 40 | 4 | Yes | VG | Comp. Ex. |
| 82 | C | CR | 4 | −40 | 4 | None | VG | Inv. range |
| 83 | C | CR | 4 | 0 | 4 | None | VG | Inv. range |
| 84 | C | CR | 4 | 15 | 4 | None | VG | Inv. range |
| 85 | C | CR | 4 | 40 | 4 | Yes | VG | Comp. Ex. |
| 86 | D | CR | 4 | −40 | 4 | None | VG | Inv. range |
| 87 | D | CR | 4 | 0 | 4 | None | VG | Inv. range |
| 88 | D | CR | 4 | 15 | 4 | None | VG | Inv. range |
| 89 | D | CR | 4 | 40 | 4 | Yes | VG | Comp. Ex. |
| 90 | E | CR | 4 | −40 | 4 | None | VG | Inv. range |
| 91 | E | CR | 4 | 0 | 4 | None | VG | Inv. range |
| 92 | E | CR | 4 | 15 | 4 | None | VG | Inv. range |
| 93 | C | CR | 4 | 40 | 4 | Yes | VG | Comp. Ex. |
| 94 | C | CR | 2 | −40 | 4 | None | VG | Inv. range |
| 95 | C | CR | 2 | −20 | 4 | None | VG | Inv. range |
| 96 | C | CR | 2 | 0 | 4 | None | VG | Inv. range |
| 97 | C | CR | 2 | 5 | 4 | None | VG | Inv. range |
| 98 | C | CR | 2 | 15 | 4 | None | VG | Inv. range |
| 99 | C | CR | 2 | 25 | 4 | None | VG | Inv. range |
| 100 | C | CR | 2 | 40 | 4 | Yes | VG | Comp. Ex. |
| | | | | (Part 2) | | | | |
| 101 | C | AL | 2 | −40 | 4 | None | VG | Inv. range |
| 102 | C | AL | 2 | −20 | 4 | None | VG | Inv. range |
| 103 | C | AL | 2 | 0 | 4 | None | VG | Inv. range |
| 104 | C | AL | 2 | 5 | 4 | None | VG | Inv. range |
| 105 | C | AL | 2 | 15 | 4 | None | VG | Inv. range |
| 106 | C | AL | 2 | 25 | 4 | None | VG | Inv. range |
| 107 | C | AL | 2 | 40 | 4 | Yes | VG | Comp. Ex. |
| 108 | C | GI | 2 | 15 | 4 | None | VG | Inv. range |
| 109 | C | GA | 2 | 15 | 4 | None | VG | Inv. range |
| 110 | D | CR | 2 | −40 | 4 | None | VG | Inv. range |
| 111 | D | CR | 2 | −20 | 4 | None | VG | Inv. range |
| 112 | D | CR | 2 | 0 | 4 | None | VG | Inv. range |
| 113 | D | CR | 2 | 5 | 4 | None | VG | Inv. range |
| 114 | D | CR | 2 | 15 | 4 | None | VG | Inv. range |
| 115 | D | CR | 2 | 25 | 4 | None | VG | Inv. range |
| 116 | D | CR | 2 | 40 | 4 | Yes | VG | Comp. Ex. |
| 117 | D | AL | 2 | −40 | 4 | None | VG | Inv. range |
| 118 | D | AL | 2 | −20 | 4 | None | VG | Inv. range |
| 119 | D | AL | 2 | 0 | 4 | None | VG | Inv. range |
| 120 | D | AL | 2 | 5 | 4 | None | VG | Inv. range |
| 121 | D | AL | 2 | 15 | 4 | None | VG | Inv. range |
| 122 | D | AL | 2 | 25 | 4 | None | VG | Inv. range |
| 123 | D | AL | 2 | 40 | 4 | Yes | VG | Comp. Ex. |
| 124 | D | GI | 2 | 15 | 4 | None | VG | Inv. range |
| 125 | D | GA | 2 | 15 | 4 | None | VG | Inv. range |
| 126 | E | CR | 2 | −40 | 4 | None | VG | Inv. range |
| 127 | E | CR | 2 | −20 | 4 | None | VG | Inv. range |
| 128 | E | CR | 2 | 0 | 4 | None | VG | Inv. range |
| 129 | E | CR | 2 | 5 | 4 | None | VG | Inv. range |
| 130 | E | CR | 2 | 15 | 4 | None | VG | Inv. range |
| 131 | E | CR | 2 | 25 | 4 | None | VG | Inv. range |
| 132 | E | CR | 2 | 40 | 4 | Yes | VG | Comp. Ex. |
| 133 | E | AL | 2 | −40 | 4 | None | VG | Inv. range |
| 134 | E | AL | 2 | −20 | 4 | None | VG | Inv. range |
| 135 | E | AL | 2 | 0 | 4 | None | VG | Inv. range |
| 136 | E | AL | 2 | 5 | 4 | None | VG | Inv. range |
| 137 | E | AL | 2 | 15 | 4 | None | VG | Inv. range |
| 138 | E | AL | 2 | 25 | 4 | None | VG | Inv. range |
| 139 | E | AL | 2 | 40 | 4 | Yes | VG | Comp. Ex. |
| 140 | E | GI | 2 | 15 | 4 | None | VG | Inv. range |
| 141 | E | GA | 2 | 15 | 4 | None | VG | Inv. range |
| 142 | C | CR | 0.5 | −40 | 4 | None | VG | Inv. range |
| 143 | C | CR | 0.5 | 0 | 4 | None | VG | Inv. range |
| 144 | C | CR | 0.5 | 15 | 4 | None | VG | Inv. range |
| 145 | C | CR | 0.5 | 40 | 4 | Yes | VG | Comp. Ex. |
| 146 | D | CR | 0.5 | −40 | 4 | None | VG | Inv. range |
| 147 | D | CR | 0.5 | 0 | 4 | None | VG | Inv. range |
| 148 | D | CR | 0.5 | 15 | 4 | None | VG | Inv. range |

TABLE 11-continued

| Ex. no. | Steel type | Plating type | H am't (%) | Dew point (° C.) | Shearing timing (mm) | Cracks | Shape precision | Class |
|---|---|---|---|---|---|---|---|---|
| 149 | D | CR | 0.5 | 40 | 4 | Yes | VG | Comp. Ex. |
| 150 | E | CR | 0.5 | −40 | 4 | None | VG | Inv. range |
| 151 | E | CR | 0.5 | 0 | 4 | None | VG | Inv. range |
| 152 | E | CR | 0.5 | 15 | 4 | None | VG | Inv. range |
| 153 | E | CR | 0.5 | 40 | 4 | Yes | VG | Comp. Ex. |
| 154 | C | CR | 0.1 | −40 | 4 | None | VG | Inv. range |
| 155 | C | CR | 0.1 | −20 | 4 | None | VG | Inv. range |
| 156 | C | CR | 0.1 | 0 | 4 | None | VG | Inv. range |
| 157 | C | CR | 0.1 | 5 | 4 | None | VG | Inv. range |
| 158 | C | CR | 0.1 | 15 | 4 | None | VG | Inv. range |
| 159 | C | CR | 0.1 | 25 | 4 | None | VG | Inv. range |
| 160 | C | CR | 0.1 | 40 | 4 | Yes | VG | Comp. Ex. |
| 161 | C | AL | 0.1 | −40 | 4 | None | VG | Inv. range |
| 162 | C | AL | 0.1 | −20 | 4 | None | VG | Inv. range |
| 163 | C | AL | 0.1 | 0 | 4 | None | VG | Inv. range |
| 164 | C | AL | 0.1 | 5 | 4 | None | VG | Inv. range |
| 165 | C | AL | 0.1 | 15 | 4 | None | VG | Inv. range |
| 166 | C | AL | 0.1 | 25 | 4 | None | VG | Inv. range |
| 167 | C | AL | 0.1 | 40 | 4 | Yes | VG | Comp. Ex. |
| 168 | C | GI | 0.1 | 15 | 4 | None | VG | Inv. range |
| 169 | C | GA | 0.1 | 15 | 4 | None | VG | Inv. range |
| 170 | D | CR | 0.1 | −40 | 4 | None | VG | Inv. range |
| 171 | D | CR | 0.1 | −20 | 4 | None | VG | Inv. range |
| 172 | D | CR | 0.1 | 0 | 4 | None | VG | Inv. range |
| 173 | D | CR | 0.1 | 5 | 4 | None | VG | Inv. range |
| 174 | D | CR | 0.1 | 15 | 4 | None | VG | Inv. range |
| 175 | D | CR | 0.1 | 25 | 4 | None | VG | Inv. range |
| 176 | D | CR | 0.1 | 40 | 4 | Yes | VG | Comp. Ex. |
| 177 | D | AL | 0.1 | −40 | 4 | None | VG | Inv. range |
| 178 | D | AL | 0.1 | −20 | 4 | None | VG | Inv. range |
| 179 | D | AL | 0.1 | 0 | 4 | None | VG | Inv. range |
| 180 | D | AL | 0.1 | 5 | 4 | None | VG | Inv. range |
| 181 | D | AL | 0.1 | 15 | 4 | None | VG | Inv. range |
| 182 | D | AL | 0.1 | 25 | 4 | None | VG | Inv. range |
| 183 | D | AL | 0.1 | 40 | 4 | Yes | VG | Comp. Ex. |
| 184 | D | GI | 0.1 | 15 | 4 | None | VG | Inv. range |
| 185 | D | GA | 0.1 | 15 | 4 | None | VG | Inv. range |
| 186 | E | CR | 0.1 | −40 | 4 | None | VG | Inv. range |
| 187 | E | CR | 0.1 | −20 | 4 | None | VG | Inv. range |
| 188 | E | CR | 0.1 | 0 | 4 | None | VG | Inv. range |
| 189 | E | CR | 0.1 | 5 | 4 | None | VG | Inv. range |
| 190 | E | CR | 0.1 | 15 | 4 | None | VG | Inv. range |
| 191 | E | CR | 0.1 | 25 | 4 | None | VG | Inv. range |
| 192 | E | CR | 0.1 | 40 | 4 | Yes | VG | Comp. Ex. |
| 193 | E | AL | 0.1 | −40 | 4 | None | VG | Inv. range |
| 194 | E | AL | 0.1 | −20 | 4 | None | VG | Inv. range |
| 195 | E | AL | 0.1 | 0 | 4 | None | VG | Inv. range |
| 196 | E | AL | 0.1 | 5 | 4 | None | VG | Inv. range |
| 197 | E | AL | 0.1 | 15 | 4 | None | VG | Inv. range |
| 198 | E | AL | 0.1 | 25 | 4 | None | VG | Inv. range |
| 199 | E | AL | 0.1 | 40 | 4 | Yes | VG | Comp. Ex. |
| 200 | E | GI | 0.1 | 15 | 4 | None | VG | Inv. range |
| | | | | (Part 3) | | | | |
| 201 | E | GA | 0.1 | 15 | 4 | None | VG | Inv. range |
| 202 | C | CR | 0.05 | −20 | 4 | None | VG | Inv. range |
| 203 | C | CR | 0.05 | −40 | 4 | None | VG | Inv. range |
| 204 | C | CR | 0.05 | −20 | 4 | None | VG | Inv. range |
| 205 | C | CR | 0.05 | 0 | 4 | None | VG | Inv. range |
| 206 | C | CR | 0.05 | 5 | 4 | None | VG | Inv. range |
| 207 | C | CR | 0.05 | 15 | 4 | None | VG | Inv. range |
| 208 | C | CR | 0.05 | 25 | 4 | None | VG | Inv. range |
| 209 | C | CR | 0.05 | 40 | 4 | Yes | VG | Comp. Ex. |
| 210 | D | CR | 0.05 | −20 | 4 | None | VG | Inv. range |
| 211 | D | CR | 0.05 | −40 | 4 | None | VG | Inv. range |
| 212 | D | CR | 0.05 | −20 | 4 | None | VG | Inv. range |
| 213 | D | CR | 0.05 | 0 | 4 | None | VG | Inv. range |
| 214 | D | CR | 0.05 | 5 | 4 | None | VG | Inv. range |
| 215 | D | CR | 0.05 | 15 | 4 | None | VG | Inv. range |
| 216 | D | CR | 0.05 | 25 | 4 | None | VG | Inv. range |
| 217 | D | CR | 0.05 | 40 | 4 | Yes | VG | Comp. Ex. |
| 218 | E | CR | 0.05 | −20 | 4 | None | VG | Inv. range |
| 219 | E | CR | 0.05 | −40 | 4 | None | VG | Inv. range |
| 220 | E | CR | 0.05 | −20 | 4 | None | VG | Inv. range |
| 221 | E | CR | 0.05 | 0 | 4 | None | VG | Inv. range |
| 222 | E | CR | 0.05 | 5 | 4 | None | VG | Inv. range |

TABLE 11-continued

| Ex. no. | Steel type | Plating type | H am't (%) | Dew point (° C.) | Shearing timing (mm) | Cracks | Shape precision | Class |
|---|---|---|---|---|---|---|---|---|
| 223 | E | CR | 0.05 | 15 | 4 | None | VG | Inv. range |
| 224 | E | CR | 0.05 | 25 | 4 | None | VG | Inv. range |
| 225 | E | CR | 0.05 | 40 | 4 | Yes | VG | Comp. Ex. |
| 226 | C | CR | 0.01 | −40 | 4 | None | VG | Inv. range |
| 227 | C | CR | 0.01 | 0 | 4 | None | VG | Inv. range |
| 228 | C | CR | 0.01 | 15 | 4 | None | VG | Inv. range |
| 229 | C | CR | 0.01 | 40 | 4 | Yes | VG | Comp. Ex. |
| 230 | D | CR | 0.01 | −40 | 4 | None | VG | Inv. range |
| 231 | D | CR | 0.01 | 0 | 4 | None | VG | Inv. range |
| 232 | D | CR | 0.01 | 15 | 4 | None | VG | Inv. range |
| 233 | D | CR | 0.01 | 40 | 4 | Yes | VG | Comp. Ex. |
| 234 | E | CR | 0.01 | −40 | 4 | None | VG | Inv. range |
| 235 | E | CR | 0.01 | 0 | 4 | None | VG | Inv. range |
| 236 | E | CR | 0.01 | 15 | 4 | None | VG | Inv. range |
| 237 | E | CR | 0.01 | 40 | 4 | Yes | VG | Comp. Ex. |
| 238 | C | CR | 0.005 | −40 | 4 | None | VG | Inv. range |
| 239 | C | CR | 0.005 | 0 | 4 | None | VG | Inv. range |
| 240 | C | CR | 0.005 | 15 | 4 | None | VG | Inv. range |
| 241 | C | CR | 0.005 | 40 | 4 | Yes | VG | Comp. Ex. |
| 242 | D | CR | 0.005 | −40 | 4 | None | VG | Inv. range |
| 243 | D | CR | 0.005 | 0 | 4 | None | VG | Inv. range |
| 244 | D | CR | 0.005 | 15 | 4 | None | VG | Inv. range |
| 245 | D | CR | 0.005 | 40 | 4 | Yes | VG | Comp. Ex. |
| 246 | E | CR | 0.005 | −40 | 4 | None | VG | Inv. range |
| 247 | E | CR | 0.005 | 0 | 4 | None | VG | Inv. range |
| 248 | E | CR | 0.005 | 15 | 4 | None | VG | Inv. range |
| 249 | E | CR | 0.005 | 40 | 4 | Yes | VG | Comp. Ex. |
| 250 | D | CR | 0.1 | −40 | 8 | None | G | Inv. range |
| 251 | D | CR | 0.1 | −20 | 8 | None | G | Inv. range |
| 252 | D | CR | 0.1 | 0 | 8 | None | G | Inv. range |
| 253 | D | CR | 0.1 | 5 | 8 | None | G | Inv. range |
| 254 | D | CR | 0.1 | 15 | 8 | None | G | Inv. range |
| 255 | D | CR | 0.1 | 25 | 8 | None | G | Inv. range |
| 256 | D | CR | 0.1 | 40 | 8 | Yes | G | Comp. Ex. |
| 257 | D | AL | 0.1 | −40 | 8 | None | G | Inv. range |
| 258 | D | AL | 0.1 | −20 | 8 | None | G | Inv. range |
| 259 | D | AL | 0.1 | 0 | 8 | None | G | Inv. range |
| 260 | D | AL | 0.1 | 5 | 8 | None | G | Inv. range |
| 261 | D | AL | 0.1 | 15 | 8 | None | G | Inv. range |
| 262 | D | AL | 0.1 | 25 | 8 | None | G | Inv. range |
| 263 | D | AL | 0.1 | 40 | 8 | Yes | G | Comp. Ex. |
| 264 | D | CR | 0.1 | −40 | 15 | None | F | Comp. Ex. |
| 265 | D | CR | 0.1 | −20 | 15 | None | F | Comp. Ex. |
| 266 | D | CR | 0.1 | 0 | 15 | None | F | Comp. Ex. |
| 267 | D | CR | 0.1 | 5 | 15 | None | F | Comp. Ex. |
| 268 | D | CR | 0.1 | 15 | 15 | None | F | Comp. Ex. |
| 269 | D | CR | 0.1 | 25 | 15 | None | F | Comp. Ex. |
| 270 | D | CR | 0.1 | 40 | 15 | Yes | F | Comp. Ex. |
| 271 | D | AL | 0.1 | −40 | 15 | None | F | Comp. Ex. |
| 272 | D | AL | 0.1 | −20 | 15 | None | F | Comp. Ex. |
| 273 | D | AL | 0.1 | 0 | 15 | None | F | Comp. Ex. |
| 274 | D | AL | 0.1 | 5 | 15 | None | F | Comp. Ex. |
| 275 | D | AL | 0.1 | 15 | 15 | None | F | Comp. Ex. |
| 276 | D | AL | 0.1 | 25 | 15 | None | F | Comp. Ex. |
| 277 | D | AL | 0.1 | 40 | 15 | Yes | F | Comp. Ex. |
| 264 | D | CR | 0.1 | −40 | 25 | None | x | Comp. Ex. |
| 265 | D | CR | 0.1 | −20 | 25 | None | x | Comp. Ex. |
| 266 | D | CR | 0.1 | 0 | 25 | None | x | Comp. Ex. |
| 267 | D | CR | 0.1 | 5 | 25 | None | x | Comp. Ex. |
| 268 | D | CR | 0.1 | 15 | 25 | None | x | Comp. Ex. |
| 269 | D | CR | 0.1 | 25 | 25 | None | x | Comp. Ex. |
| 270 | D | CR | 0.1 | 40 | 25 | Yes | x | Comp. Ex. |
| 271 | D | AL | 0.1 | −40 | 25 | None | x | Comp. Ex. |
| 272 | D | AL | 0.1 | −20 | 25 | None | x | Comp. Ex. |
| 273 | D | AL | 0.1 | 0 | 25 | None | x | Comp. Ex. |
| 274 | D | AL | 0.1 | 5 | 25 | None | x | Comp. Ex. |
| 275 | D | AL | 0.1 | 15 | 25 | None | x | Comp. Ex. |
| 276 | D | AL | 0.1 | 25 | 25 | None | x | Comp. Ex. |
| 277 | D | AL | 0.1 | 40 | 25 | Yes | x | Comp. Ex. |

Example 7

Steel slabs having the chemical compositions shown in Table 4 were cast. These slabs were heated to 1050 to 1350° C., then hot rolled at a finishing temperature of 800 to 900° C. and a coiling temperature of 450 to 680° C. to obtain hot rolled steel sheets having a thickness of 4 mm. The steel sheets were then pickled and cold rolled to obtain cold rolled steel sheets having a thickness of 1.6 mm. Further, a portion of the cold rolled plates were treated by hot dip aluminum coating, hot dip aluminum-zinc coating, alloying hot dip galvanization, and/or hot dip galvanization. Table 5 shows a legend of the plating types used. These cold rolled steel sheets and surface treated steel sheets were then heated in a furnace to above the Ac3 point, that is, to 950° C. in the austenite region, then hot shaped. The atmosphere of the heating furnace was varied with respect to the amount of hydrogen and the dew point. The conditions used are shown in Table 13.

A cross-section of the shape of the mold is shown in FIG. 14. The legend in FIG. 14 is shown here (1: die, 2: punch). The shape of the punch as seen from above is shown in FIG. 15. The legend in FIG. 15 is shown here (2: punch). The shape of the die as seen from below is shown in FIG. 16. The legend in FIG. 16 is shown here (1: die). The mold followed the shape of the punch. The shape of the die was determined by providing a clearance having a thickness of 1.6 mm. The blank size (in mm) was 1.6 (thickness)×300×500. The shaping conditions included a punch speed of 10 mm/s, a pressing force of 200 tons, and a holding time at bottom dead center of 5 seconds. A schematic view of the shaped part is shown in FIG. 17. Using a tensile test piece cut out from the shaped part, the tensile strength of the shaped part was observed to be 1470 MPa or more.

Figure 25:
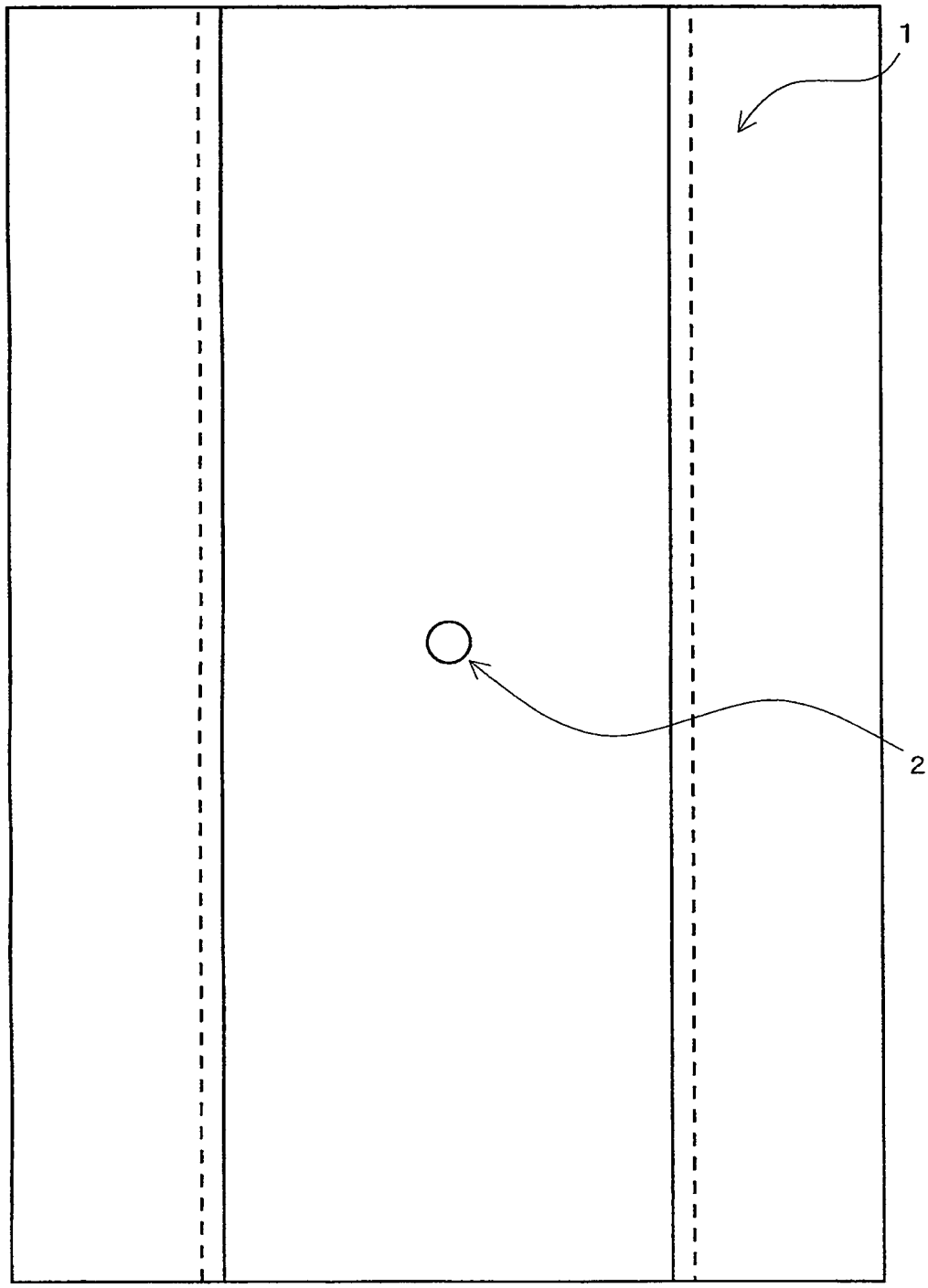
FIG. 25 is a schematic diagram of the state of a post-processing position described in Example 6.

After hot shaping, a hole of a diameter of 10 mm was made at the position shown in FIG. 25. FIG. 25 shows the shape of the part as seen from above. The legend in FIG. 25 is shown here (1: part, 2: hole part). Working procedures including laser working, plasma cutting, drilling, and cutting by sawing using a counter machine were performed. The working procedures are shown together in Table 13. The legend in the table is shown next: laser working: "L", plasma cutting: "P", gas fusion cutting "G", drilling: "D", and sawing: "S". The above working was performed within 30 minutes after the hot shaping. Resistance to hydrogen embrittlement was evaluated by examining the entire circumference of the holes one week after the working to evaluate the presence of any cracking. The observation was performed using a loupe or an electron microscope. The results of these evaluations are shown together in Table 3.

Further, the heat effect near the cut surface was examined for laser working, plasma cutting, and gas fusion cutting. The cross-sectional hardness at a position 3 mm from the cut surface was examined using Vicker's hardness based on a load of 10 kgf, and compared with the hardness at a location 100 mm from the cut surface where no heat effect is expected. The results are shown below in Table 13 as a hardness reduction rate.

The hardness reduction rate can be represented by the expression:[(hardness at position 100 mm from cut surface)−(hardness of position 3 mm from the cut surface)]/(hardness at position 100 mm from cut surface)×100 (%)

The legend representing hardness reduction rates is as follows: Hardness reduction rate less than 10%: VG, hardness reduction rate 10% to less than 30%: G, hardness reduction rate 30% to less than 50%: F, hardness reduction rate 50% or more: P Experiment Nos. 1 to 249 show the results of consideration of the effects of the steel type, plating type, concentration of hydrogen in the atmosphere, and dew point for samples processed using laser working. No cracks occurred after piercing in samples processed in accordance with exemplary embodiments of the present invention. Experiment Nos. 250 to 277 show the results of plasma working as the effect of the working process. For samples processed in accordance with exemplary embodiments of the present invention, no cracks occurred after piercing. Experiment Nos. 278 to 526 show the results based on effects of the steel type, plating type, concentration of hydrogen in the atmosphere, and dew point for samples processed by drilling. No cracks occurred after piercing in samples processed in accordance with exemplary embodiments of the present invention. Experiment Nos. 527 to 558 show the results for samples processed using sawing as a working technique. Again, no cracks occurred after piercing in samples processed in accordance with exemplary embodiments of the present invention.

Experiment Nos. 559 to 564 present experiments which include changes in a fusion cutting procedure. Since the atmospheres are in accordance with exemplary embodiments of the present invention and the procedures involve fusion cutting, cracking does not occur, but hardness near the cut parts diminished in Experiment Nos. 561 and 564. These results suggest that a fusion cutting method may be desirable because the heat affected zones can be small.

TABLE 12

| Difference from reference shape | Legend |
|---|---|
| 0.5 mm or less | VG |
| 1.0 mm or less | G |
| 1.5 mm or less | F |
| Over 1.5 mm | x |

TABLE 13

| Ex. no. | Steel type | Plating type | H am't (%) | Dew point (° C.) | Work method | Cracks | Hardness drop | Class |
|---|---|---|---|---|---|---|---|---|
| (Part 1) | | | | | | | | |
| 1 | C | CR | 80 | −40 | L | Yes | VG | Comp. Ex. |
| 2 | C | CR | 80 | −20 | L | Yes | VG | Comp. Ex. |
| 3 | C | CR | 80 | 0 | L | Yes | VG | Comp. Ex. |
| 4 | C | CR | 80 | 5 | L | Yes | VG | Comp. Ex. |
| 5 | C | CR | 80 | 15 | L | Yes | VG | Comp. Ex. |
| 6 | C | CR | 80 | 25 | L | Yes | VG | Comp. Ex. |
| 7 | C | CR | 80 | 40 | L | Yes | VG | Comp. Ex. |
| 8 | C | AL | 80 | −40 | L | Yes | VG | Comp. Ex. |
| 9 | C | AL | 80 | −20 | L | Yes | VG | Comp. Ex. |
| 10 | C | AL | 80 | 0 | L | Yes | VG | Comp. Ex. |
| 11 | C | AL | 80 | 5 | L | Yes | VG | Comp. Ex. |
| 12 | C | AL | 80 | 15 | L | Yes | VG | Comp. Ex. |
| 13 | C | AL | 80 | 25 | L | Yes | VG | Comp. Ex. |
| 14 | C | AL | 80 | 40 | L | Yes | VG | Comp. Ex. |
| 15 | C | GI | 80 | −20 | L | Yes | VG | Comp. Ex. |
| 16 | C | GA | 80 | −20 | L | Yes | VG | Comp. Ex. |
| 17 | D | CR | 80 | −40 | L | Yes | VG | Comp. Ex. |
| 18 | D | CR | 80 | −20 | L | Yes | VG | Comp. Ex. |

TABLE 13-continued

| Ex. no. | Steel type | Plating type | H am't (%) | Dew point (° C.) | Work method | Cracks | Hardness drop | Class |
|---|---|---|---|---|---|---|---|---|
| 19 | D | CR | 80 | 0 | L | Yes | VG | Comp. Ex. |
| 20 | D | CR | 80 | 5 | L | Yes | VG | Comp. Ex. |
| 21 | D | CR | 80 | 15 | L | Yes | VG | Comp. Ex. |
| 22 | D | CR | 80 | 25 | L | Yes | VG | Comp. Ex. |
| 23 | D | CR | 80 | 40 | L | Yes | VG | Comp. Ex. |
| 24 | D | AL | 80 | −40 | L | Yes | VG | Comp. Ex. |
| 25 | D | AL | 80 | −20 | L | Yes | VG | Comp. Ex. |
| 26 | D | AL | 80 | 0 | L | Yes | VG | Comp. Ex. |
| 27 | D | AL | 80 | 5 | L | Yes | VG | Comp. Ex. |
| 28 | D | AL | 80 | 15 | L | Yes | VG | Comp. Ex. |
| 29 | D | AL | 80 | 25 | L | Yes | VG | Comp. Ex. |
| 30 | D | AL | 80 | 40 | L | Yes | VG | Comp. Ex. |
| 31 | D | GI | 80 | −20 | L | Yes | VG | Comp. Ex. |
| 32 | D | GA | 80 | −20 | L | Yes | VG | Comp. Ex. |
| 33 | E | CR | 80 | −40 | L | Yes | VG | Comp. Ex. |
| 34 | E | CR | 80 | −20 | L | Yes | VG | Comp. Ex. |
| 35 | E | CR | 80 | 0 | L | Yes | VG | Comp. Ex. |
| 36 | E | CR | 80 | 5 | L | Yes | VG | Comp. Ex. |
| 37 | E | CR | 80 | 15 | L | Yes | VG | Comp. Ex. |
| 38 | E | CR | 80 | 25 | L | Yes | VG | Comp. Ex. |
| 39 | E | CR | 80 | 40 | L | Yes | VG | Comp. Ex. |
| 40 | E | AL | 80 | −40 | L | Yes | VG | Comp. Ex. |
| 41 | E | AL | 80 | −20 | L | Yes | VG | Comp. Ex. |
| 42 | E | AL | 80 | 0 | L | Yes | VG | Comp. Ex. |
| 43 | E | AL | 80 | 5 | L | Yes | VG | Comp. Ex. |
| 44 | E | AL | 80 | 15 | L | Yes | VG | Comp. Ex. |
| 45 | E | AL | 80 | 25 | L | Yes | VG | Comp. Ex. |
| 46 | E | AL | 80 | 40 | L | Yes | VG | Comp. Ex. |
| 47 | E | GI | 80 | −20 | L | Yes | VG | Comp. Ex. |
| 48 | E | GA | 80 | −20 | L | Yes | VG | Comp. Ex. |
| 49 | C | CR | 40 | −40 | L | Yes | VG | Comp. Ex. |
| 50 | C | CR | 40 | 0 | L | Yes | VG | Comp. Ex. |
| 51 | C | CR | 40 | 15 | L | Yes | VG | Comp. Ex. |
| 52 | C | CR | 40 | 40 | L | Yes | VG | Comp. Ex. |
| 53 | D | CR | 40 | −40 | L | Yes | VG | Comp. Ex. |
| 54 | D | CR | 40 | 0 | L | Yes | VG | Comp. Ex. |
| 55 | D | CR | 40 | 15 | L | Yes | VG | Comp. Ex. |

TABLE 13-continued

| Ex. no. | Steel type | Plating type | H am't (%) | Dew point (° C.) | Work method | Cracks | Hardness drop | Class |
|---|---|---|---|---|---|---|---|---|
| 56 | D | CR | 40 | 40 | L | Yes | VG | Comp. Ex. |
| 57 | E | CR | 40 | −40 | L | Yes | VG | Comp. Ex. |
| 58 | E | CR | 40 | 0 | L | Yes | VG | Comp. Ex. |
| 59 | E | CR | 40 | 15 | L | Yes | VG | Comp. Ex. |
| 60 | E | CR | 40 | 40 | L | Yes | VG | Comp. Ex. |
| 61 | C | CR | 8 | −40 | L | None | VG | Inv. range |
| 62 | C | CR | 8 | −20 | L | None | VG | Inv. range |
| 63 | C | CR | 8 | 0 | L | None | VG | Inv. range |
| 64 | C | CR | 8 | 5 | L | None | VG | Inv. range |
| 65 | C | CR | 8 | 15 | L | None | VG | Inv. range |
| 66 | C | CR | 8 | 25 | L | None | VG | Inv. range |
| 67 | C | CR | 8 | 40 | L | Yes | VG | Comp. Ex. |
| 68 | D | CR | 8 | −40 | L | None | VG | Inv. range |
| 69 | D | CR | 8 | −20 | L | None | VG | Inv. range |
| 70 | D | CR | 8 | 0 | L | None | VG | Inv. range |
| 71 | D | CR | 8 | 5 | L | None | VG | Inv. range |
| 72 | D | CR | 8 | 15 | L | None | VG | Inv. range |
| 73 | D | CR | 8 | 25 | L | None | VG | Inv. range |
| 74 | D | CR | 8 | 40 | L | Yes | VG | Comp. Ex. |
| 75 | E | CR | 8 | −40 | L | None | VG | Inv. range |
| 76 | E | CR | 8 | −20 | L | None | VG | Inv. range |
| 77 | E | CR | 8 | 0 | L | None | VG | Inv. range |
| 78 | E | CR | 8 | 5 | L | None | VG | Inv. range |
| 79 | E | CR | 8 | 15 | L | None | VG | Inv. range |
| 80 | E | CR | 8 | 25 | L | None | VG | Inv. range |
| 81 | E | CR | 8 | 40 | L | Yes | VG | Comp. Ex. |
| 82 | C | CR | 4 | −40 | L | None | VG | Inv. range |
| 83 | C | CR | 4 | 0 | L | None | VG | Inv. range |
| 84 | C | CR | 4 | 15 | L | None | VG | Inv. range |
| 85 | C | CR | 4 | 40 | L | Yes | VG | Comp. Ex. |
| 86 | D | CR | 4 | −40 | L | None | VG | Inv. range |
| 87 | D | CR | 4 | 0 | L | None | VG | Inv. range |
| 88 | D | CR | 4 | 15 | L | None | VG | Inv. range |
| 89 | D | CR | 4 | 40 | L | Yes | VG | Comp. Ex. |
| 90 | E | CR | 4 | −40 | L | None | VG | Inv. range |
| 91 | E | CR | 4 | 0 | L | None | VG | Inv. range |
| 92 | E | CR | 4 | 15 | L | None | VG | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 93 | E | CR | 4 | 40 | L | Yes | VG | Comp. Ex. |
| 94 | C | CR | 2 | −40 | L | None | VG | Inv. range |
| 95 | C | CR | 2 | −20 | L | None | VG | Inv. range |
| 96 | C | CR | 2 | 0 | L | None | VG | Inv. range |
| 97 | C | CR | 2 | 5 | L | None | VG | Inv. range |
| 98 | C | CR | 2 | 15 | L | None | VG | Inv. range |
| 99 | C | CR | 2 | 25 | L | None | VG | Inv. range |
| 100 | C | CR | 2 | 40 | L | Yes | VG | Comp. Ex. |
| | | | | (Part 2) | | | | |
| 101 | C | AL | 2 | −40 | L | None | VG | Inv. range |
| 102 | C | AL | 2 | −20 | L | None | VG | Inv. range |
| 103 | C | AL | 2 | 0 | L | None | VG | Inv. range |
| 104 | C | AL | 2 | 5 | L | None | VG | Inv. range |
| 105 | C | AL | 2 | 15 | L | None | VG | Inv. range |
| 106 | C | AL | 2 | 25 | L | None | VG | Inv. range |
| 107 | C | AL | 2 | 40 | L | Yes | VG | Comp. Ex. |
| 108 | C | GI | 2 | 15 | L | None | VG | Inv. range |
| 109 | C | GA | 2 | 15 | L | None | VG | Inv. range |
| 110 | D | CR | 2 | −40 | L | None | VG | Inv. range |
| 111 | D | CR | 2 | −20 | L | None | VG | Inv. range |
| 112 | D | CR | 2 | 0 | L | None | VG | Inv. range |
| 113 | D | CR | 2 | 5 | L | None | VG | Inv. range |
| 114 | D | CR | 2 | 15 | L | None | VG | Inv. range |
| 115 | D | CR | 2 | 25 | L | None | VG | Inv. range |
| 116 | D | CR | 2 | 40 | L | Yes | VG | Comp. Ex. |
| 117 | D | AL | 2 | −40 | L | None | VG | Inv. range |
| 118 | D | AL | 2 | −20 | L | None | VG | Inv. range |
| 119 | D | AL | 2 | 0 | L | None | VG | Inv. range |
| 120 | D | AL | 2 | 5 | L | None | VG | Inv. range |
| 121 | D | AL | 2 | 15 | L | None | VG | Inv. range |
| 122 | D | AL | 2 | 25 | L | None | VG | Inv. range |
| 123 | D | AL | 2 | 40 | L | Yes | VG | Comp. Ex. |
| 124 | D | GI | 2 | 15 | L | None | VG | Inv. range |
| 125 | D | GA | 2 | 15 | L | None | VG | Inv. range |
| 126 | E | CR | 2 | −40 | L | None | VG | Inv. range |
| 127 | E | CR | 2 | −20 | L | None | VG | Inv. range |
| 128 | E | CR | 2 | 0 | L | None | VG | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 129 | E | CR | 2 | 5 | L | None | VG | Inv. range |
| 130 | E | CR | 2 | 15 | L | None | VG | Inv. range |
| 131 | E | CR | 2 | 25 | L | None | VG | Inv. range |
| 132 | E | CR | 2 | 40 | L | Yes | VG | Comp. Ex. |
| 133 | E | AL | 2 | −40 | L | None | VG | Inv. range |
| 134 | E | AL | 2 | −20 | L | None | VG | Inv. range |
| 135 | E | AL | 2 | 0 | L | None | VG | Inv. range |
| 136 | E | AL | 2 | 5 | L | None | VG | Inv. range |
| 137 | E | AL | 2 | 15 | L | None | VG | Inv. range |
| 138 | E | AL | 2 | 25 | L | None | VG | Inv. range |
| 139 | E | AL | 2 | 40 | L | Yes | VG | Comp. Ex. |
| 140 | E | GI | 2 | 15 | L | None | VG | Inv. range |
| 141 | E | GA | 2 | 15 | L | None | VG | Inv. range |
| 142 | C | CR | 0.5 | −40 | L | None | VG | Inv. range |
| 143 | C | CR | 0.5 | 0 | L | None | VG | Inv. range |
| 144 | C | CR | 0.5 | 15 | L | None | VG | Inv. range |
| 145 | C | CR | 0.5 | 40 | L | Yes | VG | Comp. Ex. |
| 146 | D | CR | 0.5 | −40 | L | None | VG | Inv. range |
| 147 | D | CR | 0.5 | 0 | L | None | VG | Inv. range |
| 148 | D | CR | 0.5 | 15 | L | None | VG | Inv. range |
| 149 | D | CR | 0.5 | 40 | L | Yes | VG | Comp. Ex. |
| 150 | E | CR | 0.5 | −40 | L | None | VG | Inv. range |
| 151 | E | CR | 0.5 | 0 | L | None | VG | Inv. range |
| 152 | E | CR | 0.5 | 15 | L | None | VG | Inv. range |
| 153 | E | CR | 0.5 | 40 | L | Yes | VG | Comp. Ex. |
| 154 | C | CR | 0.1 | −40 | L | None | VG | Inv. range |
| 155 | C | CR | 0.1 | −20 | L | None | VG | Inv. range |
| 156 | C | CR | 0.1 | 0 | L | None | VG | Inv. range |
| 157 | C | CR | 0.1 | 5 | L | None | VG | Inv. range |
| 158 | C | CR | 0.1 | 15 | L | None | VG | Inv. range |
| 159 | C | CR | 0.1 | 25 | L | None | VG | Inv. range |
| 160 | C | CR | 0.1 | 40 | L | Yes | VG | Comp. Ex. |
| 161 | C | AL | 0.1 | −40 | L | None | VG | Inv. range |
| 162 | C | AL | 0.1 | −20 | L | None | VG | Inv. range |
| 163 | C | AL | 0.1 | 0 | L | None | VG | Inv. range |
| 164 | C | AL | 0.1 | 5 | L | None | VG | Inv. range |
| 165 | C | AL | 0.1 | 15 | L | None | VG | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 166 | C | AL | 0.1 | 25 | L | None | VG | Inv. range |
| 167 | C | AL | 0.1 | 40 | L | Yes | VG | Comp. Ex. |
| 168 | C | GI | 0.1 | 15 | L | None | VG | Inv. range |
| 169 | C | GA | 0.1 | 15 | L | None | VG | Inv. range |
| 170 | D | CR | 0.1 | −40 | L | None | VG | Inv. range |
| 171 | D | CR | 0.1 | −20 | L | None | VG | Inv. range |
| 172 | D | CR | 0.1 | 0 | L | None | VG | Inv. range |
| 173 | D | CR | 0.1 | 5 | L | None | VG | Inv. range |
| 174 | D | CR | 0.1 | 15 | L | None | VG | Inv. range |
| 175 | D | CR | 0.1 | 25 | L | None | VG | Inv. range |
| 176 | D | CR | 0.1 | 40 | L | Yes | VG | Comp. Ex. |
| 177 | D | AL | 0.1 | −40 | L | None | VG | Inv. range |
| 178 | D | AL | 0.1 | −20 | L | None | VG | Inv. range |
| 179 | D | AL | 0.1 | 0 | L | None | VG | Inv. range |
| 180 | D | AL | 0.1 | 5 | L | None | VG | Inv. range |
| 181 | D | AL | 0.1 | 15 | L | None | VG | Inv. range |
| 182 | D | AL | 0.1 | 25 | L | None | VG | Inv. range |
| 183 | D | AL | 0.1 | 40 | L | Yes | VG | Comp. Ex. |
| 184 | D | GI | 0.1 | 15 | L | None | VG | Inv. range |
| 185 | D | GA | 0.1 | 15 | L | None | VG | Inv. range |
| 186 | E | CR | 0.1 | −40 | L | None | VG | Inv. range |
| 187 | E | CR | 0.1 | −20 | L | None | VG | Inv. range |
| 188 | E | CR | 0.1 | 0 | L | None | VG | Inv. range |
| 189 | E | CR | 0.1 | 5 | L | None | VG | Inv. range |
| 190 | E | CR | 0.1 | 15 | L | None | VG | Inv. range |
| 191 | E | CR | 0.1 | 25 | L | None | VG | Inv. range |
| 192 | E | CR | 0.1 | 40 | L | Yes | VG | Comp. Ex. |
| 193 | E | AL | 0.1 | −40 | L | None | VG | Inv. range |
| 194 | E | AL | 0.1 | −20 | L | None | VG | Inv. range |
| 195 | E | AL | 0.1 | 0 | L | None | VG | Inv. range |
| 196 | E | AL | 0.1 | 5 | L | None | VG | Inv. range |
| 197 | E | AL | 0.1 | 15 | L | None | VG | Inv. range |
| 198 | E | AL | 0.1 | 25 | L | None | VG | Inv. range |
| 199 | E | AL | 0.1 | 40 | L | Yes | VG | Comp. Ex. |
| 200 | E | GI | 0.1 | 15 | L | None | VG | Inv. range |
| | | | | (Part 3) | | | | |
| 201 | E | GA | 0.1 | 15 | L | None | VG | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 202 | C | CR | 0.05 | −20 | L | None | VG | Inv. range |
| 203 | C | CR | 0.05 | −40 | L | None | VG | Inv. range |
| 204 | C | CR | 0.05 | −20 | L | None | VG | Inv. range |
| 205 | C | CR | 0.05 | 0 | L | None | VG | Inv. range |
| 206 | C | CR | 0.05 | 5 | L | None | VG | Inv. range |
| 207 | C | CR | 0.05 | 15 | L | None | VG | Inv. range |
| 208 | C | CR | 0.05 | 25 | L | None | VG | Inv. range |
| 209 | C | CR | 0.05 | 40 | L | Yes | VG | Comp. Ex. |
| 210 | D | CR | 0.05 | −20 | L | None | VG | Inv. range |
| 211 | D | CR | 0.05 | −40 | L | None | VG | Inv. range |
| 212 | D | CR | 0.05 | −20 | L | None | VG | Inv. range |
| 213 | D | CR | 0.05 | 0 | L | None | VG | Inv. range |
| 214 | D | CR | 0.05 | 5 | L | None | VG | Inv. range |
| 215 | D | CR | 0.05 | 15 | L | None | VG | Inv. range |
| 216 | D | CR | 0.05 | 25 | L | None | VG | Inv. range |
| 217 | D | CR | 0.05 | 40 | L | Yes | VG | Comp. Ex. |
| 218 | E | CR | 0.05 | −20 | L | None | VG | Inv. range |
| 219 | E | CR | 0.05 | −40 | L | None | VG | Inv. range |
| 220 | E | CR | 0.05 | −20 | L | None | VG | Inv. range |
| 221 | E | CR | 0.05 | 0 | L | None | VG | Inv. range |
| 222 | E | CR | 0.05 | 5 | L | None | VG | Inv. range |
| 223 | E | CR | 0.05 | 15 | L | None | VG | Inv. range |
| 224 | E | CR | 0.05 | 25 | L | None | VG | Inv. range |
| 225 | E | CR | 0.05 | 40 | L | Yes | VG | Comp. Ex. |
| 226 | C | CR | 0.01 | −40 | L | None | VG | Inv. range |
| 227 | C | CR | 0.01 | 0 | L | None | VG | Inv. range |
| 228 | C | CR | 0.01 | 15 | L | None | VG | Inv. range |
| 229 | C | CR | 0.01 | 40 | L | Yes | VG | Comp. Ex. |
| 230 | D | CR | 0.01 | −40 | L | None | VG | Inv. range |
| 231 | D | CR | 0.01 | 0 | L | None | VG | Inv. range |
| 232 | D | CR | 0.01 | 15 | L | None | VG | Inv. range |
| 233 | D | CR | 0.01 | 40 | L | Yes | VG | Comp. Ex. |
| 234 | E | CR | 0.01 | −40 | L | None | VG | Inv. range |
| 235 | E | CR | 0.01 | 0 | L | None | VG | Inv. range |
| 236 | E | CR | 0.01 | 15 | L | None | VG | Inv. range |
| 237 | E | CR | 0.01 | 40 | L | Yes | VG | Comp. Ex. |
| 238 | C | CR | 0.005 | −40 | L | None | VG | Inv. range |

TABLE 13-continued

| Ex. no. | Steel type | Plating type | H am't (%) | Dew point (° C.) | Work me-thod | Cracks | Hard-ness drop | Class |
|---|---|---|---|---|---|---|---|---|
| 239 | C | CR | 0.005 | 0 | L | None | VG | Inv. range |
| 240 | C | CR | 0.005 | 15 | L | None | VG | Inv. range |
| 241 | C | CR | 0.005 | 40 | L | Yes | VG | Comp. Ex. |
| 242 | D | CR | 0.005 | −40 | L | None | VG | Inv. range |
| 243 | D | CR | 0.005 | 0 | L | None | VG | Inv. range |
| 244 | D | CR | 0.005 | 15 | L | None | VG | Inv. range |
| 245 | D | CR | 0.005 | 40 | L | Yes | VG | Comp. Ex. |
| 246 | E | CR | 0.005 | −40 | L | None | VG | Inv. range |
| 247 | E | CR | 0.005 | 0 | L | None | VG | Inv. range |
| 248 | E | CR | 0.005 | 15 | L | None | VG | Inv. range |
| 249 | E | CR | 0.005 | 40 | L | Yes | VG | Comp. Ex. |
| 250 | D | CR | 80 | −40 | P | Yes | G | Comp. Ex. |
| 251 | D | CR | 80 | −20 | P | Yes | G | Comp. Ex. |
| 252 | D | CR | 80 | 0 | P | Yes | G | Comp. Ex. |
| 253 | D | CR | 80 | 5 | P | Yes | G | Comp. Ex. |
| 254 | D | CR | 80 | 15 | P | Yes | G | Comp. Ex. |
| 255 | D | CR | 80 | 25 | P | Yes | G | Comp. Ex. |
| 256 | D | CR | 80 | 40 | P | Yes | G | Comp. Ex. |
| 257 | D | AL | 80 | −40 | P | Yes | G | Comp. Ex. |
| 258 | D | AL | 80 | −20 | P | Yes | G | Comp. Ex. |
| 259 | D | AL | 80 | 0 | P | Yes | G | Comp. Ex. |
| 260 | D | AL | 80 | 5 | P | Yes | G | Comp. Ex. |
| 261 | D | AL | 80 | 15 | P | Yes | G | Comp. Ex. |
| 262 | D | AL | 80 | 25 | P | Yes | G | Comp. Ex. |
| 263 | D | AL | 80 | 40 | P | Yes | G | Comp. Ex. |
| 264 | D | CR | 8 | −40 | P | None | G | Inv. range |
| 265 | D | CR | 8 | −20 | P | None | G | Inv. range |
| 266 | D | CR | 8 | 0 | P | None | G | Inv. range |
| 267 | D | CR | 8 | 5 | P | None | G | Inv. range |
| 268 | D | CR | 8 | 15 | P | None | G | Inv. range |
| 269 | D | CR | 8 | 25 | P | None | G | Inv. range |
| 270 | D | CR | 8 | 40 | P | Yes | G | Comp. Ex. |
| 271 | D | AL | 8 | −40 | P | None | G | Inv. range |
| 272 | D | AL | 8 | −20 | P | None | G | Inv. range |
| 273 | D | AL | 8 | 0 | P | None | G | Inv. range |
| 274 | D | AL | 8 | 5 | P | None | G | Inv. range |
| 275 | D | AL | 8 | 15 | P | None | G | Inv. range |

TABLE 13-continued

| Ex. no. | Steel type | Plating type | H am't (%) | Dew point (° C.) | Work me-thod | Cracks | Hard-ness drop | Class |
|---|---|---|---|---|---|---|---|---|
| 276 | D | AL | 8 | 25 | P | None | G | Inv. range |
| 277 | D | AL | 8 | 40 | P | Yes | G | Comp. Ex. |
| 278 | C | CR | 80 | −40 | D | Yes | — | Comp. Ex. |
| 279 | C | CR | 80 | −20 | D | Yes | — | Comp. Ex. |
| 280 | C | CR | 80 | 0 | D | Yes | — | Comp. Ex. |
| 281 | C | CR | 80 | 5 | D | Yes | — | Comp. Ex. |
| 282 | C | CR | 80 | 15 | D | Yes | — | Comp. Ex. |
| 283 | C | CR | 80 | 25 | D | Yes | — | Comp. Ex. |
| 284 | C | CR | 80 | 40 | D | Yes | — | Comp. Ex. |
| 285 | C | AL | 80 | −40 | D | Yes | — | Comp. Ex. |
| 286 | C | AL | 80 | −20 | D | Yes | — | Comp. Ex. |
| 287 | C | AL | 80 | 0 | D | Yes | — | Comp. Ex. |
| 288 | C | AL | 80 | 5 | D | Yes | — | Comp. Ex. |
| 289 | C | AL | 80 | 15 | D | Yes | — | Comp. Ex. |
| 290 | C | AL | 80 | 25 | D | Yes | — | Comp. Ex. |
| 291 | C | Al | 80 | 40 | D | Yes | — | Comp. Ex. |
| 292 | C | GI | 80 | −20 | D | Yes | — | Comp. Ex. |
| 293 | C | GA | 80 | −20 | D | Yes | — | Comp. Ex. |
| 294 | D | CR | 80 | −40 | D | Yes | — | Comp. Ex. |
| 295 | D | CR | 80 | −20 | D | Yes | — | Comp. Ex. |
| 296 | D | CR | 80 | 0 | D | Yes | — | Comp. Ex. |
| 297 | D | CR | 80 | 5 | D | Yes | — | Comp. Ex. |
| 298 | D | CR | 80 | 15 | D | Yes | — | Comp. Ex. |
| 299 | D | CR | 80 | 25 | D | Yes | — | Comp. Ex. |
| 300 | D | CR | 80 | 40 | D | Yes | — | Comp. Ex. |
| | | | | (Part 4) | | | | |
| 301 | D | AL | 80 | −40 | D | Yes | — | Comp. Ex. |
| 302 | D | AL | 80 | −20 | D | Yes | — | Comp. Ex. |
| 303 | D | AL | 80 | 0 | D | Yes | — | Comp. Ex. |
| 304 | D | AL | 80 | 5 | D | Yes | — | Comp. Ex. |
| 305 | D | AL | 80 | 15 | D | Yes | — | Comp. Ex. |
| 306 | D | AL | 80 | 25 | D | Yes | — | Comp. Ex. |
| 307 | D | AL | 80 | 40 | D | Yes | — | Comp. Ex. |
| 308 | D | GI | 80 | −20 | D | Yes | — | Comp. Ex. |
| 309 | D | GA | 80 | −20 | D | Yes | — | Comp. Ex. |
| 310 | E | CR | 80 | −40 | D | Yes | — | Comp. Ex. |
| 311 | E | CR | 80 | −20 | D | Yes | — | Comp. Ex. |

TABLE 13-continued

| Ex. no. | Steel type | Plating type | H am't (%) | Dew point (° C.) | Work method | Cracks | Hardness drop | Class |
|---|---|---|---|---|---|---|---|---|
| 312 | E | CR | 80 | 0 | D | Yes | — | Comp. Ex. |
| 313 | E | CR | 80 | 5 | D | Yes | — | Comp. Ex. |
| 314 | E | CR | 80 | 15 | D | Yes | — | Comp. Ex. |
| 315 | E | CR | 80 | 25 | D | Yes | — | Comp. Ex. |
| 316 | E | CR | 80 | 40 | D | Yes | — | Comp. Ex. |
| 317 | E | AL | 80 | −40 | D | Yes | — | Comp. Ex. |
| 318 | E | AL | 80 | −20 | D | Yes | — | Comp. Ex. |
| 319 | E | AL | 80 | 0 | D | Yes | — | Comp. Ex. |
| 320 | E | AL | 80 | 5 | D | Yes | — | Comp. Ex. |
| 321 | E | AL | 80 | 15 | D | Yes | — | Comp. Ex. |
| 322 | E | AL | 80 | 25 | D | Yes | — | Comp. Ex. |
| 323 | E | AL | 80 | 40 | D | Yes | — | Comp. Ex. |
| 324 | E | GI | 80 | −20 | D | Yes | — | Comp. Ex. |
| 325 | E | GA | 80 | −20 | D | Yes | — | Comp. Ex. |
| 326 | C | CR | 40 | −40 | D | Yes | — | Comp. Ex. |
| 327 | C | CR | 40 | 0 | D | Yes | — | Comp. Ex. |
| 328 | C | CR | 40 | 15 | D | Yes | — | Comp. Ex. |
| 329 | C | CR | 40 | 40 | D | Yes | — | Comp. Ex. |
| 330 | D | CR | 40 | −40 | D | Yes | — | Comp. Ex. |
| 331 | D | CR | 40 | 0 | D | Yes | — | Comp. Ex. |
| 332 | D | CR | 40 | 15 | D | Yes | — | Comp. Ex. |
| 333 | D | CR | 40 | 40 | D | Yes | — | Comp. Ex. |
| 334 | E | CR | 40 | −40 | D | Yes | — | Comp. Ex. |
| 335 | E | CR | 40 | 0 | D | Yes | — | Comp. Ex. |
| 336 | E | CR | 40 | 15 | D | Yes | — | Comp. Ex. |
| 337 | E | CR | 40 | 40 | D | Yes | — | Comp. Ex. |
| 338 | C | CR | 8 | −40 | D | None | — | Inv. range |
| 339 | C | CR | 8 | −20 | D | None | — | Inv. range |
| 340 | C | CR | 8 | 0 | D | None | — | Inv. range |
| 341 | C | CR | 8 | 5 | D | None | — | Inv. range |
| 342 | C | CR | 8 | 15 | D | None | — | Inv. range |
| 343 | C | CR | 8 | 25 | D | None | — | Inv. range |
| 344 | C | CR | 8 | 40 | D | Yes | — | Comp. Ex. |
| 345 | D | CR | 8 | −40 | D | None | — | Inv. range |
| 346 | D | CR | 8 | −20 | D | None | — | Inv. range |
| 347 | D | CR | 8 | 0 | D | None | — | Inv. range |
| 348 | D | CR | 8 | 5 | D | None | — | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 349 | D | CR | 8 | 15 | D | None | — | Inv. range |
| 350 | D | CR | 8 | 25 | D | None | — | Inv. range |
| 351 | D | CR | 8 | 40 | D | Yes | — | Comp. Ex. |
| 352 | E | CR | 8 | −40 | D | None | — | Inv. range |
| 353 | E | CR | 8 | −20 | D | None | — | Inv. range |
| 354 | E | CR | 8 | 0 | D | None | — | Inv. range |
| 355 | E | CR | 8 | 5 | D | None | — | Inv. range |
| 356 | E | CR | 8 | 15 | D | None | — | Inv. range |
| 357 | E | CR | 8 | 25 | D | None | — | Inv. range |
| 358 | E | CR | 8 | 40 | D | Yes | — | Comp. Ex. |
| 359 | C | CR | 4 | −40 | D | None | — | Inv. range |
| 360 | C | CR | 4 | 0 | D | None | — | Inv. range |
| 361 | C | CR | 4 | 15 | D | None | — | Inv. range |
| 362 | C | CR | 4 | 40 | D | Yes | — | Comp. Ex. |
| 363 | D | CR | 4 | −40 | D | None | — | Inv. range |
| 364 | D | CR | 4 | 0 | D | None | — | Inv. range |
| 365 | D | CR | 4 | 15 | D | None | — | Inv. range |
| 366 | D | CR | 4 | 40 | D | Yes | — | Comp. Ex. |
| 367 | E | CR | 4 | −40 | D | None | — | Inv. range |
| 368 | E | CR | 4 | 0 | D | None | — | Inv. range |
| 369 | E | CR | 4 | 15 | D | None | — | Inv. range |
| 370 | E | CR | 4 | 40 | D | Yes | — | Comp. Ex. |
| 371 | C | CR | 2 | −40 | D | None | — | Inv. range |
| 372 | C | CR | 2 | −20 | D | None | — | Inv. range |
| 373 | C | CR | 2 | 0 | D | None | — | Inv. range |
| 374 | C | CR | 2 | 5 | D | None | — | Inv. range |
| 375 | C | CR | 2 | 15 | D | None | — | Inv. range |
| 376 | C | CR | 2 | 25 | D | None | — | Inv. range |
| 377 | C | CR | 2 | 40 | D | Yes | — | Comp. Ex. |
| 378 | C | AL | 2 | −40 | D | None | — | Inv. range |
| 379 | C | AL | 2 | −20 | D | None | — | Inv. range |
| 380 | C | AL | 2 | 0 | D | None | — | Inv. range |
| 381 | C | AL | 2 | 5 | D | None | — | Inv. range |
| 382 | C | AL | 2 | 15 | D | None | — | Inv. range |
| 383 | C | AL | 2 | 25 | D | None | — | Inv. range |
| 384 | C | AL | 2 | 40 | D | Yes | — | Comp. Ex. |
| 385 | C | GI | 2 | 15 | D | None | — | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 386 | C | GA | 2 | 15 | D | None | — | Inv. range |
| 387 | D | CR | 2 | −40 | D | None | — | Inv. range |
| 388 | D | CR | 2 | −20 | D | None | — | Inv. range |
| 389 | D | CR | 2 | 0 | D | None | — | Inv. range |
| 390 | D | CR | 2 | 5 | D | None | — | Inv. range |
| 391 | D | CR | 2 | 15 | D | None | — | Inv. range |
| 392 | D | CR | 2 | 25 | D | None | — | Inv. range |
| 393 | D | CR | 2 | 40 | D | Yes | — | Comp. Ex. |
| 394 | D | AL | 2 | −40 | D | None | — | Inv. range |
| 395 | D | AL | 2 | −20 | D | None | — | Inv. range |
| 396 | D | AL | 2 | 0 | D | None | — | Inv. range |
| 397 | D | AL | 2 | 5 | D | None | — | Inv. range |
| 398 | D | AL | 2 | 15 | D | None | — | Inv. range |
| 399 | D | AL | 2 | 25 | D | None | — | Inv. range |
| 400 | D | AL | 2 | 40 | D | Yes | — | Comp. Ex. |
| | | | | (Part 5) | | | | |
| 401 | D | GI | 2 | 15 | D | None | — | Inv. range |
| 402 | D | GA | 2 | 15 | D | None | — | Inv. range |
| 403 | E | CR | 2 | −40 | D | None | — | Inv. range |
| 404 | E | CR | 2 | −20 | D | None | — | Inv. range |
| 405 | E | CR | 2 | 0 | D | None | — | Inv. range |
| 406 | E | CR | 2 | 5 | D | None | — | Inv. range |
| 407 | E | CR | 2 | 15 | D | None | — | Inv. range |
| 408 | E | CR | 2 | 25 | D | None | — | Inv. range |
| 409 | E | CR | 2 | 40 | D | Yes | — | Comp. Ex. |
| 410 | E | AL | 2 | −40 | D | None | — | Inv. range |
| 411 | E | AL | 2 | −20 | D | None | — | Inv. range |
| 412 | E | AL | 2 | 0 | D | None | — | Inv. range |
| 413 | E | AL | 2 | 5 | D | None | — | Inv. range |
| 414 | E | AL | 2 | 15 | D | None | — | Inv. range |
| 415 | E | AL | 2 | 25 | D | None | — | Inv. range |
| 416 | E | AL | 2 | 40 | D | Yes | — | Comp. Ex. |
| 417 | E | GI | 2 | 15 | D | None | — | Inv. range |
| 418 | E | GA | 2 | 15 | D | None | — | Inv. range |
| 419 | C | CR | 0.5 | −40 | D | None | — | Inv. range |
| 420 | C | CR | 0.5 | 0 | D | None | — | Inv. range |
| 421 | C | CR | 0.5 | 15 | D | None | — | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 422 | C | CR | 0.5 | 40 | D | Yes | — | Comp. Ex. |
| 423 | D | CR | 0.5 | −40 | D | None | — | Inv. range |
| 424 | D | CR | 0.5 | 0 | D | None | — | Inv. range |
| 425 | D | CR | 0.5 | 15 | D | None | — | Inv. range |
| 426 | D | CR | 0.5 | 40 | D | Yes | — | Comp. Ex. |
| 427 | E | CR | 0.5 | −40 | D | None | — | Inv. range |
| 428 | E | CR | 0.5 | 0 | D | None | — | Inv. range |
| 429 | E | CR | 0.5 | 15 | D | None | — | Inv. range |
| 430 | E | CR | 0.5 | 40 | D | Yes | — | Comp. Ex. |
| 431 | C | CR | 0.1 | −40 | D | None | — | Inv. range |
| 432 | C | CR | 0.1 | −20 | D | None | — | Inv. range |
| 433 | C | CR | 0.1 | 0 | D | None | — | Inv. range |
| 434 | C | CR | 0.1 | 5 | D | None | — | Inv. range |
| 435 | C | CR | 0.1 | 15 | D | None | — | Inv. range |
| 436 | C | CR | 0.1 | 25 | D | None | — | Inv. range |
| 437 | C | CR | 0.1 | 40 | D | Yes | — | Comp. Ex. |
| 438 | C | AL | 0.1 | −40 | D | None | — | Inv. range |
| 439 | C | AL | 0.1 | −20 | D | None | — | Inv. range |
| 440 | C | AL | 0.1 | 0 | D | None | — | Inv. range |
| 441 | C | AL | 0.1 | 5 | D | None | — | Inv. range |
| 442 | C | AL | 0.1 | 15 | D | None | — | Inv. range |
| 443 | C | AL | 0.1 | 25 | D | None | — | Inv. range |
| 444 | C | AL | 0.1 | 40 | D | Yes | — | Comp. Ex. |
| 445 | C | GI | 0.1 | 15 | D | None | — | Inv. range |
| 446 | C | GA | 0.1 | 15 | D | None | — | Inv. range |
| 447 | D | CR | 0.1 | −40 | D | None | — | Inv. range |
| 448 | D | CR | 0.1 | −20 | D | None | — | Inv. range |
| 449 | D | CR | 0.1 | 0 | D | None | — | Inv. range |
| 450 | D | CR | 0.1 | 5 | D | None | — | Inv. range |
| 451 | D | CR | 0.1 | 15 | D | None | — | Inv. range |
| 452 | D | CR | 0.1 | 25 | D | None | — | Inv. range |
| 453 | D | CR | 0.1 | 40 | D | Yes | — | Comp. Ex. |
| 454 | D | AL | 0.1 | −40 | D | None | — | Inv. range |
| 455 | D | AL | 0.1 | −20 | D | None | — | Inv. range |
| 456 | D | AL | 0.1 | 0 | D | None | — | Inv. range |
| 457 | D | AL | 0.1 | 5 | D | None | — | Inv. range |
| 458 | D | AL | 0.1 | 15 | D | None | — | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 459 | D | AL | 0.1 | 25 | D | None | — | Inv. range |
| 460 | D | AL | 0.1 | 40 | D | Yes | — | Comp. Ex. |
| 461 | D | GI | 0.1 | 15 | D | None | — | Inv. range |
| 462 | D | GA | 0.1 | 15 | D | None | — | Inv. range |
| 463 | E | CR | 0.1 | −40 | D | None | — | Inv. range |
| 464 | E | CR | 0.1 | −20 | D | None | — | Inv. range |
| 465 | E | CR | 0.1 | 0 | D | None | — | Inv. range |
| 466 | E | CR | 0.1 | 5 | D | None | — | Inv. range |
| 467 | E | CR | 0.1 | 15 | D | None | — | Inv. range |
| 468 | E | CR | 0.1 | 25 | D | None | — | Inv. range |
| 469 | E | CR | 0.1 | 40 | D | Yes | — | Comp. Ex. |
| 470 | E | AL | 0.1 | −40 | D | None | — | Inv. range |
| 471 | E | AL | 0.1 | −20 | D | None | — | Inv. range |
| 472 | E | AL | 0.1 | 0 | D | None | — | Inv. range |
| 473 | E | AL | 0.1 | 5 | D | None | — | Inv. range |
| 474 | E | AL | 0.1 | 15 | D | None | — | Inv. range |
| 475 | E | AL | 0.1 | 25 | D | None | — | Inv. range |
| 476 | E | AL | 0.1 | 40 | D | Yes | — | Comp. Ex. |
| 477 | E | GI | 0.1 | 15 | D | None | — | Inv. range |
| 478 | E | GA | 0.1 | 15 | D | None | — | Inv. range |
| 479 | C | CR | 0.05 | −20 | D | None | — | Inv. range |
| 480 | C | CR | 0.05 | −40 | D | None | — | Inv. range |
| 481 | C | CR | 0.05 | −20 | D | None | — | Inv. range |
| 482 | C | CR | 0.05 | 0 | D | None | — | Inv. range |
| 483 | C | CR | 0.05 | 5 | D | None | — | Inv. range |
| 484 | C | CR | 0.05 | 15 | D | None | — | Inv. range |
| 485 | C | CR | 0.05 | 25 | D | None | — | Inv. range |
| 486 | C | CR | 0.05 | 40 | D | Yes | — | Comp. Ex. |
| 487 | D | CR | 0.05 | −20 | D | None | — | Inv. range |
| 488 | D | CR | 0.05 | −40 | D | None | — | Inv. range |
| 489 | D | CR | 0.05 | −20 | D | None | — | Inv. range |
| 490 | D | CR | 0.05 | 0 | D | None | — | Inv. range |
| 491 | D | CR | 0.05 | 5 | D | None | — | Inv. range |
| 492 | D | CR | 0.05 | 15 | D | None | — | Inv. range |
| 493 | D | CR | 0.05 | 25 | D | None | — | Inv. range |
| 494 | D | CR | 0.05 | 40 | D | Yes | — | Comp. Ex. |
| 495 | E | CR | 0.05 | −20 | D | None | — | Inv. range |

TABLE 13-continued

| Ex. no. | Steel type | Plating type | H am't (%) | Dew point (° C.) | Work method | Cracks | Hardness drop | Class |
|---|---|---|---|---|---|---|---|---|
| 496 | E | CR | 0.05 | −40 | D | None | — | Inv. range |
| 497 | E | CR | 0.05 | −20 | D | None | — | Inv. range |
| 498 | E | CR | 0.05 | 0 | D | None | — | Inv. range |
| 499 | E | CR | 0.05 | 5 | D | None | — | Inv. range |
| 500 | E | CR | 0.05 | 15 | D | None | — | Inv. range |
| (Part 6) | | | | | | | | |
| 501 | E | CR | 0.05 | 25 | D | None | — | Inv. range |
| 502 | E | CR | 0.05 | 40 | D | Yes | — | Comp. Ex. |
| 503 | C | CR | 0.01 | −40 | D | None | — | Inv. range |
| 504 | C | CR | 0.01 | 0 | D | None | — | Inv. range |
| 505 | C | CR | 0.01 | 15 | D | None | — | Inv. range |
| 506 | C | CR | 0.01 | 40 | D | Yes | — | Comp. Ex. |
| 507 | D | CR | 0.01 | −40 | D | None | — | Inv. range |
| 508 | D | CR | 0.01 | 0 | D | None | — | Inv. range |
| 509 | D | CR | 0.01 | 15 | D | None | — | Inv. range |
| 510 | D | CR | 0.01 | 40 | D | Yes | — | Comp. Ex. |
| 511 | E | CR | 0.01 | −40 | D | None | — | Inv. range |
| 512 | E | CR | 0.01 | 0 | D | None | — | Inv. range |
| 513 | E | CR | 0.01 | 15 | D | None | — | Inv. range |
| 514 | E | CR | 0.01 | 40 | D | Yes | — | Comp. Ex. |
| 515 | C | CR | 0.005 | −40 | D | None | — | Inv. range |
| 516 | C | CR | 0.005 | 0 | D | None | — | Inv. range |
| 517 | C | CR | 0.005 | 15 | D | None | — | Inv. range |
| 518 | C | CR | 0.005 | 40 | D | Yes | — | Comp. Ex. |
| 519 | D | CR | 0.005 | −40 | D | None | — | Inv. range |
| 520 | D | CR | 0.005 | 0 | D | None | — | Inv. range |
| 521 | D | CR | 0.005 | 15 | D | None | — | Inv. range |
| 522 | D | CR | 0.005 | 40 | D | Yes | — | Comp. Ex. |
| 523 | E | CR | 0.005 | −40 | D | None | — | Inv. range |
| 524 | E | CR | 0.005 | 0 | D | None | — | Inv. range |
| 525 | E | CR | 0.005 | 15 | D | None | — | Inv. range |
| 526 | E | CR | 0.005 | 40 | D | Yes | — | Comp. Ex. |
| 527 | D | CR | 80 | −40 | S | Yes | — | Comp. Ex. |
| 528 | D | CR | 80 | −20 | S | Yes | — | Comp. Ex. |
| 529 | D | CR | 80 | 0 | S | Yes | — | Comp. Ex. |
| 530 | D | CR | 80 | 5 | S | Yes | — | Comp. Ex. |
| 531 | D | CR | 80 | 15 | S | Yes | — | Comp. Ex. |

TABLE 13-continued

| Ex. no. | Steel type | Plating type | H am't (%) | Dew point (° C.) | Work me-thod | Cracks | Hard-ness drop | Class |
|---|---|---|---|---|---|---|---|---|
| 532 | D | CR | 80 | 25 | S | Yes | — | Comp. Ex. |
| 533 | D | CR | 80 | 40 | S | Yes | — | Comp. Ex. |
| 534 | D | AL | 80 | −40 | S | Yes | — | Comp. Ex. |
| 535 | D | AL | 80 | −20 | S | Yes | — | Comp. Ex. |
| 536 | D | AL | 80 | 0 | S | Yes | — | Comp. Ex. |
| 537 | D | AL | 80 | 5 | S | Yes | — | Comp. Ex. |
| 538 | D | AL | 80 | 15 | S | Yes | — | Comp. Ex. |
| 539 | D | AL | 80 | 25 | S | Yes | — | Comp. Ex. |
| 540 | D | AL | 80 | 40 | S | Yes | — | Comp. Ex. |
| 541 | D | CR | 8 | −40 | S | None | — | Inv. range |
| 542 | D | CR | 8 | −20 | S | None | — | Inv. range |
| 543 | D | CR | 8 | 0 | S | None | — | Inv. range |
| 544 | D | CR | 8 | 5 | S | None | — | Inv. range |
| 545 | D | CR | 8 | 15 | S | None | — | Inv. range |
| 546 | D | CR | 8 | 25 | S | None | — | Inv. range |
| 547 | D | CR | 8 | 40 | S | Yes | — | Comp. Ex. |
| 548 | D | AL | 8 | −40 | S | None | — | Inv. range |
| 549 | D | AL | 8 | −20 | S | None | — | Inv. range |
| 550 | D | AL | 8 | 0 | S | None | — | Inv. range |
| 551 | D | AL | 8 | 5 | S | None | — | Inv. range |
| 552 | D | AL | 8 | 15 | S | None | — | Inv. range |
| 553 | D | AL | 8 | 25 | S | None | — | Inv. range |
| 554 | D | AL | 8 | 40 | S | Yes | — | Comp. Ex. |
| 555 | D | AL | 8 | 5 | S | None | — | Inv. range |
| 556 | D | AL | 8 | 15 | S | None | — | Inv. range |
| 557 | D | AL | 8 | 25 | S | None | — | Inv. range |
| 558 | D | AL | 8 | 40 | S | Yes | — | Comp. Ex. |
| 559 | D | CR | 0.005 | 15 | L | None | VG | Inv. range |
| 560 | D | CR | 0.005 | 15 | P | None | G | Inv. range |
| 561 | D | CR | 0.005 | 15 | G | None | x | Inv. range |
| 562 | D | AL | 2 | 15 | L | None | VG | Inv. range |
| 563 | D | AL | 2 | 15 | P | None | G | Inv. range |
| 564 | D | AL | 2 | 15 | G | None | x | Inv. range |

Example 8

Steel slabs having the chemical compositions shown in Table 4 were cast. These slabs were heated to 1050 to 1350° C. and hot rolled at a finishing temperature of 800 to 900° C. and a coiling temperature of 450 to 680° C. to obtain hot rolled steel sheets having a thickness of 4 mm. The steel sheets were then pickled and cold rolled to obtain cold rolled steel sheets having a thickness of 1.6 mm. Further, parts of the cold rolled plates were treated by hot dip aluminum coating, hot dip aluminum-zinc coating, alloying hot dip galvanization, and/or hot dip galvanization. Table 5 shows the legends for the plating types used. These cold rolled steel sheets and surface treated steel sheets were heated in a furnace to a temperature higher than the Ac3 point, that is, to 950° C. which is in the austenite region, then hot shaped. The atmosphere of the heating furnace was varied with respect to the amount of hydrogen and the dew point. The conditions used are shown in Table 14.

A cross-section of an exemplary shape of the mold is shown in FIG. 14. The legend in FIG. 14 is shown here (1: die, 2: punch). The shape of the punch as seen from above is shown in FIG. 15. The legend in FIG. 15 is shown here (2: punch). The exemplary shape of the die as seen from below is shown in FIG. 16. The legend in FIG. 16 is shown here (1: die). The mold followed the shape of the punch. The shape of the die was determined by providing a clearance having a thickness of 1.6 mm. The blank size (in mm) was 1.6 (thickness)×300×500. The shaping conditions include a punch speed of 10 mm/s, a pressing force of 200 tons, and a holding time at bottom dead center of 5 seconds. A schematic view of the exemplary shaped part is shown in FIG. 17. Based on a tensile test piece cut out from the shaped part, the tensile strength of the shaped part was observed to be 1470 MPa or more.

Shearing was performed by piercing. The position shown in FIG. 18 was pierced using a punch having a diameter of 10 mm and a die having a diameter of 10.5 mm. FIG. 5 shows the shape of the part as seen from above. The legend in FIG. 18 is shown therein (1: part, 2: center of pierce hole). The piercing was performed within 30 minutes after the hot shaping. After piercing, reaming was performed. The working method is shown together in Table 14. In the legend, reaming is indicated by "R", while no working is indicated by "N". The finished hole diameter was then changed and the effect on the thickness removed was studied. The conditions used are shown together in Table 14. The reaming was performed within 30 minutes after the piercing. Resistance to hydrogen embrittlement was evaluated one week after reaming by observing the entire circumference of the hole to evaluate the presence of cracking. The observation was performed by a loupe or an electron microscope. The results of these evaluations are shown together in Table 4.

Experiment Nos. 1 to 277 show results for reaming based on steel type, plating type, concentration of hydrogen in the atmosphere, and dew point. No cracks occurred after the piercing in samples processed in accordance with exemplary embodiments of the present invention. Experiment Nos. 278 to 289 show the effects of the amount of working. Again, no cracks occurred after the piercing in samples processed in accordance with exemplary embodiments of the present invention.

TABLE 14

| Ex. no. | Steel type | Plating type | H am't (%) | Dew point (° C.) | Work me-thod | Work am't (mm) | Cracks | Class |
|---|---|---|---|---|---|---|---|---|
| (Part 1) | | | | | | | | |
| 1 | C | CR | 80 | −40 | R | 0.1 | Yes | Comp. Ex. |
| 2 | C | CR | 80 | −20 | R | 0.1 | Yes | Comp. Ex. |

TABLE 14-continued

| Ex. no. | Steel type | Plating type | H am't (%) | Dew point (° C.) | Work me-thod | Work am't (mm) | Cracks | Class |
|---|---|---|---|---|---|---|---|---|
| 3 | C | CR | 80 | 0 | R | 0.1 | Yes | Comp. Ex. |
| 4 | C | CR | 80 | 5 | R | 0.1 | Yes | Comp. Ex. |
| 5 | C | CR | 80 | 15 | R | 0.1 | Yes | Comp. Ex. |
| 6 | C | CR | 80 | 25 | R | 0.1 | Yes | Comp. Ex. |
| 7 | C | CR | 80 | 40 | R | 0.1 | Yes | Comp. Ex. |
| 8 | C | AL | 80 | −40 | R | 0.1 | Yes | Comp. Ex. |
| 9 | C | AL | 80 | −20 | R | 0.1 | Yes | Comp. Ex. |
| 10 | C | AL | 80 | 0 | R | 0.1 | Yes | Comp. Ex. |
| 11 | C | AL | 80 | 5 | R | 0.1 | Yes | Comp. Ex. |
| 12 | C | AL | 80 | 15 | R | 0.1 | Yes | Comp. Ex. |
| 13 | C | AL | 80 | 25 | R | 0.1 | Yes | Comp. Ex. |
| 14 | C | AL | 80 | 40 | R | 0.1 | Yes | Comp. Ex. |
| 15 | C | GI | 80 | −20 | R | 0.1 | Yes | Comp. Ex. |
| 16 | C | GA | 80 | −20 | R | 0.1 | Yes | Comp. Ex. |
| 17 | D | CR | 80 | −40 | R | 0.1 | Yes | Comp. Ex. |
| 18 | D | CR | 80 | −20 | R | 0.1 | Yes | Comp. Ex. |
| 19 | D | CR | 80 | 0 | R | 0.1 | Yes | Comp. Ex. |
| 20 | D | CR | 80 | 5 | R | 0.1 | Yes | Comp. Ex. |
| 21 | D | CR | 80 | 15 | R | 0.1 | Yes | Comp. Ex. |
| 22 | D | CR | 80 | 25 | R | 0.1 | Yes | Comp. Ex. |
| 23 | D | CR | 80 | 40 | R | 0.1 | Yes | Comp. Ex. |
| 24 | D | AL | 80 | −40 | R | 0.1 | Yes | Comp. Ex. |
| 25 | D | AL | 80 | −20 | R | 0.1 | Yes | Comp. Ex. |
| 26 | D | AL | 80 | 0 | R | 0.1 | Yes | Comp. Ex. |
| 27 | D | AL | 80 | 5 | R | 0.1 | Yes | Comp. Ex. |
| 28 | D | AL | 80 | 15 | R | 0.1 | Yes | Comp. Ex. |
| 29 | D | AL | 80 | 25 | R | 0.1 | Yes | Comp. Ex. |
| 30 | D | AL | 80 | 40 | R | 0.1 | Yes | Comp. Ex. |
| 31 | D | GI | 80 | −20 | R | 0.1 | Yes | Comp. Ex. |
| 32 | D | GA | 80 | −20 | R | 0.1 | Yes | Comp. Ex. |
| 33 | E | CR | 80 | −40 | R | 0.1 | Yes | Comp. Ex. |
| 34 | E | CR | 80 | −20 | R | 0.1 | Yes | Comp. Ex. |
| 35 | E | CR | 80 | 0 | R | 0.1 | Yes | Comp. Ex. |
| 36 | E | CR | 80 | 5 | R | 0.1 | Yes | Comp. Ex. |
| 37 | E | CR | 80 | 15 | R | 0.1 | Yes | Comp. Ex. |
| 38 | E | CR | 80 | 25 | R | 0.1 | Yes | Comp. Ex. |
| 39 | E | CR | 80 | 40 | R | 0.1 | Yes | Comp. Ex. |

TABLE 14-continued

| Ex. no. | Steel type | Plating type | H am't (%) | Dew point (° C.) | Work me-thod | Work am't (mm) | Cracks | Class |
|---|---|---|---|---|---|---|---|---|
| 40 | E | AL | 80 | −40 | R | 0.1 | Yes | Comp. Ex. |
| 41 | E | AL | 80 | −20 | R | 0.1 | Yes | Comp. Ex. |
| 42 | E | AL | 80 | 0 | R | 0.1 | Yes | Comp. Ex. |
| 43 | E | AL | 80 | 5 | R | 0.1 | Yes | Comp. Ex. |
| 44 | E | AL | 80 | 15 | R | 0.1 | Yes | Comp. Ex. |
| 45 | E | AL | 80 | 25 | R | 0.1 | Yes | Comp. Ex. |
| 46 | E | AL | 80 | 40 | R | 0.1 | Yes | Comp. Ex. |
| 47 | E | GI | 80 | −20 | R | 0.1 | Yes | Comp. Ex. |
| 48 | E | GA | 80 | −20 | R | 0.1 | Yes | Comp. Ex. |
| 49 | C | CR | 40 | −40 | R | 0.1 | Yes | Comp. Ex. |
| 50 | C | CR | 40 | 0 | R | 0.1 | Yes | Comp. Ex. |
| 51 | C | CR | 40 | 15 | R | 0.1 | Yes | Comp. Ex. |
| 52 | C | CR | 40 | 40 | R | 0.1 | Yes | Comp. Ex. |
| 53 | D | CR | 40 | −40 | R | 0.1 | Yes | Comp. Ex. |
| 54 | D | CR | 40 | 0 | R | 0.1 | Yes | Comp. Ex. |
| 55 | D | CR | 40 | 15 | R | 0.1 | Yes | Comp. Ex. |
| 56 | D | CR | 40 | 40 | R | 0.1 | Yes | Comp. Ex. |
| 57 | E | CR | 40 | −40 | R | 0.1 | Yes | Comp. Ex. |
| 58 | E | CR | 40 | 0 | R | 0.1 | Yes | Comp. Ex. |
| 59 | E | CR | 40 | 15 | R | 0.1 | Yes | Comp. Ex. |
| 60 | E | CR | 40 | 40 | R | 0.1 | Yes | Comp. Ex. |
| 61 | C | CR | 8 | −40 | R | 0.1 | None | Inv. range |
| 62 | C | CR | 8 | −20 | R | 0.1 | None | Inv. range |
| 63 | C | CR | 8 | 0 | R | 0.1 | None | Inv. range |
| 64 | C | CR | 8 | 5 | R | 0.1 | None | Inv. range |
| 65 | C | CR | 8 | 15 | R | 0.1 | None | Inv. range |
| 66 | C | CR | 8 | 25 | R | 0.1 | None | Inv. range |
| 67 | C | CR | 8 | 40 | R | 0.1 | Yes | Comp. Ex. |
| 68 | D | CR | 8 | −40 | R | 0.1 | None | Inv. range |
| 69 | D | CR | 8 | −20 | R | 0.1 | None | Inv. range |
| 70 | D | CR | 8 | 0 | R | 0.1 | None | Inv. range |
| 71 | D | CR | 8 | 5 | R | 0.1 | None | Inv. range |
| 72 | D | CR | 8 | 15 | R | 0.1 | None | Inv. range |
| 73 | D | CR | 8 | 25 | R | 0.1 | None | Inv. range |
| 74 | D | CR | 8 | 40 | R | 0.1 | Yes | Comp. Ex. |
| 75 | E | CR | 8 | −40 | R | 0.1 | None | Inv. range |
| 76 | E | CR | 8 | −20 | R | 0.1 | None | Inv. range |

TABLE 14-continued

| Ex. no. | Steel type | Plating type | H am't (%) | Dew point (° C.) | Work me-thod | Work am't (mm) | Cracks | Class |
|---|---|---|---|---|---|---|---|---|
| 77 | E | CR | 8 | 0 | R | 0.1 | None | Inv. range |
| 78 | E | CR | 8 | 5 | R | 0.1 | None | Inv. range |
| 79 | E | CR | 8 | 15 | R | 0.1 | None | Inv. range |
| 80 | E | CR | 8 | 25 | R | 0.1 | None | Inv. range |
| 81 | E | CR | 8 | 40 | R | 0.1 | Yes | Comp. Ex. |
| 82 | C | CR | 4 | −40 | R | 0.1 | None | Inv. range |
| 83 | C | CR | 4 | 0 | R | 0.1 | None | Inv. range |
| 84 | C | CR | 4 | 15 | R | 0.1 | None | Inv. range |
| 85 | C | CR | 4 | 40 | R | 0.1 | Yes | Comp. Ex. |
| 86 | D | CR | 4 | −40 | R | 0.1 | None | Inv. range |
| 87 | D | CR | 4 | 0 | R | 0.1 | None | Inv. range |
| 88 | D | CR | 4 | 15 | R | 0.1 | None | Inv. range |
| 89 | D | CR | 4 | 40 | R | 0.1 | Yes | Comp. Ex. |
| 90 | E | CR | 4 | −40 | R | 0.1 | None | Inv. range |
| 91 | E | CR | 4 | 0 | R | 0.1 | None | Inv. range |
| 92 | E | CR | 4 | 15 | R | 0.1 | None | Inv. range |
| 93 | E | CR | 4 | 40 | R | 0.1 | Yes | Comp. Ex. |
| 94 | C | CR | 2 | −40 | R | 0.1 | None | Inv. range |
| 95 | C | CR | 2 | −20 | R | 0.1 | None | Inv. range |
| 96 | C | CR | 2 | 0 | R | 0.1 | None | Inv. range |
| 97 | C | CR | 2 | 5 | R | 0.1 | None | Inv. range |
| 98 | C | CR | 2 | 15 | R | 0.1 | None | Inv. range |
| 99 | C | CR | 2 | 25 | R | 0.1 | None | Inv. range |
| 100 | C | CR | 2 | 40 | R | 0.1 | Yes | Comp. Ex. |
| | | | | (Part 2) | | | | |
| 101 | C | AL | 2 | −40 | R | 0.1 | None | Inv. range |
| 102 | C | AL | 2 | −20 | R | 0.1 | None | Inv. range |
| 103 | C | AL | 2 | 0 | R | 0.1 | None | Inv. range |
| 104 | C | AL | 2 | 5 | R | 0.1 | None | Inv. range |
| 105 | C | AL | 2 | 15 | R | 0.1 | None | Inv. range |
| 106 | C | AL | 2 | 25 | R | 0.1 | None | Inv. range |
| 107 | C | AL | 2 | 40 | R | 0.1 | Yes | Comp. Ex. |
| 108 | C | GI | 2 | 15 | R | 0.1 | None | Inv. range |
| 109 | C | GA | 2 | 15 | R | 0.1 | None | Inv. range |
| 110 | D | CR | 2 | −40 | R | 0.1 | None | Inv. range |
| 111 | D | CR | 2 | −20 | R | 0.1 | None | Inv. range |
| 112 | D | CR | 2 | 0 | R | 0.1 | None | Inv. range |

TABLE 14-continued

| Ex. no. | Steel type | Plating type | H am't (%) | Dew point (° C.) | Work me-thod | Work am't (mm) | Cracks | Class |
|---|---|---|---|---|---|---|---|---|
| 113 | D | CR | 2 | 5 | R | 0.1 | None | Inv. range |
| 114 | D | CR | 2 | 15 | R | 0.1 | None | Inv. range |
| 115 | D | CR | 2 | 25 | R | 0.1 | None | Inv. range |
| 116 | D | CR | 2 | 40 | R | 0.1 | Yes | Comp. Ex. |
| 117 | D | AL | 2 | −40 | R | 0.1 | None | Inv. range |
| 118 | D | AL | 2 | −20 | R | 0.1 | None | Inv. range |
| 119 | D | AL | 2 | 0 | R | 0.1 | None | Inv. range |
| 120 | D | AL | 2 | 5 | R | 0.1 | None | Inv. range |
| 121 | D | AL | 2 | 15 | R | 0.1 | None | Inv. range |
| 122 | D | AL | 2 | 25 | R | 0.1 | None | Inv. range |
| 123 | D | AL | 2 | 40 | R | 0.1 | Yes | Comp. Ex. |
| 124 | D | GI | 2 | 15 | R | 0.1 | None | Inv. range |
| 125 | D | GA | 2 | 15 | R | 0.1 | None | Inv. range |
| 126 | E | CR | 2 | −40 | R | 0.1 | None | Inv. range |
| 127 | E | CR | 2 | −20 | R | 0.1 | None | Inv. range |
| 128 | E | CR | 2 | 0 | R | 0.1 | None | Inv. range |
| 129 | E | CR | 2 | 5 | R | 0.1 | None | Inv. range |
| 130 | E | CR | 2 | 15 | R | 0.1 | None | Inv. range |
| 131 | E | CR | 2 | 25 | R | 0.1 | None | Inv. range |
| 132 | E | CR | 2 | 40 | R | 0.1 | Yes | Comp. Ex. |
| 133 | E | AL | 2 | −40 | R | 0.1 | None | Inv. range |
| 134 | E | AL | 2 | −20 | R | 0.1 | None | Inv. range |
| 135 | E | AL | 2 | 0 | R | 0.1 | None | Inv. range |
| 136 | E | AL | 2 | 5 | R | 0.1 | None | Inv. range |
| 137 | E | AL | 2 | 15 | R | 0.1 | None | Inv. range |
| 138 | E | AL | 2 | 25 | R | 0.1 | None | Inv. range |
| 139 | E | AL | 2 | 40 | R | 0.1 | Yes | Comp. Ex. |
| 140 | E | GI | 2 | 15 | R | 0.1 | None | Inv. range |
| 141 | E | GA | 2 | 15 | R | 0.1 | None | Inv. range |
| 142 | C | CR | 0.5 | −40 | R | 0.1 | None | Inv. range |
| 143 | C | CR | 0.5 | 0 | R | 0.1 | None | Inv. range |
| 144 | C | CR | 0.5 | 15 | R | 0.1 | None | Inv. range |
| 145 | C | CR | 0.5 | 40 | R | 0.1 | Yes | Comp. Ex. |
| 146 | D | CR | 0.5 | −40 | R | 0.1 | None | Inv. range |
| 147 | D | CR | 0.5 | 0 | R | 0.1 | None | Inv. range |
| 148 | D | CR | 0.5 | 15 | R | 0.1 | None | Inv. range |
| 149 | D | CR | 0.5 | 40 | R | 0.1 | Yes | Comp. Ex. |

TABLE 14-continued

| Ex. no. | Steel type | Plating type | H am't (%) | Dew point (° C.) | Work me-thod | Work am't (mm) | Cracks | Class |
|---|---|---|---|---|---|---|---|---|
| 150 | E | CR | 0.5 | −40 | R | 0.1 | None | Inv. range |
| 151 | E | CR | 0.5 | 0 | R | 0.1 | None | Inv. range |
| 152 | E | CR | 0.5 | 15 | R | 0.1 | None | Inv. range |
| 153 | E | CR | 0.5 | 40 | R | 0.1 | Yes | Comp. Ex. |
| 154 | C | CR | 0.1 | −40 | R | 0.1 | None | Inv. range |
| 155 | C | CR | 0.1 | −20 | R | 0.1 | None | Inv. range |
| 156 | C | CR | 0.1 | 0 | R | 0.1 | None | Inv. range |
| 157 | C | CR | 0.1 | 5 | R | 0.1 | None | Inv. range |
| 158 | C | CR | 0.1 | 15 | R | 0.1 | None | Inv. range |
| 159 | C | CR | 0.1 | 25 | R | 0.1 | None | Inv. range |
| 160 | C | CR | 0.1 | 40 | R | 0.1 | Yes | Comp. Ex. |
| 161 | C | AL | 0.1 | −40 | R | 0.1 | None | Inv. range |
| 162 | C | AL | 0.1 | −20 | R | 0.1 | None | Inv. range |
| 163 | C | AL | 0.1 | 0 | R | 0.1 | None | Inv. range |
| 164 | C | AL | 0.1 | 5 | R | 0.1 | None | Inv. range |
| 165 | C | AL | 0.1 | 15 | R | 0.1 | None | Inv. range |
| 166 | C | AL | 0.1 | 25 | R | 0.1 | None | Inv. range |
| 167 | C | AL | 0.1 | 40 | R | 0.1 | Yes | Comp. Ex. |
| 168 | C | GI | 0.1 | 15 | R | 0.1 | None | Inv. range |
| 169 | C | GA | 0.1 | 15 | R | 0.1 | None | Inv. range |
| 170 | D | CR | 0.1 | −40 | R | 0.1 | None | Inv. range |
| 171 | D | CR | 0.1 | −20 | R | 0.1 | None | Inv. range |
| 172 | D | CR | 0.1 | 0 | R | 0.1 | None | Inv. range |
| 173 | D | CR | 0.1 | 5 | R | 0.1 | None | Inv. range |
| 174 | D | CR | 0.1 | 15 | R | 0.1 | None | Inv. range |
| 175 | D | CR | 0.1 | 25 | R | 0.1 | None | Inv. range |
| 176 | D | CR | 0.1 | 40 | R | 0.1 | Yes | Comp. Ex. |
| 177 | D | AL | 0.1 | −40 | R | 0.1 | None | Inv. range |
| 178 | D | AL | 0.1 | −20 | R | 0.1 | None | Inv. range |
| 179 | D | AL | 0.1 | 0 | R | 0.1 | None | Inv. range |
| 180 | D | AL | 0.1 | 5 | R | 0.1 | None | Inv. range |
| 181 | D | AL | 0.1 | 15 | R | 0.1 | None | Inv. range |
| 182 | D | AL | 0.1 | 25 | R | 0.1 | None | Inv. range |
| 183 | D | AL | 0.1 | 40 | R | 0.1 | Yes | Comp. Ex. |
| 184 | D | GI | 0.1 | 15 | R | 0.1 | None | Inv. range |
| 185 | D | GA | 0.1 | 15 | R | 0.1 | None | Inv. range |
| 186 | E | CR | 0.1 | −40 | R | 0.1 | None | Inv. range |

TABLE 14-continued

| Ex. no. | Steel type | Plating type | H am't (%) | Dew point (° C.) | Work me-thod | Work am't (mm) | Cracks | Class |
|---|---|---|---|---|---|---|---|---|
| 187 | E | CR | 0.1 | −20 | R | 0.1 | None | Inv. range |
| 188 | E | CR | 0.1 | 0 | R | 0.1 | None | Inv. range |
| 189 | E | CR | 0.1 | 5 | R | 0.1 | None | Inv. range |
| 190 | E | CR | 0.1 | 15 | R | 0.1 | None | Inv. range |
| 191 | E | CR | 0.1 | 25 | R | 0.1 | None | Inv. range |
| 192 | E | CR | 0.1 | 40 | R | 0.1 | Yes | Comp. Ex. |
| 193 | E | AL | 0.1 | −40 | R | 0.1 | None | Inv. range |
| 194 | E | AL | 0.1 | −20 | R | 0.1 | None | Inv. range |
| 195 | E | AL | 0.1 | 0 | R | 0.1 | None | Inv. range |
| 196 | E | AL | 0.1 | 5 | R | 0.1 | None | Inv. range |
| 197 | E | AL | 0.1 | 15 | R | 0.1 | None | Inv. range |
| 198 | E | AL | 0.1 | 25 | R | 0.1 | None | Inv. range |
| 199 | E | AL | 0.1 | 40 | R | 0.1 | Yes | Comp. Ex. |
| 200 | E | GI | 0.1 | 15 | R | 0.1 | None | Inv. range |

(Part 3)

| Ex. no. | Steel type | Plating type | H am't (%) | Dew point (° C.) | Work me-thod | Work am't (mm) | Cracks | Class |
|---|---|---|---|---|---|---|---|---|
| 201 | E | GA | 0.1 | 15 | R | 0.1 | None | Inv. range |
| 202 | C | CR | 0.05 | −20 | R | 0.1 | None | Inv. range |
| 203 | C | CR | 0.05 | −40 | R | 0.1 | None | Inv. range |
| 204 | C | CR | 0.05 | −20 | R | 0.1 | None | Inv. range |
| 205 | C | CR | 0.05 | 0 | R | 0.1 | None | Inv. range |
| 206 | C | CR | 0.05 | 5 | R | 0.1 | None | Inv. range |
| 207 | C | CR | 0.05 | 15 | R | 0.1 | None | Inv. range |
| 208 | C | CR | 0.05 | 25 | R | 0.1 | None | Inv. range |
| 209 | C | CR | 0.05 | 40 | R | 0.1 | Yes | Comp. Ex. |
| 210 | D | CR | 0.05 | −20 | R | 0.1 | None | Inv. range |
| 211 | D | CR | 0.05 | −40 | R | 0.1 | None | Inv. range |
| 212 | D | CR | 0.05 | −20 | R | 0.1 | None | Inv. range |
| 213 | D | CR | 0.05 | 0 | R | 0.1 | None | Inv. range |
| 214 | D | CR | 0.05 | 5 | R | 0.1 | None | Inv. range |
| 215 | D | CR | 0.05 | 15 | R | 0.1 | None | Inv. range |
| 216 | D | CR | 0.05 | 25 | R | 0.1 | None | Inv. range |
| 217 | D | CR | 0.05 | 40 | R | 0.1 | Yes | Comp. Ex. |
| 218 | E | CR | 0.05 | −20 | R | 0.1 | None | Inv. range |
| 219 | E | CR | 0.05 | −40 | R | 0.1 | None | Inv. range |
| 220 | E | CR | 0.05 | −20 | R | 0.1 | None | Inv. range |
| 221 | E | CR | 0.05 | 0 | R | 0.1 | None | Inv. range |
| 222 | E | CR | 0.05 | 5 | R | 0.1 | None | Inv. range |

TABLE 14-continued

| Ex. no. | Steel type | Plating type | H am't (%) | Dew point (° C.) | Work me-thod | Work am't (mm) | Cracks | Class |
|---|---|---|---|---|---|---|---|---|
| 223 | E | CR | 0.05 | 15 | R | 0.1 | None | Inv. range |
| 224 | E | CR | 0.05 | 25 | R | 0.1 | None | Inv. range |
| 225 | E | CR | 0.05 | 40 | R | 0.1 | Yes | Comp. Ex. |
| 226 | C | CR | 0.05 | −40 | R | 0.1 | None | Inv. range |
| 227 | C | CR | 0.01 | 0 | R | 0.1 | None | Inv. range |
| 228 | C | CR | 0.01 | 15 | R | 0.1 | None | Inv. range |
| 229 | C | CR | 0.01 | 40 | R | 0.1 | Yes | Comp. Ex. |
| 230 | D | CR | 0.01 | −40 | R | 0.1 | None | Inv. range |
| 231 | D | CR | 0.01 | 0 | R | 0.1 | None | Inv. range |
| 232 | D | CR | 0.01 | 15 | R | 0.1 | None | Inv. range |
| 233 | D | CR | 0.01 | 40 | R | 0.1 | Yes | Comp. Ex. |
| 234 | E | CR | 0.01 | −40 | R | 0.1 | None | Inv. range |
| 235 | E | CR | 0.01 | 0 | R | 0.1 | None | Inv. range |
| 236 | E | CR | 0.01 | 15 | R | 0.1 | None | Inv. range |
| 237 | E | CR | 0.01 | 40 | R | 0.1 | Yes | Comp. Ex. |
| 238 | C | CR | 0.005 | −40 | R | 0.1 | None | Inv. range |
| 239 | C | CR | 0.005 | 0 | R | 0.1 | None | Inv. range |
| 240 | C | CR | 0.005 | 15 | R | 0.1 | None | Inv. range |
| 241 | C | CR | 0.005 | 40 | R | 0.1 | Yes | Comp. Ex. |
| 242 | D | CR | 0.005 | −40 | R | 0.1 | None | Inv. range |
| 243 | D | CR | 0.005 | −40 | R | 0.1 | None | Inv. range |
| 244 | D | CR | 0.005 | 0 | R | 0.1 | None | Inv. range |
| 245 | D | CR | 0.005 | 15 | R | 0.1 | None | Inv. range |
| 246 | D | CR | 0.005 | 40 | R | 0.1 | Yes | Comp. Ex. |
| 247 | E | CR | 0.005 | 0 | R | 0.1 | None | Inv. range |
| 248 | E | CR | 0.005 | 15 | R | 0.1 | None | Inv. range |
| 249 | E | CR | 0.005 | 40 | R | 0.1 | Yes | Comp. Ex. |
| 250 | D | CR | 80 | 40 | N | 0 | Yes | Comp. Ex. |
| 251 | D | CR | 80 | −20 | N | 0 | Yes | Comp. Ex. |
| 252 | D | CR | 80 | 0 | N | 0 | Yes | Comp. Ex. |
| 253 | D | CR | 80 | 5 | N | 0 | Yes | Comp. Ex. |
| 254 | D | CR | 80 | 15 | N | 0 | Yes | Comp. Ex. |
| 255 | D | CR | 80 | 25 | N | 0 | Yes | Comp. Ex. |
| 256 | D | CR | 80 | 40 | N | 0 | Yes | Comp. Ex. |
| 257 | D | AL | 80 | −40 | N | 0 | Yes | Comp. Ex. |
| 258 | D | AL | 80 | −20 | N | 0 | Yes | Comp. Ex. |
| 259 | D | AL | 80 | 0 | N | 0 | Yes | Comp. Ex. |
| 260 | D | AL | 80 | 5 | N | 0 | Yes | Comp. Ex. |
| 261 | D | AL | 80 | 15 | N | 0 | Yes | Comp. Ex. |
| 262 | D | AL | 80 | 25 | N | 0 | Yes | Comp. Ex. |
| 263 | D | AL | 80 | 40 | N | 0 | Yes | Comp. Ex. |
| 264 | D | CR | 8 | −40 | N | 0 | Yes | Comp. Ex. |
| 265 | D | CR | 8 | −20 | N | 0 | Yes | Comp. Ex. |
| 266 | D | CR | 8 | 0 | N | 0 | Yes | Comp. Ex. |
| 267 | D | CR | 8 | 5 | N | 0 | Yes | Comp. Ex. |
| 268 | D | CR | 8 | 15 | N | 0 | Yes | Comp. Ex. |
| 269 | D | CR | 8 | 25 | N | 0 | Yes | Comp. Ex. |
| 270 | D | CR | 8 | 40 | N | 0 | Yes | Comp. Ex. |
| 271 | D | AL | 8 | −40 | N | 0 | Yes | Comp. Ex. |
| 272 | D | AL | 8 | −20 | N | 0 | Yes | Comp. Ex. |
| 273 | D | AL | 8 | 0 | N | 0 | Yes | Comp. Ex. |
| 274 | D | AL | 8 | 5 | N | 0 | Yes | Comp. Ex. |
| 275 | D | AL | 8 | 15 | N | 0 | Yes | Comp. Ex. |
| 276 | D | AL | 8 | 25 | N | 0 | Yes | Comp. Ex. |
| 277 | D | AL | 8 | 40 | N | 0 | Yes | Comp. Ex. |
| 278 | C | CR | 2 | 15 | R | 0 | Yes | Comp. Ex. |
| 279 | C | CR | 2 | 15 | R | 0 | Yes | Comp. Ex. |
| 280 | C | CR | 2 | 15 | R | 0.1 | Yes | Comp. Ex. |
| 281 | C | CR | 2 | 15 | R | 0.2 | Yes | Comp. Ex. |
| 282 | D | CR | 2 | 15 | R | 0 | Yes | Comp. Ex. |
| 283 | D | CR | 2 | 15 | R | 0 | Yes | Comp. Ex. |
| 284 | D | CR | 2 | 15 | R | 0.1 | None | Inv. range |
| 285 | D | CR | 2 | 15 | R | 0.2 | None | Inv. range |
| 286 | E | CR | 2 | 15 | R | 0 | Yes | Comp. Ex. |
| 287 | E | CR | 2 | 15 | R | 0 | Yes | Comp. Ex. |
| 288 | E | CR | 2 | 15 | R | 0.1 | None | Inv. range |
| 289 | E | CR | 2 | 15 | R | 0.2 | None | Inv. range |

INDUSTRIAL APPLICABILITY

According to exemplary embodiments of the present invention, it can be possible to produce a high-strength part for an automobile that is light in weight and superior in collision safety by cooling and hardening after shaping in a mold.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements, media and methods which, although not explicitly shown or described herein, embody the principles of the invention and are thus within the spirit and scope of the present invention. In addition, all publications referenced herein above are incorporated herein by reference in their entireties.

The invention claimed is:

1. A method for producing a high-strength part, comprising:

providing a steel sheet comprising between about 0.05 and 0.55 wt % C, and between about 0.1 to 3 wt % Mn;

heating the steel sheet to a temperature between an Ac3 temperature and a melting point in an atmosphere comprising between about 0 and 4% hydrogen, where the atmosphere has a dew point less than about 0° C. or less;

initiating a shaping of the steel sheet at a temperature higher than a temperature at which ferrite, pearlite, bainite, and martensite transformations occur;

cooling and hardening the steel sheet after shaping in a mold to form the high-strength part having a tensile strength of about 980 MPa or more;

post-processing the part, wherein the post-processing comprises shearing the part; and shearing the part again at a distance between about 200 and 2000 μm from a worked end of the part.

2. The method of claim 1, wherein after shearing the part again, a residual stress of a tension stress or a compression stress is 600 MPa or less at the worked end.

3. The method of claim 1, wherein the steel sheet further comprises between about 0.005 and 0.1 wt % Al, less than about 0.02 wt % S, less than about 0.03 wt % P, and less than about 0.01 wt % N, with the balance comprising Fe and unavoidable impurities.

4. The method of claim 3, wherein the steel sheet further comprises between about 0.01 and 1.0 wt % Cr and less than about 1.0 wt % Si.

5. The method of claim 3, wherein the steel sheet further comprises between about 0.01 and 1.0 wt % Cr, less than about 1.0 wt % Si, between about 0.0002 and 0.0050 wt % B, and between (3.42×N %+0.001) wt % and 3.99×(C %−0.1) wt % Ti, where N % represents the wt % of N and C % represents the wt % of C.

6. The method of claim 3, wherein the steel sheet further comprises less than about 0.015 wt % O.

7. The method of claim 1, wherein the steel sheet provided is treated by at least one of an aluminum plating process, an aluminum-zinc plating process, or a zinc plating process.

8. A method for producing a high-strength part, comprising:

providing a steel sheet comprising between about 0.05 and 0.55 wt % C, and between about 0.1 to 3 wt % Mn;

heating the steel sheet to a temperature between an Ac3 temperature and a melting point in an atmosphere comprising between about 0 and 4% hydrogen, where the atmosphere has a dew point less than about 0° C. or less;

initiating a shaping of the steel sheet at a temperature higher than a temperature at which ferrite, pearlite, bainite, and martensite transformations occur;

cooling and hardening the steel sheet after shaping in a mold to form the high-strength part; and post-processing the part, wherein the post-processing comprises at least one of punching or cutting the part using a punch or die, wherein the punch or die comprises a cutting blade tip having a tip parallel part, a step difference, and a cutting blade base, wherein a height of the step difference is between about half of a thickness of the steel sheet and 100 mm and a width of the step difference is continuously decreasing in a range that is between about 0.01 mm to about 3.0 mm in a direction from the cutting blade base to the cutting blade tip, wherein a ratio of a difference of a width between the cutting blade base and the cutting blade tip to the height of the step difference is less than 0.5, and wherein an angle formed by the step difference and a parallel part of the cutting blade base is about 95 to 179 degrees, to provide a clearance between the parallel part of the cutting blade base and the die between about 4.3 and 25% of the thickness of the steel sheet.

9. The method of claim 8, wherein the steel sheet further comprises between about 0.005 and 0.1 wt % Al, less than about 0.02 wt % S, less than about 0.03 wt % P, and less than about 0.01 wt % N, with the balance comprising Fe and unavoidable impurities.

10. The method of claim 9, wherein the steel sheet further comprises between about 0.01 and 1.0 wt % Cr and less than about 1.0 wt % Si.

11. The method of claim 9, wherein the steel sheet further comprises between about 0.01 and 1.0 wt % Cr, less than about 1.0 wt % Si, between about 0.0002 and 0.0050 wt % B, and between (3.42×N %+0.001) wt % and 3.99×(C %−0.1) wt % Ti, where N % represents the wt % of N and C % represents the wt % of C.

12. The method of claim 9, wherein the steel sheet further comprises less than about 0.015 wt % O.

13. The method of claim 8, wherein the steel sheet provided is treated by at least one of an aluminum plating process, an aluminum-zinc plating process, or a zinc plating process.

14. A method for producing a high-strength part, comprising:

providing a steel sheet comprising between about 0.05 and 0.55 wt % C, and between about 0.1 to 3 wt % Mn;

heating the steel sheet to a temperature between an Ac3 temperature and a melting point in an atmosphere comprising less than about 10% hydrogen, where the atmosphere has a dew point less than about 30° C. or less;

initiating a shaping of the steel sheet at a temperature higher than a temperature at which ferrite, pearlite, bainite, and martensite transformations occur;

cooling and hardening the steel sheet after shaping in a mold to form the high-strength part; and punching the steel sheet using a punching tool comprising a bending blade having a shape projecting out at a front of at least one of a punch or a die, wherein a radius of curvature of a shoulder of the bending blade is greater than about 0.2 mm to provide a clearance that is less than about 25% of a thickness of the steel sheet.

15. The method of claim 14, wherein the steel sheet further comprises between about 0.005 and 0.1 wt % Al, less than about 0.02 wt % S, less than about 0.03 wt % P, and less than about 0.01 wt % N, with the balance comprising Fe and unavoidable impurities.

16. The method of claim 15, wherein the steel sheet further comprises between about 0.01 and 1.0 wt % Cr and less than about 1.0 wt % Si.

17. The method of claim 15, wherein the steel sheet further comprises between about 0.01 and 1.0 wt % Cr, less than about 1.0 wt % Si, between about 0.0002 and 0.0050 wt % B, and between (3.42×N %+0.001) wt % and 3.99×(C %−0.1) wt % Ti, where N % represents the wt % of N and C % represents the wt % of C.

18. The method of claim 15, wherein the steel sheet further comprises less than about 0.015 wt % O.

19. The method of claim 14, wherein the steel sheet provided is treated by at least one of an aluminum plating process, an aluminum-zinc plating process, or a zinc plating process.

20. A method for producing a high-strength part, comprising:

providing a steel sheet comprising between about 0.05 and 0.55 wt % C, and between about 0.1 to 3 wt % Mn;

heating the steel sheet to a temperature between an Ac3 temperature and a melting point in an atmosphere comprising less than about 10% hydrogen, where the atmosphere has a dew point less than about 30° C. or less;

initiating a shaping of the steel sheet at a temperature higher than a temperature at which ferrite, pearlite, bainite, and martensite transformations occur;

cooling and hardening the steel sheet after shaping in a mold to form the high-strength part; and punching the steel sheet using a punching tool comprising a bending blade having a shape projecting out at a front of at least one of a punch or a die, and wherein an angle of a shoulder of the bending blade is between about 100° and 170° to provide a clearance that is less than about 25% of a thickness of the steel sheet.

21. The method of claim 20, wherein a radius of curvature of a shoulder of the bending blade is greater than about 0.2 mm.

22. The method of claim 20, wherein the steel sheet further comprises between about 0.005 and 0.1 wt % Al, less than about 0.02 wt % S, less than about 0.03 wt % P, and less than about 0.01 wt % N, with the balance comprising Fe and unavoidable impurities.

23. The method of claim 22, wherein the steel sheet further comprises between about 0.01 and 1.0 wt % Cr and less than about 1.0 wt % Si.

24. The method of claim 22, wherein the steel sheet further comprises between about 0.01 and 1.0 wt % Cr, less than about 1.0 wt % Si, between about 0.0002 and 0.0050 wt % B, and between (3.42×N %+0.001) wt % and 3.99×(C %−0.1) wt % Ti, where N % represents the wt % of N and C % represents the wt % of C.

25. The method of claim 22, wherein the steel sheet further comprises less than about 0.015 wt % O.

26. The method of claim 20, wherein the steel sheet provided is treated by at least one of an aluminum plating process, an aluminum-zinc plating process, or a zinc plating process.

27. A method for producing a high-strength part, comprising:

providing a steel sheet comprising between about 0.05 and 0.55 wt % C, and between about 0.1 to 3 wt % Mn;

heating the steel sheet to a temperature between an Ac3 temperature and a melting point in an atmosphere comprising between about 0 and 10% hydrogen, where the atmosphere has a dew point less than about 30° C. or less;

initiating a shaping of the steel sheet at a temperature higher than a temperature at which ferrite, pearlite, bainite, and martensite transformations occur;

shearing the part to within 10 mm from a bottom dead point during a hot shaping when the steel is austenite; and cooling and hardening the steel sheet after shaping in a mold to form the high-strength part.

28. The method of claim 27, wherein the steel sheet further comprises between about 0.005 and 0.1 wt % Al, less than about 0.02 wt % S, less than about 0.03 wt % P, and less than about 0.01 wt % N, with the balance comprising Fe and unavoidable impurities.

29. The method of claim 28, wherein the steel sheet further comprises between about 0.01 and 1.0 wt % Cr and less than about 1.0 wt % Si.

30. The method of claim 28, wherein the steel sheet further comprises between about 0.01 and 1.0 wt % Cr, less than about 1.0 wt % Si, between about 0.0002 and 0.0050 wt % B, and between (3.42×N %+0.001) wt % and 3.99×(C %−0.1) wt % Ti, where N % represents the wt % of N and C % represents the wt % of C.

31. The method of claim 28, wherein the steel sheet further comprises less than about 0.015 wt % O.

32. The method of claim 27, wherein the steel sheet provided is treated by at least one of an aluminum plating process, an aluminum-zinc plating process, or a zinc plating process.

* * * * *